US008753584B2

(12) United States Patent
Posner et al.

(10) Patent No.: US 8,753,584 B2
(45) Date of Patent: Jun. 17, 2014

(54) SYSTEM OR DEVICE FOR BIOCHEMICAL ANALYSIS HAVING AT LEAST ONE ELECTROOSMOTIC PUMP

(71) Applicants: Illumina, Inc., San Diego, CA (US); The Arizona Board of Regents for and on Behalf of Arizona State University, Scottsdale, AZ (US)

(72) Inventors: Jonathan Posner, Seattle, WA (US); Kamil Salloum, Portland, OR (US); Michal Lebl, San Diego, CA (US); Mark Reed, San Diego, CA (US); Dale Buermann, San Diego, CA (US); Matthew Hage, San Diego, CA (US); Bryan Crane, San Diego, CA (US); David Heiner, San Diego, CA (US); Robert Kain, San Diego, CA (US); Michael Schroeder, Chandler, AZ (US)

(73) Assignees: Illumina, Inc., San Diego, CA (US); The Arizona Board of Regents for and on behalf of Arizona State Univeristy, Scottsdale, AZ (US)

( * ) Notice: Subject to any disclaimer, the term of this patent is extended or adjusted under 35 U.S.C. 154(b) by 0 days.

(21) Appl. No.: 14/085,122

(22) Filed: Nov. 20, 2013

(65) Prior Publication Data

US 2014/0080205 A1 Mar. 20, 2014

Related U.S. Application Data

(63) Continuation of application No. 13/551,704, filed on Jul. 18, 2012, now Pat. No. 8,597,594, which is a continuation of application No. 12/626,353, filed on Nov. 25, 2009, now Pat. No. 8,252,250.

(60) Provisional application No. 61/118,073, filed on Nov. 26, 2008.

(51) Int. Cl.
*B01L 3/00* (2006.01)

(52) U.S. Cl.
USPC ..... 422/505; 422/50; 422/501; 422/502; 422/503; 422/504; 436/180; 429/405; 429/409

(58) Field of Classification Search
USPC ..... 422/50, 501–505; 436/180; 429/405, 429/409
See application file for complete search history.

(56) References Cited

U.S. PATENT DOCUMENTS 3,427,978 A 2/1969 Hanneman et al.
5,223,114 A 6/1993 Zare et al.

(Continued)

FOREIGN PATENT DOCUMENTS

EP 1873532 A1 1/2008
JP 45-034910 11/1970

(Continued)

OTHER PUBLICATIONS

Forbes, Peter; "*Self-Cleaning Materials*"; www.SciAm.com; Aug. 2008; 8 pgs.

(Continued)

*Primary Examiner* — Jyoti Nagpaul
(74) *Attorney, Agent, or Firm* — Dean Small; Jason P. Gross; The Small Patent Law Group LLC

(57) ABSTRACT

An electroosmotic (EO) pump is provided that includes a housing having a pump cavity, a porous core medium and electrodes. The porous core medium is positioned within the pump cavity to form an exterior reservoir that extends at least partially about an exterior surface of the porous core medium. The porous core medium has an open inner chamber provided therein. The inner chamber represents an interior reservoir. The electrodes are positioned in the inner chamber and are positioned proximate the exterior surface. The electrodes induce flow of a fluid through the porous core medium between the interior and exterior reservoirs, wherein a gas is generated when the electrodes induce flow of the fluid. The housing has a fluid inlet to convey the fluid to one of the interior reservoir and the exterior reservoir. The housing has a fluid outlet to discharge the fluid from another of the interior reservoir and the exterior reservoir. The housing has a gas removal device to remove the gas from the pump cavity.

20 Claims, 25 Drawing Sheets

(56) References Cited

U.S. PATENT DOCUMENTS

| | | | |
|---|---|---|---|
| 5,580,435 | A | 12/1996 | Kovacs |
| 6,488,831 | B1 | 12/2002 | Hayes |
| 6,857,449 | B1 | 2/2005 | Chow |
| 6,890,411 | B1 | 5/2005 | Hayes et al. |
| 6,942,018 | B2 | 9/2005 | Goodson et al. |
| 6,991,024 | B2 | 1/2006 | Goodson et al. |
| 7,001,608 | B2 | 2/2006 | Fishman et al. |
| 7,037,416 | B2 | 5/2006 | Parce et al. |
| 7,070,681 | B2 | 7/2006 | Santiago et al. |
| 7,131,486 | B2 | 11/2006 | Goodson et al. |
| 7,134,486 | B2 | 11/2006 | Santiago et al. |
| 7,147,865 | B2 | 12/2006 | Fishman et al. |
| 7,185,697 | B2 | 3/2007 | Goodson et al. |
| 7,201,833 | B2 | 4/2007 | Lauks et al. |
| 7,231,839 | B2 | 6/2007 | Huber et al. |
| 7,238,323 | B2 | 7/2007 | Knapp et al. |
| 7,316,543 | B2 | 1/2008 | Goodson et al. |
| 2003/0085024 | A1 | 5/2003 | Santiago et al. |
| 2004/0115838 | A1 | 6/2004 | Quake et al. |
| 2004/0163957 | A1 | 8/2004 | Neyer et al. |
| 2005/0061669 | A1 | 3/2005 | Woudenberg et al. |
| 2005/0205241 | A1 | 9/2005 | Goodson et al. |
| 2006/0029851 | A1 | 2/2006 | Santiago et al. |
| 2006/0215155 | A1 | 9/2006 | Weber |
| 2006/0254913 | A1 | 11/2006 | Myers et al. |
| 2007/0009366 | A1 | 1/2007 | Myers et al. |
| 2007/0102293 | A1 | 5/2007 | Tai et al. |
| 2007/0202525 | A1 | 8/2007 | Quake et al. |
| 2007/0286773 | A1 | 12/2007 | Schlautmann et al. |
| 2009/0136362 | A1 | 5/2009 | Yanagisawa et al. |
| 2011/0072914 | A1 | 3/2011 | Lebl |

FOREIGN PATENT DOCUMENTS

| | | | |
|---|---|---|---|
| JP | 62-025249 | | 2/1987 |
| JP | 2001-232792 | A | 8/2001 |
| JP | 2004-290937 | A | 10/2004 |
| JP | 2006-311796 | A | 11/2006 |
| WO | WO 2006017404 | | 2/2006 |
| WO | WO 2007123744 | | 11/2007 |
| WO | WO 2008002502 | | 1/2008 |

OTHER PUBLICATIONS

Joneja, Aric and Huang, Xiaohua; "*A Device for Automated Hydordynamic Shearing of Genomic DNA*"; Department of Bioengineering, University of California, San Diego, La Jolla, CA, USA; Jun. 2009; 3 pgs.

Joneja, Aric and Huang, Xiaohua; Supplemental Material for: "*A Device for Automated Hydordynamic Shearing of Genomic DNA*"; Department of Bioengineering, University of California, San Diego, La Jolla, CA, USA; Jun. 2009; 3 pgs.

Brask, Anders; "Electroosmotic Micropumps"; PhD Thesis, s961052; Aug. 31, 2005; 151 pgs.

Devasenathipathy, Shankar et al; "Particle Tracking Techniques for Electrokinetic Microchannel Flows"; Anal, Chem. 2002, 74, 3704-3713.

Kim, Daejoong et al; "High Flow Rate Per Power Pumping of Aqueous Solutions and Organic solvents with Electroosmotic Pumps"; IMECE2005-81198; Nov. 5-11, 2005, 4 pgs.

Seiler , K. et al; "Electroosmotic Pumping and Valveless Control of Fluid-Flow Within a Manifold of Capillaries on a Glass Chip"; Abstract; 1 pg.

Tripp, Jennifer A. et al; "High-Pressure Electroosmotic Pumps Based on Porous Polymer Monoliths"; Sensors and Actuators B 99 (2004) 66-73.

Wu, Junqing et al.; "AC Electrokinetic Pumps for Micro/NanoFluidics"; IMECE2004-61836; Nov. 2004; 10 pgs.

Yao, Shuhuai et al.; "Porous Glass Electroosmotic Pumps: Theory"; Journal of colloid and Interface Science 268 (2003) 133-142.

Yao, Shuhuai et al.; "Electroosmotic Pumps Fabricated from Porous Silicon Membranes"; Journal of Microelectromechanical Systems, vol. 15, No. 3, Jun. 2006, 717-728.

International Written Opinion and Search Report for PCT/US2009/065938, mailed on Jul. 12, 2010. 11pgs.

Japanese of Action of Aug. 9, 2013 in Japanese Patent Application No. 2011-537743 (3 pages in length, and 3 pages of translation).

SYSTEM OR DEVICE FOR BIOCHEMICAL ANALYSIS HAVING AT LEAST ONE ELECTROOSMOTIC PUMP

CROSS REFERENCE TO RELATED APPLICATIONS

This application is a continuation of U.S. application Ser. No. 13/551,704, filed on Jul. 18, 2012, which is a continuation of U.S. application Ser. No. 12/626,353 (now U.S. Pat. No. 8,252,250), filed on Nov. 25, 2009, which claims the benefit of U.S. Provisional Application No. 61/118,073, filed Nov. 26, 2008. Each of the above applications is hereby incorporated by reference in its entirety.

BACKGROUND OF THE INVENTION

The present invention relates generally to electroosmotic pumps and more particularly to electroosmotic pumps for use in biochemical analysis system.

Recently, electroosmotic (EO) pumps have been proposed for use in a limited number of applications. An EO pump generally comprises a fluid chamber that is separated into an inlet reservoir and an outlet reservoir by a planar medium forming a dividing wall there between. The medium may also be referred to as a frit. An anode and a cathode are provided within the inlet and outlet reservoirs, respectively, on opposite sides of the medium. When an electrical potential is applied across the anode and cathode, the medium forms a pumping medium and fluid is caused to flow through the pumping medium through electroosmotic drag. Examples of EO pumps are described in U.S. patent application Ser. No. 11/168,779 (Publication No. 2007/0009366), U.S. patent application Ser. No. 10/912,527 (Publication No. 2006/0029851), and U.S. application Ser. No. 11/125,720 (Publication No. 2006/0254913) all of which are expressly incorporated herein in their entireties. The process by which fluid pumping occurs is referred to as an electroosmotic effect. One byproduct of the electroosmotic effect is that gas bubbles (typically hydrogen and oxygen) are generated within the pump chamber due to electrolysis. These bubbles typically form at the anode and cathode surfaces and potentially nucleate within or along the surfaces of the electrodes, pumping medium, or pump housing. When gas builds up excessively it will detract from the pump performance.

Various techniques have been proposed to remove the gas, once generated at the electrodes, from the pump chamber to avoid detrimentally impacting the performance of the EO pump. For example, the '366 Publication describes an "in-plane" electroosmotic pump that seeks to reduce deterioration of performance of the pump due to the electrolytic gas generation. The '366 Publication describes, among other things, the use of sheaths provided around the electrodes. The sheaths are formed of a material that passes liquid and ions, but blocks bubbles and gas. The '913 Publication describes an EO pump that is orientation independent, wherein the gases that are generated by electrolytic decomposition are collected and routed to a catalyst, and then recombined by the catalyst to form liquid. The catalyst is located outside of the reservoir and liquid produced by the catalyst is reintroduced into the fluid reservoir through an osmotic membrane.

However, conventional EO pumps have exhibited certain disadvantages. For example, the gas management techniques used by existing EO pumps can place undesirable design constraints on the degree to which the EO pumps can be miniaturized. When conventional EO pumps are reduced in volume, a relative amount of gas maintained with the pump chamber increases relative to the size of the medium. As the gas to medium area ratio increases, the flow capacity reduces and in some cases the flow rate may be undesirably low. The flow capacities and pump volumes of conventional EO pumps render such EO pumps impractical for use in certain small scale applications, such as in certain biochemical analyses.

Biochemical analysis is used, among other things, for the analysis of genetic material. In order to expedite the analysis of genetic material, a number of new DNA sequencing technologies have recently been reported that are based on the parallel analysis of amplified and unamplified molecules. These new technologies frequently rely upon the detection of fluorescent nucleotides and oligonucleotides. Furthermore, these new technologies frequently depend upon heavily automated processes that must perform at a high level of precision. For example, a computing system may control a fluid flow subsystem that is responsible for initiating several cycles of reactions within a microfluidic flow cell. These cycles may be performed with different solutions and/or temperature and flow rates. However, in order to control the fluid flow subsystem a variety of pumping devices are operated. Some of these devices have movable parts that may disturb or negatively affect the reading and analyzing of the fluorescent signals. Furthermore, after one or more cycles the pumps may need to be exchanged or cleaned thereby increasing the amount of time to complete a run that consists of several cycles.

Biochemical analysis is often conducted on an extremely small microscopic scale and thus can benefit from the use of similarly small equipment, such as microfluidic flow cells, manifolds, and the like. Miniaturization of conventional EO pumps has been constrained such that the full potential of EO flow for pumping fluids for analytical analyses such as nucleic acid sequencing reactions has not been met.

In addition, different methods and systems in biological or chemical analysis may desire nucleic acid fragments (e.g., DNA fragments having limited sizes). For example, various sequencing platforms use DNA libraries comprising DNA fragments. The DNA fragments may be separated into single-stranded nucleic acid templates and subsequently sequenced. Various methods for DNA fragmenting are known, such as enzymatic digestion, sonication, nebulization, and hydrodynamic shearing that uses, for example, syringes. However, each of the above methods may have undesirable limitations.

A need remains for improved EO pump designs having a small scale size but that still efficiently remove gas at a rate sufficient to sustain a high flow rate. Furthermore, there is a need for alternative methods of fragmenting nucleic acids that may be used in biological or chemical analysis.

BRIEF DESCRIPTION OF THE INVENTION

In accordance with at least one embodiment, an electroosmotic (EO) pump is provided that includes a housing having a pump cavity, a porous core medium and electrodes. The porous core medium is positioned within the pump cavity to form an exterior reservoir that extends at least partially about an exterior surface of the porous core medium. The porous core medium surrounds an open inner chamber. The inner chamber represents an interior reservoir. The electrodes are positioned in the inner chamber and are positioned in the exterior reservoir, for example, proximate the exterior surface. The electric field applied across the electrodes induce flow of a fluid through the porous core medium between the interior and exterior reservoirs, wherein a gas is generated when the electrodes induce flow of the fluid. The housing has a fluid inlet to convey the fluid to one of the interior reservoir and the exterior reservoir. The housing has a fluid outlet to discharge the fluid from another of the interior reservoir and the exterior reservoir. The housing has a gas removal device to remove the gas from the pump cavity.

The gas removal device may comprise a gas outlet to discharge the gas from the pump cavity. The gas that is generated when the electrodes induce flow of the fluid comprises hydrogen and oxygen. Alternatively or additionally, the gas removal device can comprise a catalyst to recombine the hydrogen and oxygen gas to form water, thereby removing the gas from the pump cavity.

The porous core medium may be configured to wrap about a longitudinal axis that projects along the interior reservoir. The interior reservoir has at least one open end. The porous core medium may be formed as an elongated cylinder that is open at a first end. The interior reservoir is positioned within the cylinder, while the exterior reservoir extends about the exterior surface of the cylinder.

The pump cavity may include a top wall holding a vent membrane proximate to the gas outlet to permit gas to vent from the pump cavity. In particular embodiments, the vent membrane is gas permeable and fluid impermeable. Optionally, the pump cavity may include an open top that is covered by a vent membrane proximate the gas outlet to permit gas to vent from the pump cavity. The gas can vent to atmosphere or can be pulled by an applied vacuum. Accordingly, the pump cavity can be in gaseous communications with a vacuum cavity. The vacuum cavity can have a vacuum inlet coupled to a vacuum source to induce vacuum within the vacuum chamber. Optionally, surfaces on at least one of the pump cavity, porous core medium and electrodes are hydrophilic or coated with a hydrophilic material to reduce attachment of gas bubbles and induce migration of gas bubbles toward the gas removal device. At least one of the electrodes may constitute a pin shape, for example, to reduce attachment of gas bubbles or induce release of gas bubbles from the electrode. At least one of the electrodes may include a helical spring shape extending along one of the inner chambers and the exterior surface of the porous core medium.

Also provided is an electroosmotic (EO) pump that includes a source of periodic energy configured to induce detachment of gas bubbles from surfaces of the EO pump. In particular embodiments, the periodic source includes a motion source to induce motion into at least one of the housing, electrodes, the gas bubbles and the porous core medium, for example, to actively cause gas bubbles to detach from the surfaces of the EO pump. Optionally, a motion source may be used to induce motion into at least one of the electrodes, for example, to actively cause gas bubbles to detach from the electrode(s). Motion can be induced in one or both electrodes independently of motion in the rest of the pump. For example, motion can be induced specifically in one or both electrodes such that the motion source does not induce substantial motion in the housing. The motion source can be, for example, one of an ultrasound source, a piezo actuator, and an electromagnetic source. Optionally, an ultrasound source may be configured to introduce motion only into the gas bubbles without causing the housing or electrodes to physically move. Alternatively or additionally, a periodic source can be configured to produce periodicity in the current or voltage for at least one of the electrodes. The periodicity can have a frequency that results in actively causing gas bubbles to detach from the electrodes, while still producing sufficient electroosmotic force to drive fluid flow through the pump. A baseline current or voltage can be applied with an additional periodic waveform applied in addition to the baseline signal.

In accordance with at least one embodiment, an electroosmotic (EO) pump is provided that comprises a housing having a vacuum cavity, the housing having a vacuum inlet configured to be coupled to a vacuum source to induce a vacuum within the vacuum cavity. A core retention member is provided within the vacuum cavity. The core retention member has an inner pump chamber extending along a longitudinal axis. The core retention member has a fluidic inlet and a fluidic outlet. The core retention member is gas permeable and fluid impermeable. A porous core medium is provided within the core retention member between the fluidic inlet and fluidic outlet. Electrodes are located within the inner chamber, for example, proximate to the core retention member to induce flow of a fluid through the porous core medium. The electrodes are separated from one another by the porous core medium along the longitudinal axis of the core retention member.

As the gas is generated when flow of the fluid is induced through the porous core medium, the gas migrates outward through the core retention member to the vacuum cavity. The porous core medium has opposite end portions and the electrodes can be spaced relative to the porous core medium to overlap and be arranged concentric with the opposite end portions of the porous core medium. The electrodes introduce a potential difference across the porous core medium that causes the fluid to flow in the direction of the longitudinal axis through the porous core medium.

When gas is generated as the fluid flows through the porous core medium, the vacuum induces the gas to migrate in a radial direction transverse to the longitudinal axis of the porous core medium outward through the core retention member. The porous core medium fills the inner pump chamber along the longitudinal axis. The core retention member has an elongated cylindrical shape open at opposite ends. The fluidic inlet and fluidic outlet are located at opposite ends of the inner pump chamber.

The core retention member may represent a tube having an outer wall formed of PTFE AF or gas permeable, liquid impermeable membrane with the fluid flowing along the tube within the outer wall, while gas is passed radially outward through the outer wall. Optionally, the porous core medium may comprise a film of packed nanoscale spheres forming a colloidal crystal. Alternatively, the porous core medium may comprise a collection of beads.

In one embodiment, a flow cell for use in a microfluidic detection system is provided. The flow cell includes a flow cell body having a channel that is configured to convey a solution through the flow cell body. The flow cell also includes a bottom surface and a top surface. The bottom surface is configured to be removably held by the detection system, and the top surface is transparent and permits light to pass there through. The flow cell body also includes fluidic inlet and outlet ports that are in fluid communication with the channel. A pump cavity is also provided in the flow cell body. The pump cavity fluidly communicates with, and is interposed between, an end of the channel and one of the fluidic inlet and outlet ports. An electroosmotic (EO) pump is held in the pump cavity. The EO pump induces flow of the solution through the EO pump and the channel between the fluidic inlet and outlet ports.

Optionally, the flow cell may include contacts that are disposed on at least one of the top and bottom surfaces of the flow cell body. The contacts are electrically coupled to the EO pump. In addition, the EO pump includes a porous core medium core that is positioned between electrodes that induce a flow rate of the liquid through the porous core medium based on a voltage potential maintained between the electrodes.

In one embodiment, a manifold for attaching to a detector subsystem within a microfluidic analysis system is provided. The manifold includes a housing that has a detector engaging end and a line terminating end. The housing has an internal passageway that extends therethrough and is configured to convey a solution. The detector engaging end is configured to be removably coupled to the detector subsystem. The passageway has one end that terminates at a passage inlet provided at the detector engaging end of the housing. The passage inlet is configured to sealably mate with a fluidic outlet port on the detector system. The line terminating end includes at least one receptacle that is configured to be coupled to a discharge line. The passageway has another end that terminates at a passage outlet at the receptacle. The passage outlet is configured to sealably mate with a connector on the discharge line. A pump cavity is also provided in the housing. The pump cavity is in fluid communication with, and interposed between, an end of the passageway and one of the passage inlet and outlet. The manifold also includes an electroosmotic (EO) pump(s) that is held in the pump cavity. The EO pump(s) induces flow of the solution through the EO pump and the passageway between the passage inlet and outlet.

In yet another embodiment, an apparatus for fragmenting nucleic acid is provided. The apparatus includes a sample reservoir that comprises a fluid having nucleic acids. The apparatus can also include a shear wall that is positioned within the sample reservoir. The shear wall includes a porous core medium that has pores that are sized to permit nucleic acids to flow therethrough. The apparatus also includes first and second chambers that are separated by the shear wall. The first and second chambers are in fluid communication with each other through the porous core medium of the shear wall. Also, the apparatus may include first and second electrodes that are located within the first and second chambers, respectively. The first and second electrodes are configured to generate an electric field that induces a flow of the sample fluid. The nucleic acids move through the shear wall thereby fragmenting the nucleic acids.

In another embodiment, an apparatus for fragmenting a species is provided. The apparatus includes a sample reservoir comprising a sample fluid having the species therein. The apparatus also includes electrodes located within the sample reservoir. The electrodes are configured to generate an electric field to move the species along a flow path. The apparatus further includes a shear wall positioned within the sample reservoir. The shear wall comprising a porous material having pores that are sized to permit species to flow therethrough. The shear wall is positioned within the flow path such that the species flow through the shear wall when the electrodes generate the electric field. The shear wall fragments the species as the species move therethrough.

The species may be polymers, such as a nucleic acids. The species may also be biomolecules, chemical compounds, cells, organelles, particles, and molecular complexes. The species may be charged so that an electric field exerts a force on the charged species. The species can move through the sample reservoir based on at least one of (a) the electroosmotic effect and (b) the force exerted on the species if the species is charged.

DETAILED DESCRIPTION OF THE INVENTION

Figure 1:
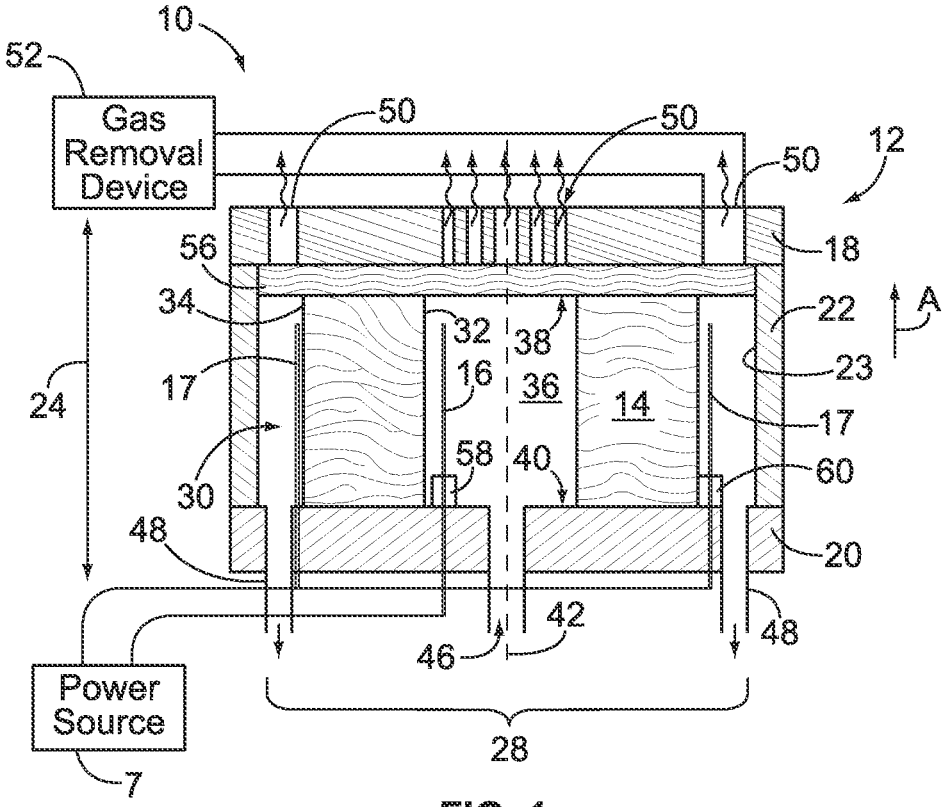
FIG. 1 illustrates a side sectional view of an electroosmotic (EO) pump formed in accordance with an embodiment of the present invention.

In accordance with at least certain embodiments described herein, one or more of the following technical effects may be achieved. Embodiments of the present invention provide an EO pump that affords efficient management of gas in real-time while generated as a byproduct of the electroosmotic process, such as the hydrogen gas and oxygen gas that are generated due to the splitting of water molecules at the electrodes that drive fluid flow. Through efficient gas management, embodiments of EO pumps described herein remove the gas at a rate sufficient to maintain desirable flow rates and prevent or at least hinder passage of the gas to downstream components within a desired application. Embodiments of the EO pumps described herein enable fluids to be pumped within pumping structures having an extremely small form factor and flow parameters that satisfy the design conditions associated with flow cells for biochemical assays, such as sequencing by synthesis reactions and the like.

A radial EO pump design is provided, embodiments of which will be described in further detail below. As will become apparent, embodiments of the radial design provide increased efficiency of gas management and increased fluid flow rates when compared to conventional EO pump designs having the same fluid dead volume. A possible explanation, although not necessarily intended as a limitation of all embodiments of the invention, is that the radial design has an active pump cross sectional area that is approximately it times larger than the active pump cross-sectional area of a conventional EO pump design having a substantially similar overall dead volume. The increased flow rate in the present radial pump design may be achieved in part due to the relation of flow rate to active pump surface area on a porous core medium (also referred to as a frit) within the EO pump. Again not wishing to be bound by theory, it is believed that flow rate scales linearly with active pump surface area of the frit. Hence, when the active pump surface area increases by approximately it times larger than a conventional planar pump, similarly, the flow rate increases by a proportional amount. Thus, a radial EO pump design is provided that has at least about 3 times more flow rate, as compared to the flow rate of a conventional pump design of similar dead volume and similar electrical potentials.

In addition, embodiments of the radial EO pump designs afford the opportunity to vent gas bubbles generated at the anode and cathode electrodes through a common semi-permeable membrane positioned along a common side or end of the radial EO pump. For example, a top end of the EO pump may be configured to vent gases for both the anode and cathode electrodes relying, at least in part, upon the buoyancy characteristics of gas within the fluid and the radial design which provides increased venting surface area compared to the venting surface area of standard EO pump designs having the same dead volume. More efficient removal of gas bubbles provides increased rate and stability of fluid flow in EO pumps. In some embodiments, the gases generated by electrodes may be induced to migrate to the vent through the application of a vacuum upon an opposite side of a gas permeable membrane or pressurization of the pump chamber itself. At least certain EO pump designs described herein afford the ability to substantially increase the surface area of the venting region relative to the overall volume of the EO pump. At least certain EO pump designs described herein provide a substantial reduction in total dead volume or package size, but maintain or increase the flow rate achieved by such EO pumps. At least certain EO pumps described herein afford ease of manufacturing and improved long term stability. Gas bubbles due to electrolysis tend to occlude the electrodes and pumping medium, resulting in reduced and unsteady flow as well as pressure generation. The location of bubble entrapment and level of bubble occlusion is unpredictable and unrepeatable due to random formation of electrolysis bubbles. Effective removal of electrolysis gases ensures stable and repeatable operation of EO pump over long run periods.

FIG. 1 illustrates a side sectional view of an electroosmotic (EO) pump 10 formed in accordance with an embodiment of the present invention. The pump 10 comprises a housing 12, a porous core medium 14, and electrodes 16 and 17. The housing 12 is constructed with upper and lower plates 18 and 20 that may be flat, arranged parallel to one another and spaced apart by a side wall 22. The lower plate 20 of the pump cavity 28 represents a bottom wall on which the porous core medium 14 is positioned.

Figure 2A:
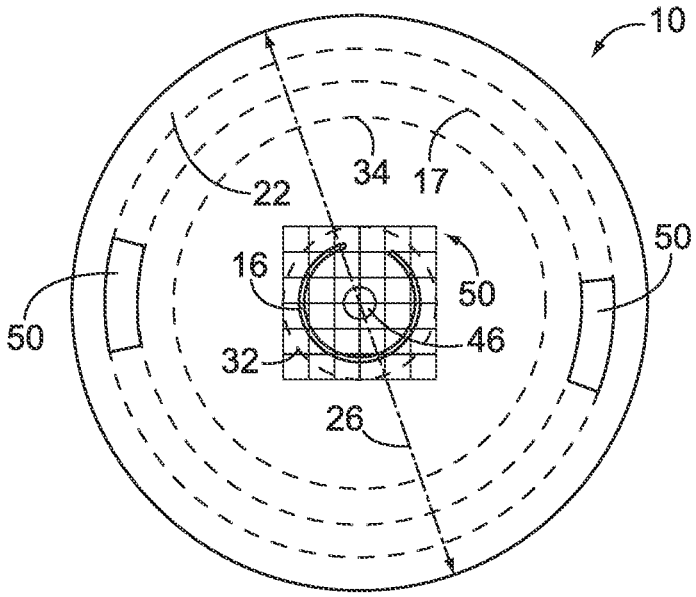
FIG. 2A illustrates a top plan view of the EO pump of FIG. 1.

FIG. 2A illustrates a top plan view of the EO pump 10 of FIG. 1. As shown in FIG. 2A, the upper and lower plates 18 and 20 and the side wall 22 are circular when viewed from the top down. In the example of FIGS. 1 and 2, the housing 12 is formed with a short, wide tubular or cylindrical shape in which the side wall 22 has a longitudinal length 24 that is less than the diameter 26 thereof. Alternatively, the housing 12, pump cavity 28 and/or porous core medium 14 may be constructed with different shapes and other dimensions. For example, the housing 12, pump cavity 28 and/or porous core medium 14 may be arranged with a long longitudinal length and a short diameter. As a further example, the housing 12, pump cavity 28 and/or porous core medium 14 may have a noncircular cross section, for example, the housing 12 may have a cross-section that is square, rectangular, triangular, oval hexagonal, polygonal and the like, when viewed from the top as in FIG. 2A. The housing 12, pump cavity 28 and/or porous core medium 14 may have a square, spherical, conical, polygonal or rectangular cross-section when viewed from the side as in FIG. 1 and as measured along the longitudinal axis 24. As a further example, the housing 12, pump cavity 28 and/or porous core medium 14 may be constructed as a spherical ball with a circular or oval cross section as measured along the longitudinal length 24 and along the diameter 26.

The housing 12 includes an interior pump cavity (generally denoted by the bracket 28) extending laterally between interior surfaces 23 of the side wall 22, and extending longitudinally between interior surfaces of the upper and lower plates 18 and 20. The porous core medium 14 is positioned within the pump cavity 28 and oriented in a configuration that is upright relative to gravity. For example, the porous core medium 14 may constitute a cylindrical frit that is placed upright within the pump cavity 28. In the example of FIGS. 1 and 2, the porous core medium 14 has an interior surface 32 and an exterior surface 34 formed concentric with one another in an open cored, tubular shape. Optionally, the interior surface 32 need not be concentric with the exterior surface 34.

For example, the interior surface 32 may have an oval or noncircular cross section, as viewed from the top down (for example FIG. 2A), while the exterior surface 34 may retain a substantially circular cross section as viewed from the top down. Alternatively, the interior surface 32 may follow a substantially circular path, while the exterior surface 34 is arranged in an oval or otherwise noncircular shape. The interior surface 32 of the porous core medium 14 surrounds the open inner chamber that represents an interior reservoir 36. The interior reservoir 36 is open at opposite ends 38 and 40 spaced apart from one another along the longitudinal axis 42.

The porous core medium 14 is spaced inward from the side wall 22 to form an exterior reservoir 30 that extends along a curved path about the porous core medium 14. The exterior reservoir 30 spans the gap between the exterior surface 34 of the porous core medium 14 and the inner surface 23 of the side wall 22. The interior reservoir 36 is centered along the longitudinal axis 42.

The porous core medium 14 may be formed as a porous volume with a matrix of continuous paths there through, where the paths span between the interior and exterior surfaces 32 and 34. The porous core medium 14 may be made of a semi-rigid material that is capable of maintaining a pre-established volumetric shape, while sustaining a surface electrical charge across the volume. The porous core medium 14 may be formed with homogeneous paths throughout (e.g. openings of similar size). Alternatively, the paths through the porous core medium 14 may be non-homogeneous. For example, when flow moves from inside radially outward, the paths may have larger openings proximate to the interior surface 32, while the sizes of the openings/paths within the medium 14 reduce in size as the paths move radially outward to the exterior surface 34. Alternatively, when flow moves from outside radially inward, the paths may have larger openings proximate to the exterior surface 34, while the sizes of the openings within the paths reduce as the paths move radially inward toward the interior surface 32. Useful porous core media include those having materials, pore sizes and other properties that are described, for example, in US 2006/0029851 A1, which is incorporated herein by reference.

The housing 12 has at least one fluid inlet 46, at least one fluid outlet 48 and at least one gas outlet 50. In the embodiment of FIGS. 1 and 2, the fluid inlet 46 is located in the lower plate 20 and conveys a fluid into the interior reservoir 36. The lower plate 20 also includes a pair of fluid outlets 48 to discharge the fluid from the exterior reservoir 30 once the fluid is pumped through the porous core medium 14. Optionally, the fluid inlet 46 and/or fluid outlet 48 may be located in the side wall 22. The upper plate 18 includes multiple gas outlets 50 arranged as vents above the interior reservoir 36 and the exterior reservoir 30. The fluid inlet 46 delivers the fluid to the pump cavity 28 through the bottom of the housing 12, while the fluid outlets 48 remove the fluid from the pump cavity 28 also through the bottom of the housing 12. The gas outlets 50 are located at an opposite end, relative to the fluid inlet 46 and fluid outlet 48, to allow gas to be discharged from the top of the housing 12, thereby locating the fluid and gas inlets and outlets at a relatively substantial distance from one another as compared to the overall longitudinal length 24 and diameter 26 of the housing 12. The gases migrate toward the gas outlets 50 along a direction transverse to the direction of fluid flow through the porous core medium 14.

The electrodes 16 and 17 are positioned in the inner chamber 36 and in the exterior reservoir 30. For example, the electrode 16 may be positioned proximate to, but spaced slightly apart from, the interior surface 32 of the porous core medium 14. The electrode 17 may be positioned proximate to, but spaced slightly apart from, the exterior surface 34 of the porous core medium 14. The electrodes 16 and 17 are supplied with opposite electrical charges by a power source 7 depending upon a desired direction of fluid flow. For example, the electrode 16 may constitute an anode, while the electrode 17 constitutes the cathode to achieve radially outward flow. Alternatively, the electrode 17 may constitute the anode, while the electrode 16 constitutes the cathode to achieve radially inward flow. When opposite charges are applied to the electrodes 16 and 17, a voltage potential and current flow may optionally create radial fluid flow through the porous core medium 14 in a direction transverse to the longitudinal axis 42. The electrodes 16 and 17 and the porous core medium 14 cooperate to induce flow of the fluid through the porous core medium 14 between the interior and exterior reservoirs 36 and 30. The direction of flow is dependent upon the charges applied to the electrodes 16 and 17. For example, when the electrode 16 represents the anode and the electrode 17 represents the cathode, the fluid flows from the interior reservoir 36 radially outward to the exterior reservoir 30 when the surface charge of the porous core medium is negative.

In the example of FIG. 1, the longitudinal axis 42 is oriented parallel to the direction of gravity with the fluid flow moving in a direction transverse (e.g., radially inward or radially outward) to the direction of gravity. Optionally, the housing 12 may be tilted or pitched such that the longitudinal axis 42 is oriented at an acute or obtuse angle relative to the direction of gravity. As noted above, a gas is generated when the electrodes 16 and 17 induce flow of the fluid. The gas may be created at either or both of the electrodes 16 and 17, as well as along or within the porous core medium 14. The housing 12 is coupled to a gas removal device 52 through the gas outlets 50 to discharge and/or draw the gas from the pump cavity 28. The gas, that is generated when the electrodes 16 and 17 induce flow of the fluid, may comprise hydrogen and oxygen. The gas removal device 52 may comprise a catalyst to recombine the hydrogen and oxygen gas to form water, which may be reintroduced to the pump cavity 28.

The housing 12 also includes a liquid impermeable, gas permeable membrane 56 that is liquid impermeable to block the flow of fluid there through and prevent the liquid from leaving the interior reservoir 36 or exterior reservoir 30 through the gas outlets 50. The membrane 56 is gas permeable to permit the gas to flow there through to the gas outlets 50. The membrane 56 is held between the open end 38 of the porous core medium 14 and the upper plate 18. As noted above, the porous core medium 14 wraps about the longitudinal axis 42 such that the interior reservoir 36 has at least one open end 38. The open end 38 of the porous core medium 14 is positioned, relative to gravitational forces, vertically above the interior reservoir 36 such that, when gas is generated in the interior reservoir 36, the gas migrates upwards and escapes from the interior reservoir 36 through the open end 38 and travels to the gas removal device 52. The gas migrates in a predetermined direction (as denoted by arrow A) relative to gravity until collecting at the membrane 56 before being removed by the gas removal device 52. The gas outlet 50 may comprise a series of vents as shown in FIG. 2A to permit gas to vent from the pump cavity 28. Optionally, the membrane 56 may be used as the uppermost layer where the upper plate 18 is removed entirely. Hence, the membrane 56 would represent the outermost upper structure constituting part of the EO pump 10.

The EO pump 10 may comprise motion sources 58 and 60 that are provided in the interior and exterior reservoirs 36 and 30, respectively. The motion sources 58 and 60 interact with the electrodes 16 and 17 to induce motion into at least one of the electrodes 16 and 17 to actively cause gas bubbles to detach from the electrodes 16 and 17. For example, the motion sources 58 and 60 may represent an ultrasound source, a piezo actuator and/or electromagnet source. The motion sources 58 and 60 may be directly coupled to, and electrically insulated from, the corresponding electrode 16 and 17. Alternatively, the motion sources 58 and 60 may be located proximate, but not directly engage, the corresponding electrodes 16 and 17 and indirectly induce motion. For example, a magnetic material that is attached to an electrode or that forms part of the electrode can be induced to move due to proximity to a generator of electromagnetic forces such as a wire coil with an electric current running through. The motion sources 58 and 60 may be continuously or periodically activated to introduce continuous or periodic energy configured to induce detachment of gas bubbles from surfaces of the EO pump 110. Optionally, the motion sources 58 and 60 may introduce the motion into at least one of the housing 12, electrodes 16, 17, and/or gas bubbles. For example, an ultrasound source may be configured to introduce motion only into the gas bubbles without causing the housing or electrodes to physically move.

The motion sources 58 and 60 may be continuously or periodically activated to introduce continuous or periodic energy configured to induce detachment of gas bubbles from surfaces of the EO pump 10. The motion sources 58 and 60 may be controlled in an intermittent manner relative to the pumping operations of the EO pump 10. For example, the EO pump 10 may be utilized in an application having intermittent pump activity where the electrodes 16 and 17 are charged for a period of time and then turned off or deactivated for a period of time. The motion sources 58 and 60 may be controlled to induce motion during the periods of time in which the electrodes 16 and 17 are deactivated and the EO pump 10 is at rest. As one example, when the EO pump is turned on for a series of pump intervals that are separated by inactive intervals, the motion sources 58 and 60 may induce vibrations into the electrodes 16 and 17 during the inactive intervals being pump intervals.

Optionally, the surfaces on at least one of the pump cavity 28, porous core medium 14 and/or electrodes 16 and 17 may be coated with a hydrophilic material to reduce attachment of gas bubbles and induce migration of gas bubbles toward the gas removal device 52. For example, the electrodes 16 and 17 may be coated with a proton exchange membrane such as the Nafion® material that is made by EI DuPont De Nemours and Company of Wilmington, Del. Alternatively, the electrodes 16 and 17 may be coated with other copolymers that function as an ion exchange resin and permit water to readily transport there through while blocking gas.

Figure 2B:
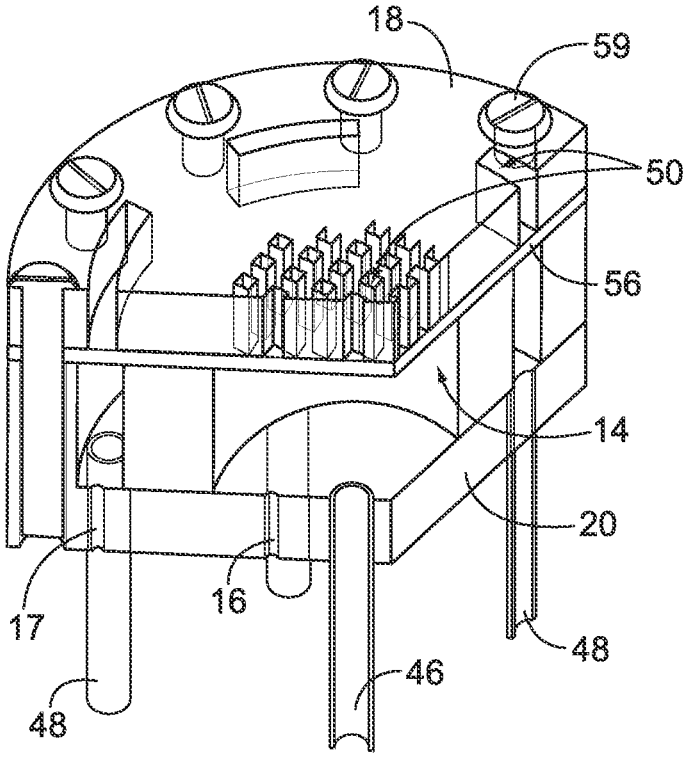
FIG. 2B illustrates a side perspective view of a cut-out portion of the EO pump of FIG. 1.

FIG. 2B illustrates a side perspective view of a cut-out section of a portion of the EO pump 10 of FIG. 1. FIG. 2B illustrates the relation between the various components. FIG. 2B further illustrates a series of fasteners 59 distributed about the perimeter of the side wall 22. The fasteners 59 hold the upper and lower plates 18 and 20 together with the porous core medium 14 and the liquid impermeable, gas permeable membrane 56 sandwiched there between. The gas outlets 50 are illustrated as a pattern of vents. Alternatively or additionally, upper and lower plates 18 and 20 can be adhered or bonded to side wall 22.

The EO pumps set forth herein can be manufactured using a variety of methods. In particular embodiments, the various plates and walls of an EO pump chamber can be molded as a single material. For example, all or some portion of the pump housing can be injection molded and in some embodiments the porous material can be provided as in insert in the mold. EO pumps can also be manufactured from acrylic components which can be joined by fusion bonding which uses heat and pressure to create a molecular bond between the materials without the addition of adhesive. Ultra-sonic welding is another method for joining plastic parts such as those useful in EO pumps. In some embodiments silicone gasket material can be used at interfaces between parts. Silicone can be particularly useful because it bonds well to glass. For example, an adhesive can be used to bond a silicone gasket and the silicone gasket can in turn bond to a porous core medium. Such a manufacturing process provides the advantage of avoiding adhesives which can wick into the core porous material under some conditions.

Figure 3:
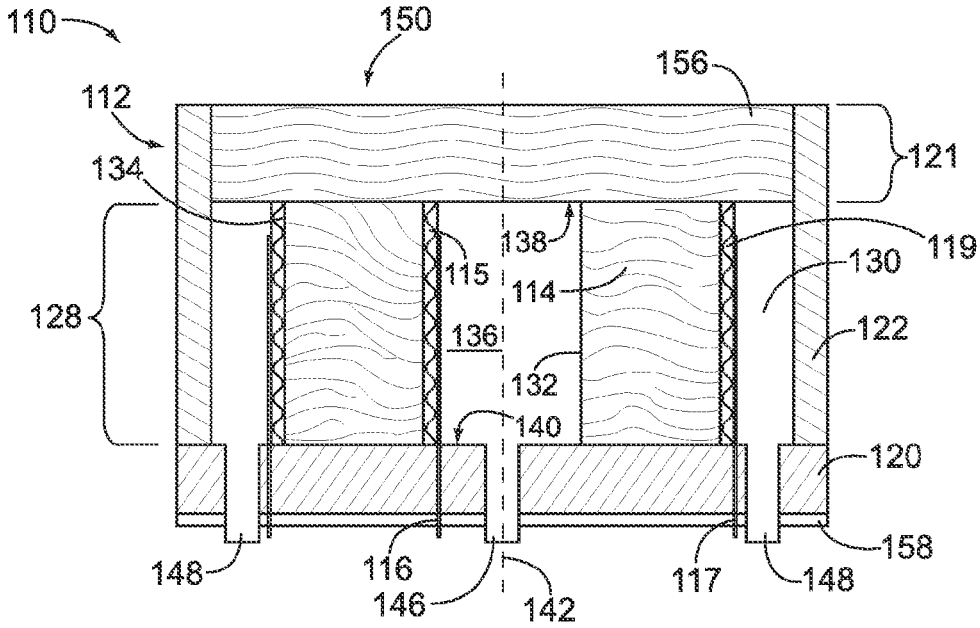
FIG. 3 illustrates a side sectional view of an EO pump formed in accordance with an alternative embodiment.

FIG. 3 illustrates an EO pump 110 formed in accordance with an alternative embodiment. The EO pump 110 includes a housing 112, a porous core medium 114, and electrodes 116 and 117. The housing 112 is constructed with a lower plate 120 and a side wall 122 that rests on the lower plate 120. The lower plate 120 and the side wall 122 define an interior pump cavity 128. The porous core medium 114 is positioned within the pump cavity 128 and oriented in an upright configuration along longitudinal axis 142 relative to gravity. The porous core medium 114 has an interior surface 132 and an exterior surface 134 formed concentric with one another. The interior surface 132 of the porous core medium 114 surrounds an open interior reservoir 136 that is open at opposite ends 138 and 140 which are spaced apart from one another along the longitudinal axis 142. The electrodes 116 and 117 are located in the interior and exterior reservoirs 136 and 130.

The housing 112 has at least one fluid inlet 146 and at least one fluid outlet 148. The housing 112 includes an open top which forms a gas outlet 150 that extends across an entire upper area spanning the interior reservoir 136, the porous core medium 114 and the exterior reservoir 130. The open top gas outlet 150 receives a gas permeable, liquid impermeable membrane 156. A particularly useful gas permeable, liquid impermeable medium is modified PTFE. Gas permeable, liquid impermeable membrane can be made from any of a variety of micro structure materials having hydrophobic coatings. Such coated materials include, for example, those coated with PTFE using methods such as hot filament chemical vapor deposition (HFCVD) as described, for example, in U.S. Pat. No. 5,888,591 and U.S. Pat. No. 6,156,435, each of which is incorporated herein by reference. By way of example only, the membrane 156 may be formed from different ePTFE membranes such as used in protective vent products offered by W.L. Gore & Associates. Optionally, the membrane 156 may be a soft semi-permeable membrane that is adhered (e.g. glued) to the top of the housing 112. The membrane 156 is not covered by an upper plate (as in FIG. 1). As shown in FIG. 3, the side wall 122 may include an extension portion 121 to extend a distance beyond the end 138 of the porous core medium 114 to form a pocket above the porous core medium 114 and within the side wall 122. The membrane 156 may then fit within the pocket and be exposed to ambient air. Alternatively, the side walls 122 may terminate at a height equal to the height of the porous core medium 114, and the membrane 156 may span across and cover the upper edge of the side wall 122.

Optionally, the EO pump 110 may comprise one or more motion sources 158 that are provided on the housing 112. For example, the motion source 158 may be mounted against the lower plate 120 to induce motion throughout the entire housing 112 when the motion source 158 vibrates to actively cause gas bubbles to detach from the porous core medium 114, side wall 122 and/or electrodes 116 and 117. The motion source 158 may represent an ultrasound source, a piezo actuator and/or electromagnet source. The motion source 158 may be directly coupled to, and electrically insulated from, the housing 112. Alternatively, the motion source 158 may be located proximate to the side wall 122. For example, a magnetic material that is attached to the pump or that forms part of a pump component can be induced to move due to proximity to a generator of electromagnetic forces such as a wire coil with an electric current running through. The motion sources 158 may be continuously or periodically activated to introduce continuous or periodic energy configured to induce detachment of gas bubbles from surfaces of the EO pump 110.

The EO pump 110 comprises a filter membrane layer 115 positioned between the interior surface 132 and electrode 116, and a filter or membrane layer 119 positioned between the exterior surface 134 and electrode 117. The membrane layers 115 and 119 are formed of an electrically conductive porous material that facilitates conduction of the electrical charge between the electrodes 116 and 117 and the porous core medium 114. The membrane layers 115 and 119 are formed of a hydrophilic material to encourage migration of the gas bubbles toward the gas outlet 150. Optionally, the membrane layers 115 and 119 could be formed of electrically insulating materials.

Figure 4:
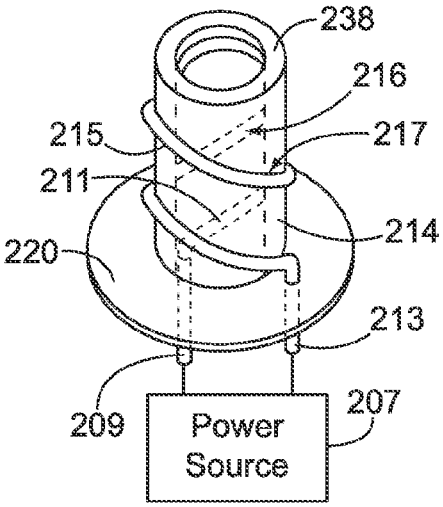
FIG. 4 illustrates a configuration of electrodes for use in an EO pump formed in accordance with an embodiment.

FIG. 4 illustrates a configuration of electrodes 216 and 217 formed in accordance with an embodiment. The electrode 217 is shown in solid lines, while electrode 216 is shown in dashed lines. The electrode 217 is located in the exterior reservoir proximate to an exterior surface of the porous core medium 214, while the electrode 216 is located in the interior reservoir proximate to an interior surface of the porous core medium. The porous core medium 214 is mounted on a lower plate 220 similar to the arrangement discussed above in connection with FIG. 1. The electrode 217 includes a continuous body portion 215 with a helical or spring shape that extends along a spiral path about the exterior surface of the porous core medium 214. The body portion 215 is joined to a tail 213 formed at the base of the body portion 215. The tail 213 extends through the lower plate 220.

The electrode 216 also includes a continuous body portion 211 with a helical or spring shape that extends along a spiral path proximate to the interior surface of the porous core medium 214. The body portion 211 is joined to a tail 209 formed at the base of the body portion 211. The tail 209 extends downward from the interior reservoir through the lower plate 220. The tails 213 and 209 are electrically coupled to a power source 207 that induces a voltage potential across the electrodes 216 and 217.

Optionally, the tails 213 and 209 may terminate on the upper surface of the lower plate 220 and be coupled to electrical contacts that are joined to the power source 207. The electrodes 216 and 217 may continue from the lower plate 220 upward to a point immediately adjacent the open end 238 of the porous core medium 214. Alternatively, one or both of the body portions 211 and 215 may not extend to the open end 238, but instead terminate below or short of the open end 238. The body portions 215 and 211 may spiral in the same or opposite directions. Alternatively, one of the body portions 211 and 215 may not be a spiral shape, while the other of the body portion 215 and 211 remains a spiral shape. Optionally, the electrodes 216 and 217 may be placed against or immediately adjacent, the top semi-permeable membrane (e.g. medium 56 in FIG. 1 or membrane 156 in FIG. 3) in order that gases may escape directly as the gases are formed.

Figure 5:
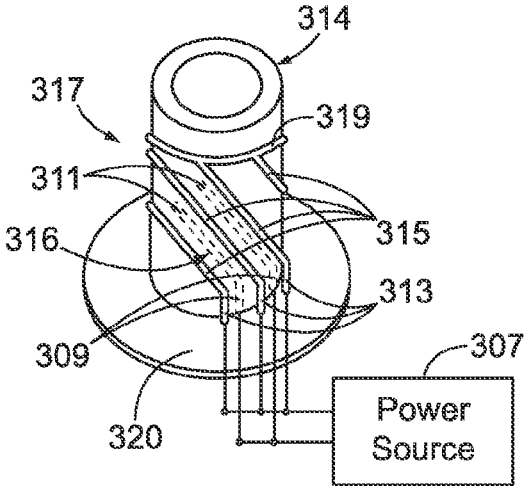
FIG. 5 illustrates a configuration of electrodes for use in an EO pump formed in accordance with an alternative embodiment.

FIG. 5 illustrates a configuration of electrodes 316 and 317 formed in accordance with an alternative embodiment. The porous core medium 314 is mounted on a lower plate 320 similar to the configuration discussed above in connection with FIG. 1. The electrode 317 is shown in solid lines, while electrode 316 is shown in dashed lines. The electrode 317 includes a series of body segments 315 that extend parallel to one another at a common acute angle or helical path about the exterior surface of the porous core medium 314. The series of body segments 315 are joined to a common tail 313 formed at the base of the body segments 315. The tail 313 extends through the lower plate 220 and is coupled to the power source 307. The series of body segments 315 include outer ends that are joined by a terminating ring 319. The ring 319 and tails 313 maintain the body segments 315 in a desired shape that is spaced slightly apart from the exterior surface of the porous core medium 314.

The electrode 316 also includes a series of body segments 311 that extend parallel to one another at a common acute angle or helical path about the interior surface of the porous core medium 314. The series of body segments 311 are joined to a common tail 309 formed at the base of the body segments 311. The tail 309 extends through the lower plate 320 and is joined to the power source 307. The series of body segments 311 may include upper ends that are free, or alternatively joined by a terminating ring (not shown).

The electrodes may be constructed in various manners. For example, one or more of the electrodes may include a pin shape, a mesh shape, a series of pins, a series of vertical straps and the like. For example, the electrodes may represent an array of pins or a grid of contacts spread about the interior surface 23 (FIG. 1) of the sidewall 22. Optionally, the tails for individual electrodes need not pass through the lower plate 20. Instead, the tails may extend inward laterally through the sidewall 22 and project inward through the exterior reservoir 30 to a location proximate, but not touching, the porous core medium 14.

Figure 6:
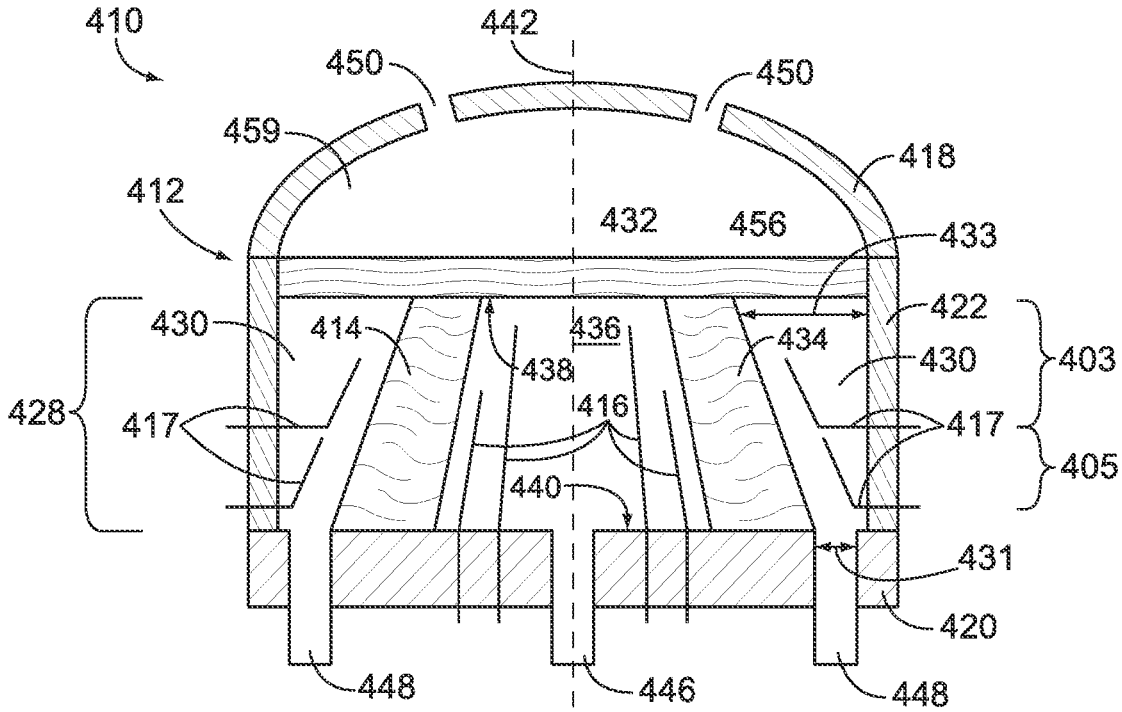
FIG. 6 illustrates an EO pump formed in accordance with an alternative embodiment.

FIG. 6 illustrates an EO pump 410 formed in accordance with an alternative embodiment. The EO pump 410 includes a housing 412, a porous core medium 414, and electrodes 416 and 417. The housing 412 is constructed with a lower plate 420 and a side wall 422 that rests on the lower plate 420. The lower plate 420 and the side wall 422 define an interior pump cavity 428. The porous core medium 414 is positioned within the pump cavity 428 and oriented in an upright configuration along longitudinal axis 442 relative to gravity. The porous core medium 414 has a cone shape with a flat top and a flat bottom (e.g., frustoconical). The porous core medium 414 has an interior surface 432 that extends upward from the lower plate 420 at a tapered acute angle until opening at the top end 438. The porous core medium 414 has an exterior surface 434 that extends upward from the lower plate 420 at a tapered obtuse angle until opening at the top end 438. The interior and exterior surfaces 432 and 434 may extend upward at common or different angles such that the porous core medium 414 may have a non-uniform or uniform radial thickness. For example, the porous core medium 414 may include a thicker base portion 405 proximate the bottom end 440 and a thinner head end portion 403 proximate the top end 438. Optionally, the porous core medium 414 may be constructed with a uniform radial thickness along the length thereof. Such alterations in the thickness and shape of the porous core medium can provide advantages of improved gas management, for example, by directing bubbles to a vent membrane more efficiently than other shapes or reducing bubble formation at locations that do not allow efficient venting.

The interior surface 432 of the porous core medium 414 surrounds an open interior reservoir 436 that is open at opposite top and bottom ends 438 and 440 which are spaced apart from one another along the longitudinal axis 442. The electrodes 416 and 417 are located in the interior and exterior reservoirs 436 and 430. The interior reservoir 436 includes an inverted conical shape having a narrow width at the top and having wider width at the bottom. The side wall 422 has a non-tapered contour that does not follow exterior surface 434 thereby forming an inverted conical shape within the exterior reservoir 430 having a narrow width 431 at the bottom and having a wide width 433 at the top. The housing 412 has at least one fluid inlet 446 and at least one fluid outlet 448. A gas permeable, liquid impermeable membrane 456 covers the top open end 438 of the porous core medium 414 spanning both the interior reservoir 436 and the exterior reservoir 430. The housing 412 also includes a cover 418 extending over the membrane 456 and joining the side wall 422. The cover 418 is spaced apart from the membrane 456 to form a gas collection area 459 therein. The cover 418 includes a gas outlet 450. Gas collects in the gas collection area 459 while/before being exhausted through the gas outlet 450.

The electrode 416 includes a group of pin electrodes that are straight and project upward through the lower plate 420. The pin electrodes 416 are distributed about the interior reservoir 436 following the interior surface 432. The pin electrodes 416 may have different lengths. The length of each pin electrode 416 may be based upon the location of the pin electrode 416 relative to the interior surface 432. The electrode 417 may also include a group of pin electrodes that project inward through the side wall 422 and are bent upward along the exterior surface 434. The pin electrodes 417 are distributed about the exterior reservoir 430 following the exterior surface 434. The pin electrodes 417 may have different lengths. The length of each pin electrode 417 may be based upon the location of the pin electrode 417 relative to the exterior surface 434. Optionally, the electrodes can be placed in direct contact with the pumping medium or the pump housing.

Figure 7:
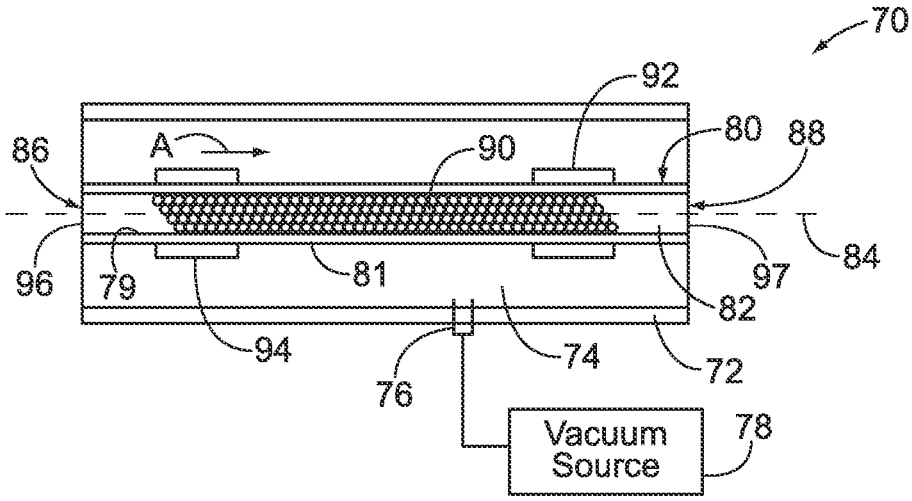
FIG. 7 illustrates a side sectional view of an electroosmotic (EO) pump formed in accordance with an embodiment of the present invention.

FIG. 7 illustrates a side sectional view of an EO pump 70 formed in accordance with an embodiment of the present invention. The pump 70 comprises a housing 72 that has a vacuum cavity 74 provided therein. The housing 72 includes a vacuum inlet 76 that is configured to be coupled to a vacuum source 78 to induce a vacuum within the vacuum cavity 74. A core retention member 80 is provided within the vacuum cavity 74. The core retention member 80 has an inner pump chamber 82 that extends along a longitudinal axis 84. The core retention member 80 has a fluid inlet 86 and a fluid outlet 88 located at opposite ends thereof. The core retention member is made of a material that is gas permeable and fluid impermeable, such as PTFE AF. Other useful core retention members are those made from any of a variety of micro structure materials having hydrophobic coatings. Such coated materials include, for example, those coated with PTFE using methods such as hot filament chemical vapor deposition (HFCVD) as described, for example, in U.S. Pat. No. 5,888,591 and U.S. Pat. No. 6,156,435, each of which is incorporated herein by reference. Optionally, the vacuum source 78 may be removed entirely and EO pump 70 operated without inducing a vacuum in the cavity 74.

A porous core medium 90 is provided within the core retention member 80. The porous core medium 90 is located between the fluidic inlet and fluidic outlet 86 and 88. The porous core medium is arranged to substantially fill the core retention member 80 in the cross sectional direction, to require all fluid to pass through the porous core medium to be conveyed from the fluid inlet 86 to the fluid outlet 88. By way of example, the porous core medium 90 may be comprised of a porous homogeneous or nonhomogeneous material, or alternatively a collection of beads, either of which retain a surface charge and permit fluid to flow there through. Other exemplary materials are described, for example, in US 2006/0029851 A1, which is incorporated herein by reference. Optionally, a pump medium may be made from PEEK or other biocompatible polymers that are used in bioanalytical methods.

The core retention member 80 has an elongated cylindrical shape that is open at opposite ends 96 and 97. The fluidic inlet and fluidic outlet 86 and 88 are located at the opposite ends 96 and 97 of the inner pump chamber 82. The core retention member 80 represents a tube having an outer wall formed from, for example, PTFE AF. The fluid flows along the tube within the outer wall while gas passes radially outward through the outer wall.

Electrodes 92 and 94 are located proximate to the core retention member 80 and separated from one another, such that, when electrically charged, flow of a fluid is induced through the porous core medium 90 from the fluid inlet 86 to the fluid outlet 88. The electrodes 92 and 94 are separated from one another along the longitudinal axis 84. In the exemplary embodiment of FIG. 7, the electrodes 92 and 94 are constructed as ring shaped electrodes that are mounted about an exterior surface 81 of the core retention member 80. The electrodes 92 and 94 introduce an electrical potential difference across the porous core medium 90 that causes the fluid to flow in the direction of arrow A along the longitudinal axis through the porous core medium 90. As discussed above, a gas is generated at the electrode as the fluid flows through the porous core medium 90. The core retention member 80, being formed of a gas permeable material, permits the gas to dissipate radially outward along the length of the core retention member 80 away from the porous core medium 90. The optional vacuum source 78 introduces a vacuum within the vacuuming cavity 74 to induce migration of the gas in a radial direction transverse to the longitudinal axis of 84 away from the porous core medium 90 and outward through the core retention member 80.

While not shown, the electrodes 92 and 94 are coupled to a power source similar to the power sources discussed above in connection with FIGS. 1-6. Optionally, the EO pump 70 may include one or more motion sources at the electrodes 92 and/or 94, and/or within or about the exterior of the housing 72. The motion sources operate in the manner discussed above in connection with FIGS. 1-6 to induce detachment of gas bubbles from surfaces within the EO pump 70.

Several different pumps are described herein and shown in the figures for purposes of demonstrating how various pump elements can be made or used. The invention is not intended to be limited to the specific embodiments described herein. It is understood that various combinations and permutations of the components discussed above and hereafter may be implemented. For example, the pumps shown in the Figures and descried herein differ in several respects, including but not limited to, the various locations of pump components such as electrodes, housings, porous core medium, and reservoirs; the various shapes of pump components such as electrodes, housings, porous core medium, and reservoirs; the optional use of motion sources; the optional presence of a top plate; the optional use of fasteners; and the optional use of hydrophilic coatings or membranes. These and other pump components can be used in various combinations or may be used with different EO pump designs, whether described herein or known in the art, as will be understood by those skilled in the art in view of the teachings herein.

The EO pumps discussed herein may be implemented in various applications including, but not limited to, biochemical analysis systems, flow cells or other microfluidic devices for the creation and/or analysis of analyte arrays, such as nucleic acid arrays. Embodiments described herein include systems, flow cells, and manifolds (or other microfluidic devices) that may be used for the creation and/or analysis of analyte arrays, such as nucleic acid arrays. In particular, embodiments of the arrays are formed by creating nucleic acid clusters through nucleic acid amplification on solid surfaces. Some embodiments may include several subsystems that interact with each other to create, read, and analyze the arrays. The subsystems may include a fluid flow subsystem, temperature control subsystem, light and reader subsystem, a moving stage which may hold the flow cells and manifolds, and a computing subsystem that may operate the other subsystems and perform analysis of the readings. In particular, some of the systems and devices may be integrated with or include electroosmotic (EO) pumps. Furthermore, the systems and devices include various combinations of optical, mechanical, fluidic, thermal, electrical, and computing aspects/features. Although portions of these are described herein, these aspects/features may be more fully described in international patent application no. PCT/US2007/007991 (published as WO 2007/123744), which claims priority to U.S. provisional application Nos. 60/788,248 and 60/795,368, and in international patent application no. PCT/US2007/014649 (published as WO 2008/002502), which claims priority to U.S. provisional application No. 60/816,283, all of which are incorporated by reference in their entirety.

The terminology used herein is for the purpose of describing particular embodiments only, and is not intended to be limiting. For example, "a flow cell," as used herein, may have one or more fluidic channels in which a chemical analyte, such as a biochemical substance, is detected (e.g., wherein the chemical analytes are polynucleotides that are directly attached to the flow cell or wherein the chemical analytes are polynucleotides that are attached to one or more beads or other substrates arrayed upon the flow cell) and may be fabricated from glass, silicon, plastic, or combinations thereof or other suitable materials. In particular embodiments, a chemical analyte that is to be detected is displayed on the surface of a flow cell, for example via attachment of the analyte to the surface by covalent or non-covalent boding. Other analytes that can be detected using the apparatus or methods described herein include libraries of proteins, peptides, saccharides, biologically active molecules, synthetic molecules or the like. For purposes of explanation only the apparatus and methods are exemplified below in the context of nucleic acid sequencing. However, it should be understood that other applications include use of these other analytes, for example, to evaluate RNA expression, genotyping, proteomics, small molecule library synthesis, or the like.

Furthermore, a flow cell may include a combination of two or more flow cells, and the like. As used herein, the terms "polynucleotide" or "nucleic acids" refer to deoxyribonucleic acid (DNA), ribonucleic acid (RNA), or analogs of either DNA or RNA made from nucleotide analogs. The terms as used herein also encompasses cDNA, that is complementary, or copy, DNA produced from an RNA template, for example by the action of reverse transcriptase. In some embodiments, the nucleic acid to be analyzed, for example by sequencing, through use of the described systems is immobilized upon a substrate (e.g., a substrate within a flow cell or one or more beads upon a substrate such as a flow cell, etc.). The term "immobilized" as used herein is intended to encompass direct or indirect, covalent or non-covalent attachment, unless indicated otherwise, either explicitly or by context. The analytes (e.g. nucleic acids) may remain immobilized or attached to the support under conditions in which it is intended to use the support, such as in applications requiring nucleic acid sequencing.

The term "solid support" (or "substrate"), as used herein, refers to any inert substrate or matrix to which nucleic acids can be attached, such as for example glass surfaces, plastic surfaces, latex, dextran, polystyrene surfaces, polypropylene surfaces, polyacrylamide gels, gold surfaces, and silicon wafers. For example, the solid support may be a glass surface (e.g., a planar surface of a flow cell channel). In some embodiments, the solid support may comprise an inert substrate or matrix which has been "functionalized," such as by applying a layer or coating of an intermediate material comprising reactive groups which permit covalent attachment to molecules such as polynucleotides. By way of non-limiting example, such supports can include polyacrylamide hydrogels supported on an inert substrate such as glass. The molecules (polynucleotides) can be directly covalently attached to the intermediate material (e.g. the hydrogel) but the intermediate material can itself be non-covalently attached to the substrate or matrix (e.g. the glass substrate). The support can include a plurality of particles or beads each having a different attached analyte.

In some embodiments, the systems described herein may be used for sequencing-by-synthesis (SBS). In SBS, four fluorescently labeled modified nucleotides are used to sequence dense clusters of amplified DNA (possibly millions of clusters) present on the surface of a substrate (e.g., a flow cell). The flow cells containing the nucleic acid samples for sequencing can take the form of arrays of discrete, separately detectable single molecules, arrays of features (or clusters) containing homogeneous populations of particular molecular species, such as amplified nucleic acids having a common sequence, or arrays where the features are beads comprising molecules of nucleic acid. The nucleic acids can be prepared such that the nucleic acids include an oligonucleotide primer adjacent to an unknown target sequence. To initiate the first SBS sequencing cycle, one or more differently labeled nucleotides, and DNA polymerase, etc., can be flowed into/through the flow cell by a fluid flow subsystem. Either a single nucleotide can be added at a time, or the nucleotides used in the sequencing procedure can be specially designed to possess a reversible termination property, thus allowing each cycle of the sequencing reaction to occur simultaneously in the presence of all four labeled nucleotides (A, C, T, G). Where the four nucleotides are mixed together, the polymerase is able to select the correct base to incorporate and each sequence is extended by a single base. In such methods of using the systems, the natural competition between all four alternatives leads to higher accuracy than wherein only one nucleotide is present in the reaction mixture (where most of the sequences are therefore not exposed to the correct nucleotide). Sequences where a particular base is repeated one after another (e.g., homopolymers) are addressed like any other sequence and with high accuracy.

Figure 8:
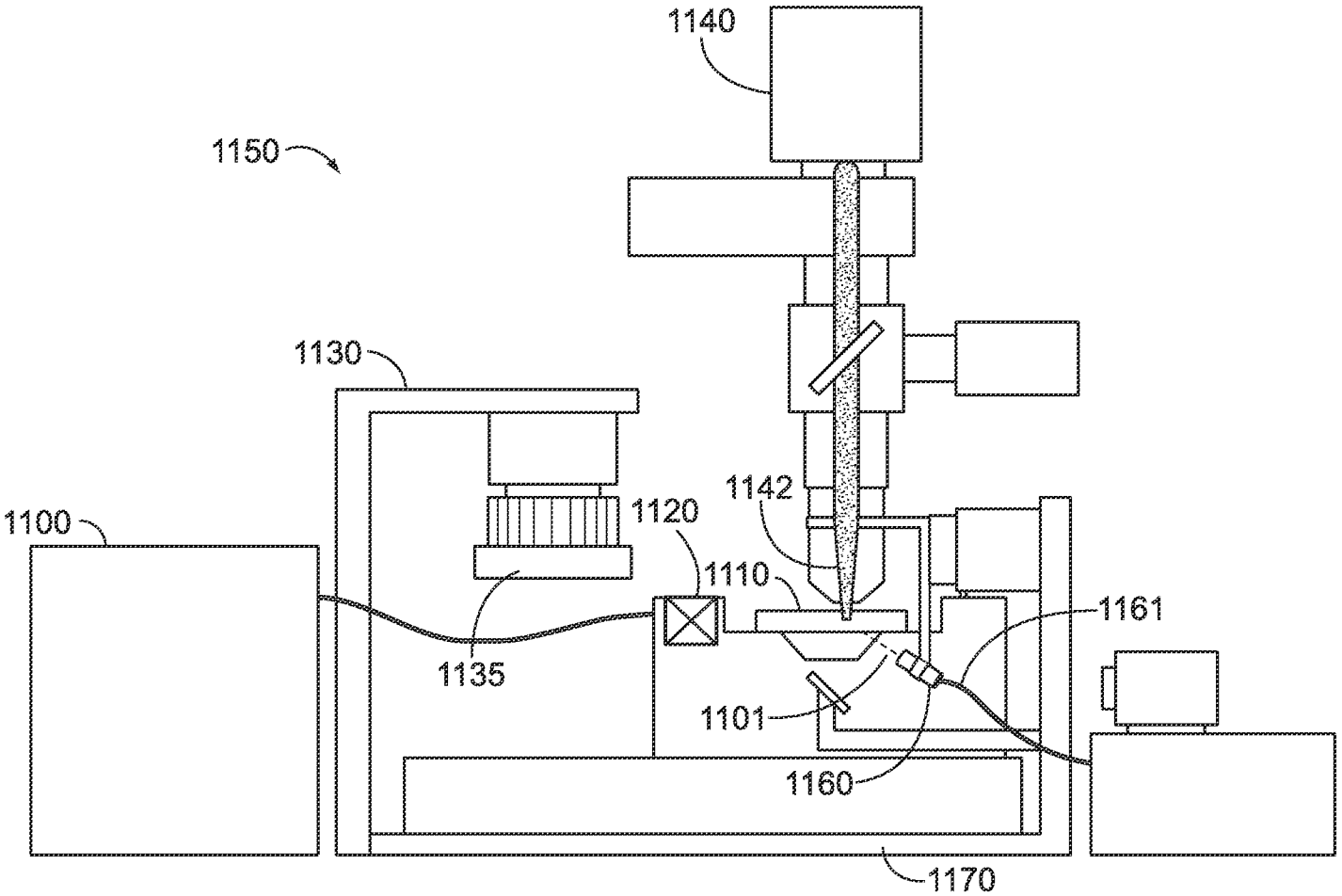
FIG. 8 illustrates a detector system that utilizes an electroosmotic (EO) pump formed in accordance with one embodiment.

FIG. 8 illustrates a detector system 1150 that utilizes an electroosmotic (EO) pump formed in accordance with one embodiment. The system 1150 may include a fluid flow subsystem 1100 for directing the flow of reagents (e.g., fluorescent nucleotides, buffers, enzymes, cleavage reagents, etc.) or other solutions to and through a flow cell 1110 and waste valve 1120. As will be discussed in greater detail below, the fluid flow system 1100 and the flow cell 1110 may include EO pumps. The flow cell 1110 may have clusters of nucleic acid sequences (e.g., of about 200-1000 bases in length) to be sequenced which are optionally attached to the substrate of the flow cell 1110, as well as optionally other components.

The flow cell 1110 may also include an array of beads, where each bead optionally contains multiple copies of a single sequence. The system 1150 may also include a temperature control subsystem 1135 to regulate the reaction conditions within the flow cell channels and reagent storage areas/containers (and optionally the camera, optics, and/or other components). In some embodiments, a heating/cooling element, which may be part of the temperature control subsystem 1135, is positioned underneath the flow cell 1110 in order to heat/cool the flow cell 1110 during operation of the system 1150. An optional movable stage 1170 upon which the flow cell 1110 is placed allows the flow cell to be brought into proper orientation for laser (or other light 1101) excitation of the substrate and optionally moved in relation to a lens 1142 and camera system 1140 to allow reading of different areas of the substrate. Additionally, other components of the system are also optionally movable/adjustable (e.g., the camera, the lens objective, the heater/cooler, etc.).

The flow cell 1110 is monitored, and sequencing is tracked, by camera system 1140 (e.g., a CCD camera) which can interact with various filters within a filter switching assembly (not shown), lens 1142, and focusing laser/focusing laser assembly (not shown). A laser device 1160 (e.g., an excitation laser within an assembly optionally comprising multiple lasers) may illuminate fluorescent sequencing reactions within the flow cell 1×110 via laser illumination through fiber optic 1161 (which can optionally include one or more re-imaging lenses, a fiber optic mounting, etc.). It will be appreciated that the illustrations herein are of exemplary embodiments and are not necessarily to be taken as limiting.

Figure 9:
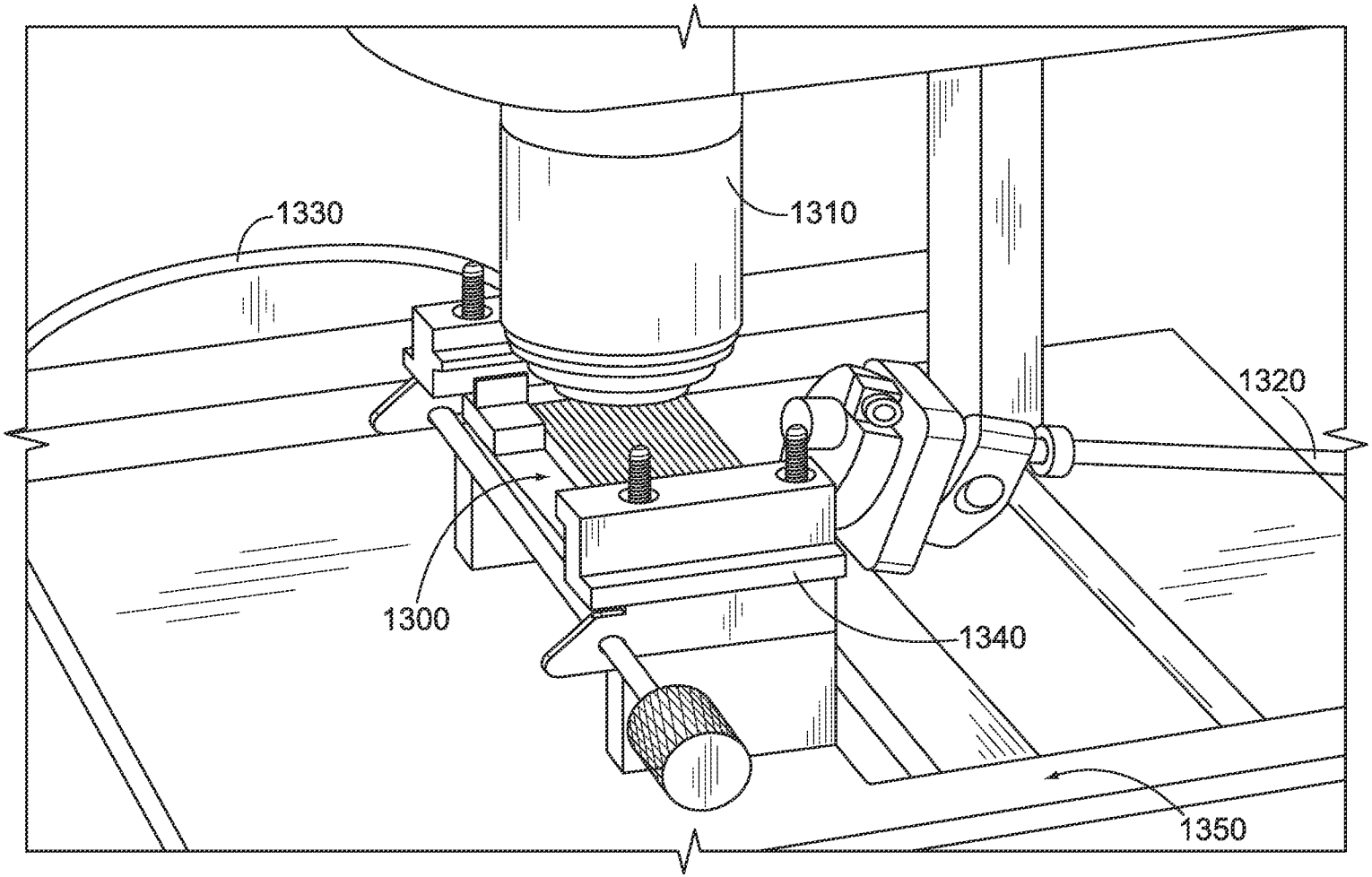
FIG. 9 illustrates a reader subsystem with a flow cell that may be used with the detector system in FIG. 8.

FIG. 9 illustrates a reader subsystem with a flow cell 1300 that may be used with an imaging or sequencing system, such as the detector system 1150 described above in FIG. 8. As shown, when nucleic acid samples have been deposited on the surface of the flow cell 1300, a laser coupled through optical fiber 1320 may be positioned to illuminate the flow cell 1300. An objective lens component 1310 may be positioned above the flow cell 1300 and capture and monitor the various fluorescent emissions once the fluorophores are illuminated by a laser or other light. Also shown, the reagents may be directed through the flow cell 1300 through one or more tubes 1330 which connect to the appropriate reagent storage, etc. The flow cell 1300 may be placed within a flow cell holder 1340, which may be placed upon movable staging area 1350. The flow cell holder 1340 may hold the flow cell 1300 securely in the proper position or orientation in relation to the laser, the prism (not shown), which directs laser illumination onto the imaging surface, and the camera system, while the sequencing occurs. Alternatively, the objective lens component 1310 is positioned below the flow cell 1300. The laser may be similarly positioned as shown in FIG. 9 or may be adjusted accordingly for the objective lens component 1310 to read the fluorescent emissions. In another alternative embodiment, the flow cell 1300 may be viewable from both sides (i.e., top and bottom). As such, the multiple readers or imaging systems may be used to read signals emanating from the channels of the flow cells 1300.

Figure 10A:
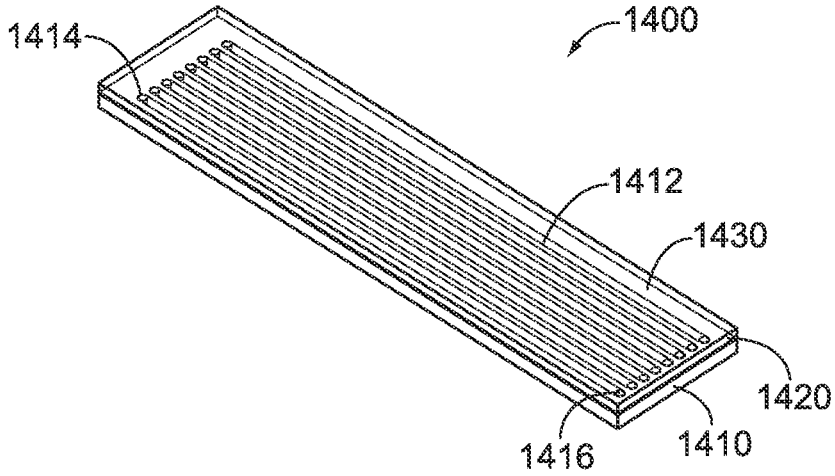
FIGS. 10A-10B illustrates a flow cell formed in accordance with one embodiment.
Figure 10B:
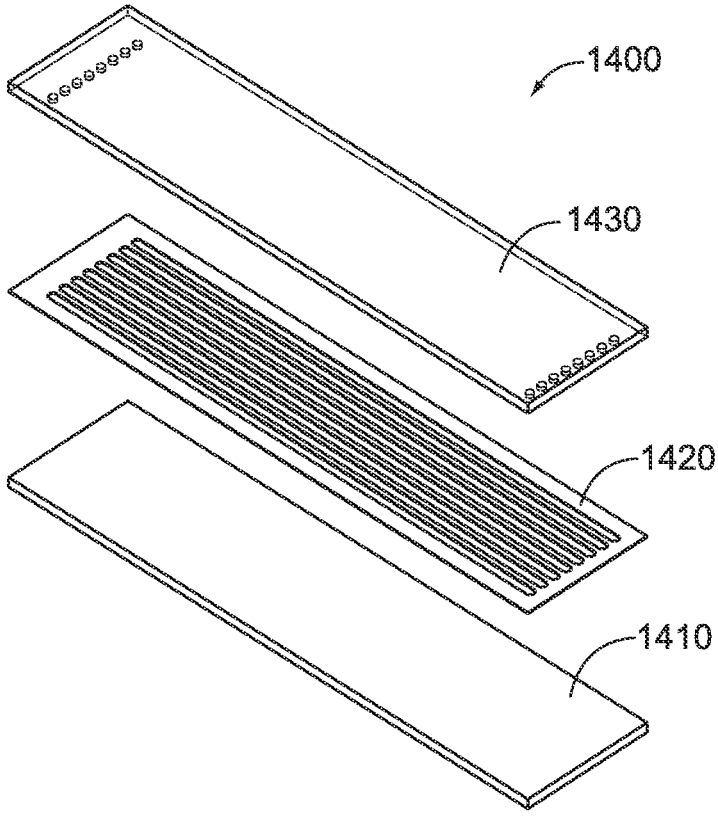

FIGS. 10A and 10B display a flow cell 1400 formed in accordance with one embodiment. The flow cell 1400 includes a bottom or base layer 1410 (e.g., of borosilicate glass 1000 μm in depth), a channel spacer or layer 1420 (e.g., of etched silicon 100 μm in depth) overlaying the base layer 1410, and a cover layer 1430 (e.g., 300 μm in depth). When assembled, the layers 1310, 1420, and 1430 form enclosed channels 3×412 having inlets and outlets ports 1414 and 1416, respectively, at either end through the cover layer 1430. As will be discussed in greater detail below, the flow cell 1400 may be configured to engage or sealably mate with a manifold, such as manifold 810 (in FIG. 15). Alternatively, the inlets 1414 and outlets 1416 of the flow cell 1400 may open at the bottom of or on the sides of the flow cell 1400. Furthermore, while the flow cell 1400 includes eight (8) channels 1412, alternative embodiments may include other numbers. For example, the flow cell 1400 may include only one (1) channel 1412 or possibly two (2), three (3), four (4), sixteen (16) or more channels 1412. In one embodiment, the channel layer 1420 may be constructed using standard photolithographic methods. One such method includes exposing a 100 μm layer of silicon and etching away the exposed channel using Deep Reactive Ion Etching or wet etching. Additionally, the channels 1412 may have different depths and/or widths (different both between channels in different flow cells and different between channels within the same flow cell). For example, while the channels 1412 formed in the cell in FIG. 10B are 100 μm deep, other embodiments can optionally comprise channels of greater depth (e.g., 500 μm) or lesser depth (e.g., 50 μm).

Figure 10C:
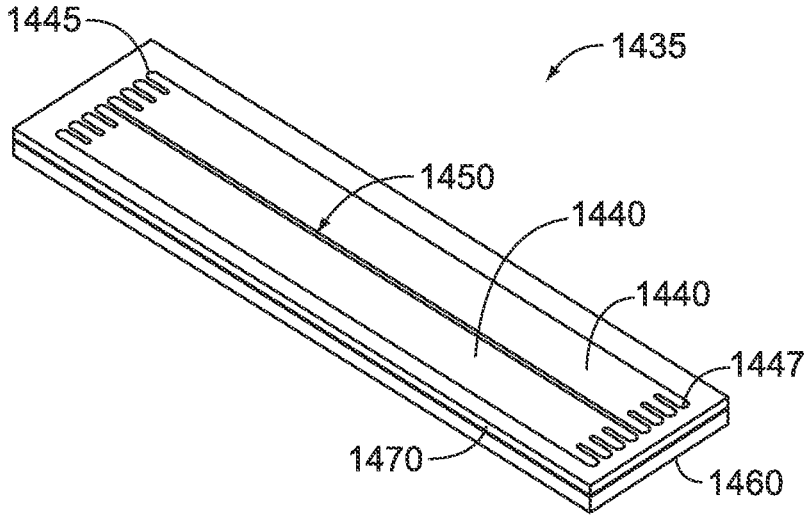
FIG. 10C illustrates a flow cell configuration formed in accordance with an alternative embodiment.
Figure 10D:
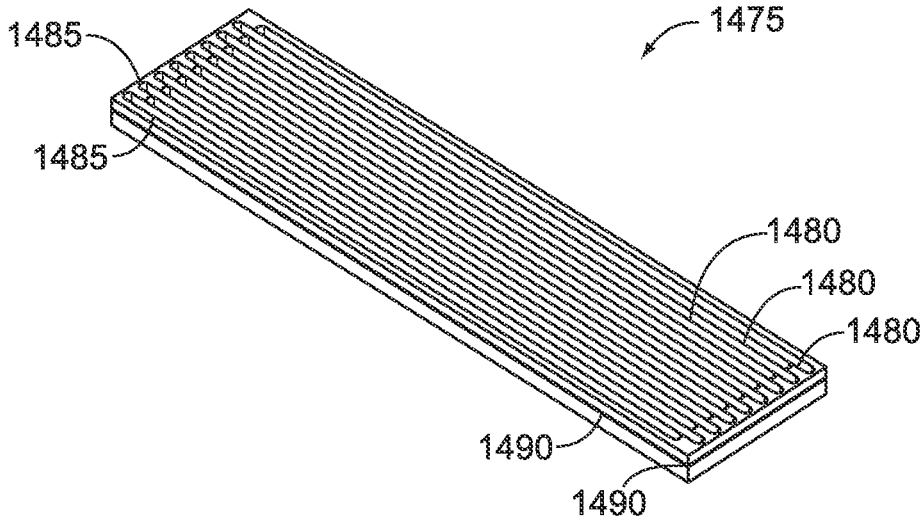
FIG. 10D illustrates a flow cell configuration formed in accordance with an alternative embodiment.

FIGS. 10C and 10D illustrate flow cell configurations formed in accordance with alternative embodiments. As shown in FIG. 10C, flow cells 1435 may have channels 1440, which are wider than the channels 1412 described with reference to the flow cell 1400, or two channels having a total of eight (8) inlet 1445 and outlet ports 1447. The flow cell 1435 may include a center wall 1450 for added structural support. In the example of FIG. 10D, the flow cell 1475 may include offset channels 1480 such that the inlet 1485 and outlet ports 1490, respectively, are arranged in staggered rows at opposite ends of the flow cell 1475.

The flow cells may be formed or constructed from a number of possible materials. For example, the flow cells may be manufactured from photosensitive glass(es) such as Foturan® (Mikroglas, Mainz, Germany) or Fotoform® (Hoya, Tokyo, Japan), which may be formed and manipulated as necessary. Other possible materials can include plastics such as cyclic olefin copolymers (e.g., Topas® (Ticona, Florence, Ky.) or Zeonor® (Zeon Chemicals, Louisville, Ky.)) which have excellent optical properties and can withstand elevated temperatures. Furthermore, the flow cells may be made from a number of different materials within the same flow cell. Thus, in some embodiments, the base layer, the walls of the channels, and the cover layer can optionally be of different materials. Also, while the example in FIG. 10B shows a flow cell 1400 formed of three (3) layers, other embodiments can include two (2) layers, e.g., a base layer having channels etched/ablated/formed within it and a cover layer, etc. Other embodiments can include flow cells having only one layer which comprises the flow channel etched/ablated/otherwise formed within it.

Figure 11:
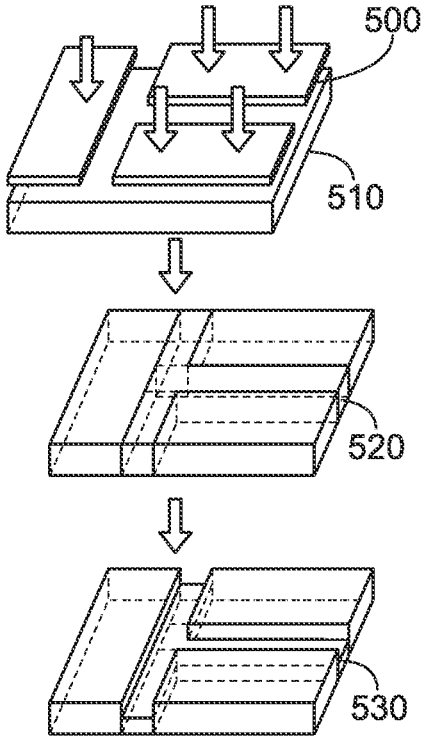
FIG. 11 illustrates a schematic diagram of a process for patterning a flow cell in accordance with one embodiment.

FIG. 11 gives a schematic diagram of a process for patterning a flow cell in accordance with one embodiment. First, the desired pattern is masked out with masks 500, onto the surface of substrate 510 which is then exposed to UV light. The glass is exposed to UV light at a wavelength between 290 and 330 nm. During the UV exposure step, silver or other doped atoms are coalesced in the illuminated areas (areas 520). Next, during a heat treatment between 5000° C. and 6000° C., the glass crystallizes around the silver atoms in area 520. Finally, the crystalline regions, when etched with a 10% hydrofluoric acid solution at room temperature (anisotropic etching), have an etching rate up to 20 times higher than that of the vitreous regions, thus resulting in channels 530. If wet chemical etching is supported by ultrasonic etching or by spray-etching, the resulting structures display a large aspect ratio.

Figure 12A:
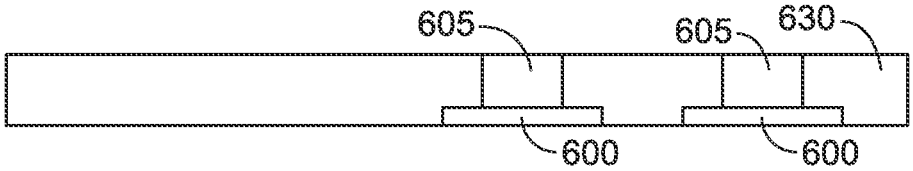
FIGS. 12A-12E illustrates an etching process that may be used to construct a flow cell in accordance with one embodiment.
Figure 12B:
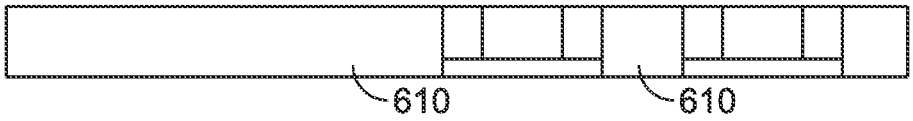
Figure 12C:
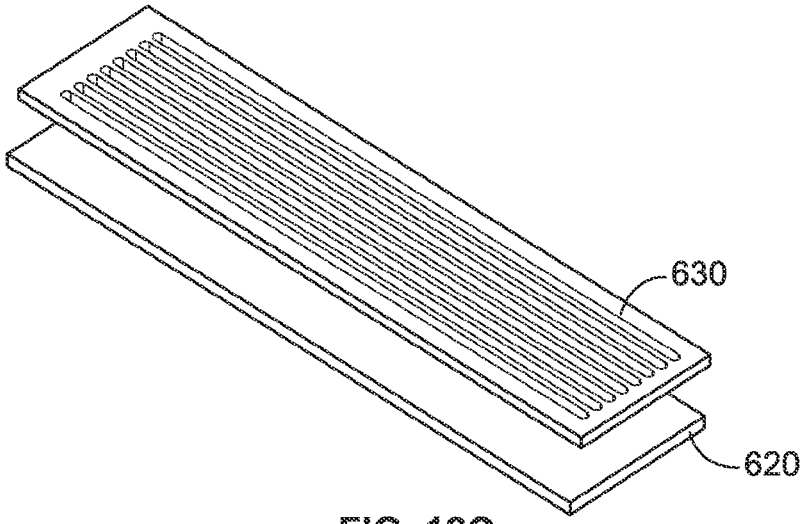
Figure 12D:
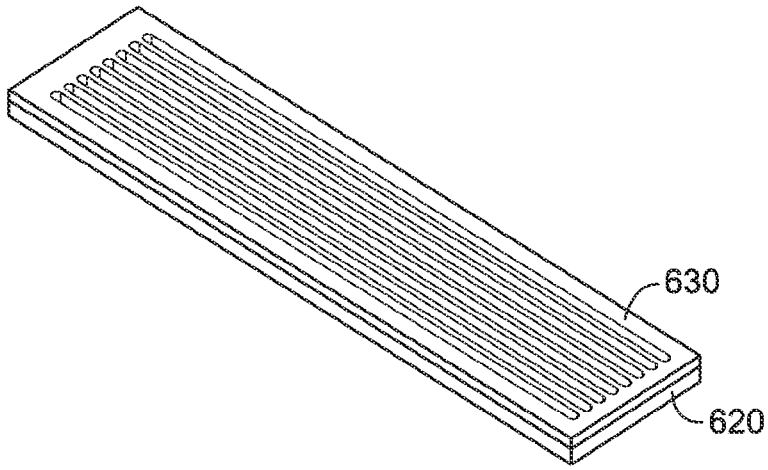
Figure 12E:
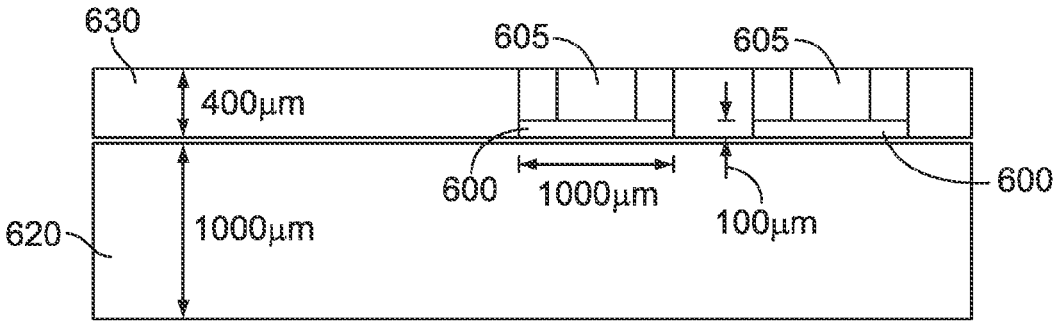

FIGS. 12A-E show an etching process that may be used to construct a flow cell in accordance with one embodiment. FIG. 12A illustrates an end view of a two-layer flow cell that includes channels 600 and through-holes 605. The channels 600 and through-holes 605 are exposed/etched into a cover layer 630. The cover layer 630 mates with a bottom layer 620 (shown in FIG. 12E). The through-holes 605 are configured to allow reagents/fluids to enter into the channels 600. The channels 600 can be etched into layer 630 through a 3-D process such as those available from Invenios (Santa Barbara, Calif.). The cover layer 630 may include Foturan and may be UV etched. Foturan, when exposed to UV, changes color and becomes optically opaque (or pseudo-opaque). In FIG. 12B, the cover layer 630 has been masked and light exposed to produce optically opaque areas 610 within the layer. The optically opaque areas may facilitate blocking misdirected light, light scatter, or other nondesirable reflections that could otherwise negatively affect the quality of sequence reading. In alternative embodiments, a thin (e.g., 100-500 nm) layer of metal such as chrome or nickel is optionally deposited between the layers of the flow cell (e.g., between the cover and bottom layers in FIG. 12E) to help block unwanted light scattering. FIGS. 12C and 12D display the mating of bottom layer 620 with cover layer 630 and FIG. 12E shows a cut away view of the same.

The layers of the flow cells may be attached to one another in a number of different ways. For example, the layers can be attached via adhesives, bonding (e.g., heat, chemical, etc.), and/or mechanical methods. Those skilled in the art will be familiar with numerous methods and techniques to attach various glass/plastic/silicon layers to one another. Furthermore, while particular flow cell designs and constructions are described herein, such descriptions should not necessarily be taken as limiting. Other flow cells can include different materials and designs than those presented herein and/or can be created through different etching/ablation techniques or other creation methods than those disclosed herein. Thus, particular flow cell compositions or construction methods should not necessarily be taken as limiting on all embodiments.

The reagents, buffers, and other materials that may be used in sequencing are regulated and dispensed via the fluid flow subsystem 100 (FIG. 1). In general, the fluid flow subsystem 100 transports the appropriate reagents (e.g., enzymes, buffers, dyes, nucleotides, etc.) at the appropriate rate and optionally at the appropriate temperature, from reagent storage areas (e.g., bottles, or other storage containers) through the flow cell 110 and optionally to a waste receiving area. The fluid flow subsystem 100 may be computer controlled and can optionally control the temperature of the various reagent components. For example, certain components are optionally held at cooled temperatures such as 4° C.+/−1° C. (e.g., for enzyme containing solutions), while other reagents are optionally held at elevated temperatures (e.g., buffers to be flowed through the flow cell when a particular enzymatic reaction is occurring at the elevated temperature).

In some embodiments, various solutions are optionally mixed prior to flow through the flow cell 1110 (e.g., a concentrated buffer mixed with a diluent, appropriate nucleotides, etc.). Such mixing and regulation is also optionally controlled by the fluid flow subsystem 1100. Furthermore, it may be advantageous to minimize the distance between the components of the system 1150. There may be a 1:1 relationship between pumps and flow channels, or the flow channels may bifurcate into two or more channels and/or be combined into one or more channel at various parts of the fluid subsystem. The fluidic reagents may be stored in reagent containers (e.g., buffers at room temperature, 5×SSC buffer, enzymology buffer, water, cleavage buffer, cooled containers for enzymes, enzyme mixes, water, scanning mix, etc.) that are all connected to the fluid flow subsystem 1100.

Multi-way valves may also be used to allow controllable access of/to multiple lines/containers. A priming pump may be used to draw reagents from the containers up through the tubing so that the reagents are "ready to go" into the flow cell 1110. Thus, dead air, reagents at the wrong temperature (e.g., because of sitting in tubing), etc. may be avoided. The fluid flow itself is optionally driven by any of a number of pump types, (e.g., positive/negative displacement, vacuum, peristaltic, and electroosmotic, etc.).

Which ever pump/pump type is used herein, the reagents are optionally transported from their storage areas to the flow cell 1110 through tubing. Such tubing, such as PTFE, can be chosen in order to, e.g., minimize interaction with the reagents. The diameter of the tubing can vary between embodiments (and/or optionally between different reagent storage areas), but can be chosen based on, e.g., the desire to decrease "dead volume" or the amount of fluid left in the lines Furthermore, the size of the tubing can optionally vary from one area of a flow path to another. For example, the tube size from a reagent storage area can be of a different diameter than the size of the tube from the pump to the flow cell, etc.

The fluid flow system 1100 can be further equipped with pressure sensors that automatically detect and report features of the fluidic performance of the system, such as leaks, blockages and flow volumes. Such pressure or flow sensors can be useful in instrument maintenance and troubleshooting. The fluidic system can be controlled by the one or more computer component, e.g., as described below. It will be appreciated that the fluid flow configurations in the various embodiments can vary, e.g., in terms of number of reagent containers, tubing length, diameter, and composition, types of selector valves and pumps, etc.

As described above, the various components of the system 1150 (FIG. 8) may be coupled to a processor or computing system that functions to instruct the operation of these instruments in accordance with preprogrammed or user input instructions, receive data and information from these instruments, and interpret, manipulate and report this information to the user. As such, the computing system is typically appropriately coupled to these instruments/components (e.g., including an analog to digital or digital to analog converter as needed). The computing system may include appropriate software for receiving user instructions, either in the form of user input into set parameter fields, e.g., in a GUI, or in the form of preprogrammed instructions, e.g., preprogrammed for a variety of different specific operations (e.g., auto focusing, SBS sequencing, etc.). The software may then convert these instructions to appropriate language for instructing the correct operation to carry out the desired operation (e.g., of fluid direction and transport, autofocusing, etc.). Additionally, the data, e.g., light emission profiles from the nucleic acid arrays, or other data, gathered from the system can be outputted in printed form. The data, whether in printed form or electronic form (e.g., as displayed on a monitor), can be in various or multiple formats, e.g., curves, histograms, numeric series, tables, graphs and the like.

Figure 13:
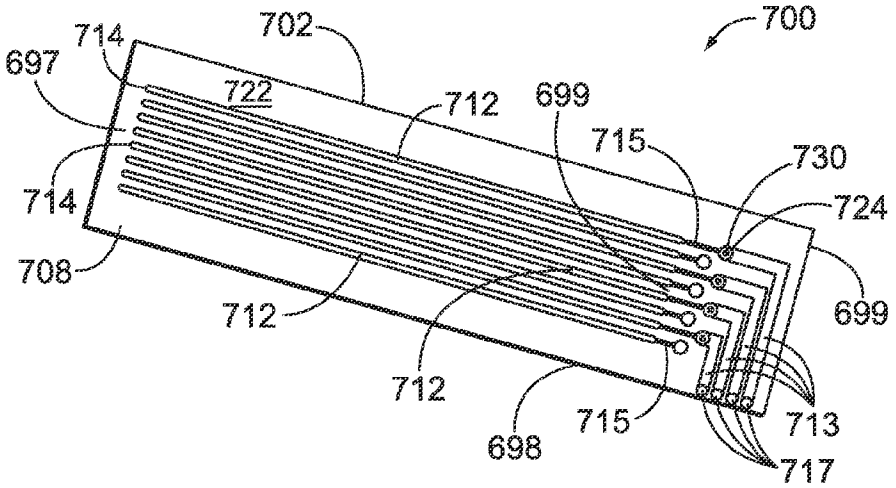
FIG. 13 illustrates a planar view of a flow cell that may be constructed to receive EO pumps in accordance with one embodiment.
Figure 14:
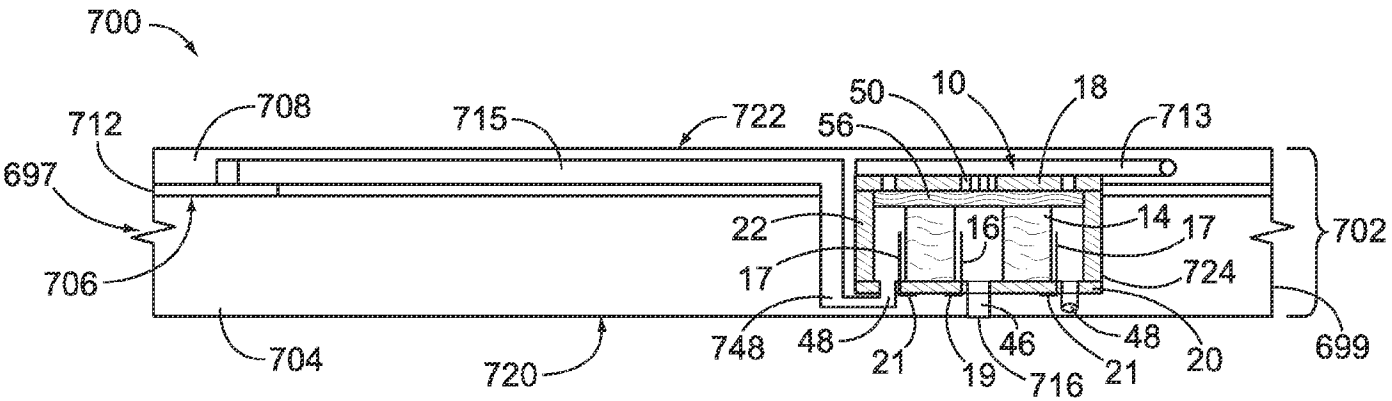
FIG. 14 illustrates a cross-sectional view of an end portion of the flow cell that may be constructed to receive EO pumps in accordance with one embodiment.

FIGS. 13 and 14 illustrate a flow cell 700 that may be constructed to receive EO pumps in accordance with one embodiment. FIG. 13 is a planar view of the flow cell 700, and FIG. 14 is a cross-sectional view of an end portion of the flow cell 700. The flow cell 700 includes a flow cell body 702 that may be formed from one or more substrate layers stacked upon each other. As shown in FIG. 14, the flow cell body 702 includes a bottom layer 704, a channel spacer or layer 706, and a cover layer 708. The channel spacer 706 may be optically opaque in order to block misdirected light, light scatter, or other nondesirable reflections that could otherwise negatively affect the quality of sequence reading. The flow cell body 702 has a substantially planar bottom surface 720 (FIG. 14) and a substantially planar top surface 722. The surfaces 720 and 722 may be transparent allowing light to pass therethrough, and either surface 720 or 722 (and corresponding layers 704 and 708, respectively) may be configured to be held by the system 1150 or, more specifically, the holder subassembly 800 (shown in FIG. 15). For example, the bottom layer 704 may have drilled holes or indentations for the holder 806 and/or prism 804 (both shown in FIG. 15) to engage. The layers 704, 706, and 708 are configured to form one or more channels 712 that extend between and are in flow communication with a fluidic inlet/outlet (I/O) port 714 at one end 697 (FIG. 13) of the flow cell body 702 and another fluidic inlet/outlet (I/O) port 716 (FIG. 14) at the other end 699. Furthermore, the flow cell body 702 may include one or more pump cavities 724, each of which is interposed between one end 699 of the channel 712 and one of the fluidic I/O ports 716. The pump cavity 724 is shaped to hold one or more electroosmotic (EO) pumps 730, which will be described in further detail below.

As shown in FIG. 13, the pump cavities 724 are joined to fluid channels 712 and to gas discharge channels 713. The gas discharge channels 713 extend to a common area, such as side 698 or to end 699 of the flow cell body 702. The gas discharge channels 713 terminate at gas ports 717 that are coupled to a gas removal device (e.g. 52 in FIG. 1) or a vacuum source (e.g. 78 in FIG. 7). The gas ports 717 may align with mating ports in the holder assembly 800. Optionally, the pump cavities 724 may be joined to a common gas discharge channel 713 with a common gas port 717, thereby simplifying the gas coupling path to/from the flow cell body 702.

The pump cavity 724 receives an EO pump 10 (FIG. 1) or any other EO pump described in or consistent with the inventions described in the present application. For convenience, the EO pump 10 within FIG. 14 will be described with the reference numerals discussed above in connection with FIG. 1. The EO pump 10 includes side walls 22, a porous core medium 14, upper and lower plates 18 and 20, a membrane 56 that is gas permeable but liquid impermeable, electrodes 16 and 17, fluid inlet 46 and fluid outlets 48 and gas outlets 50. The electrodes 16 and 17 terminate at contacts 19 and 21 on the lower plate 20 to facilitate an electrical connection of the EO pump 10 once inserted into the flow cell body 702. The contacts 19 and 21 join to mating contacts within the flow cell body 702.

Once the EO pump 10 is inserted into the pump cavity 724, the fluid inlet 46 aligns with the inlet port 716, while the fluid outlets 48 align with ports coupled with the fluid channel 715. A fluid passage 748 is joined to each of the fluid outlets 48 and extends from the bottom plate 20 of the EO pump 10 up to the fluid channel 715. The gas outlets 50 receive gas that passes through the membrane 56. The gas outlets 50 discharge the gas into a gas channel 713 that runs along the top of the cover plate 18. Optionally, the EO pump 10 may be constructed to omit the side walls 22 entirely and utilize the walls of the pump cavity 724 to define the exterior surface of the exterior reservoir.

The electrodes 16 and 17 may be electrically charged by a power source (not shown). The power source may be a battery, AC power supply, DC power supply, or any other source. The electrode 16 is positively charged and operates as an anode. The electrode 17 is negatively charged and operates as a cathode. Furthermore, surfaces of the pump cavity 724 may be coated in an insulating material to prevent current leakage. The insulating material may be, for example, silicon dioxide, silicon nitride, or multiple layers of these materials.

In an alternative embodiment, the charge may be created by inductive coupling rather than a direct electrical connection. For example, the contacts 16 and 17 may be replaced with inductive contacts. The inductive contacts may be embedded below the upper and/or lower surfaces of the top and bottom layers of the flow cell. The inductive contacts may be covered in insulation to avoid direct exposure to surrounding environment. In operation, the flow cell holder would include transformer sources proximate the areas on the flow cell where the inductive contacts are to be positioned. Once the flow cell is placed in the holder, the transformer sources would create local electromagnetic fields in the areas surrounding the inductive contacts. The EM fields would induce current flow at the inductive contacts, thereby creating a voltage potential between the inductive contacts.

The components of the EO pump 10 described above may be fastened or sealed together such that the components of the EO pump 10 form an integrated unit. For example, the components may be affixed within an acrylic housing. As such, the flow cell 700 may be configured to allow the EO pump 10 to be replaced by another EO pump unit when the EO pump 10 fails or another EO pump with different properties is desired.

Also, the bottom flow cells may be held to the flow cell holder through vacuum chucking rather than clamps. Thus, a vacuum can hold the flow cell into the correct position within the device so that proper illumination and imaging can take place.

In addition, the flow cell 700 illustrates a "push" flow cell in that the EO pump 10 is positioned upstream from the channel 712 (FIG. 14) and forces the fluid into the channels 712 via the connecting passage 715 where the reactions may occur. In alternative embodiments, the EO pump 10 is a "pull" flow cell in that the EO pump 10 is placed downstream from the channel 712 (i.e., after the reactions have occurred) such that the EO pump 10 draws the solution or fluid through the channel 712 before the fluid enters the pump. The EO pump 10 may either push or pull the fluids of interest directly, or alternatively, the EO pump 10 may utilize a working fluid (e.g. de-ionized water), which subsequently generates a pressure gradient upon the fluids of interest. A working fluid may be suitable when the fluid of interest is of a high ionic strength (e.g. Sodium Hydroxide) which would lead to higher currents, and therefore more gas generation.

Figure 15:
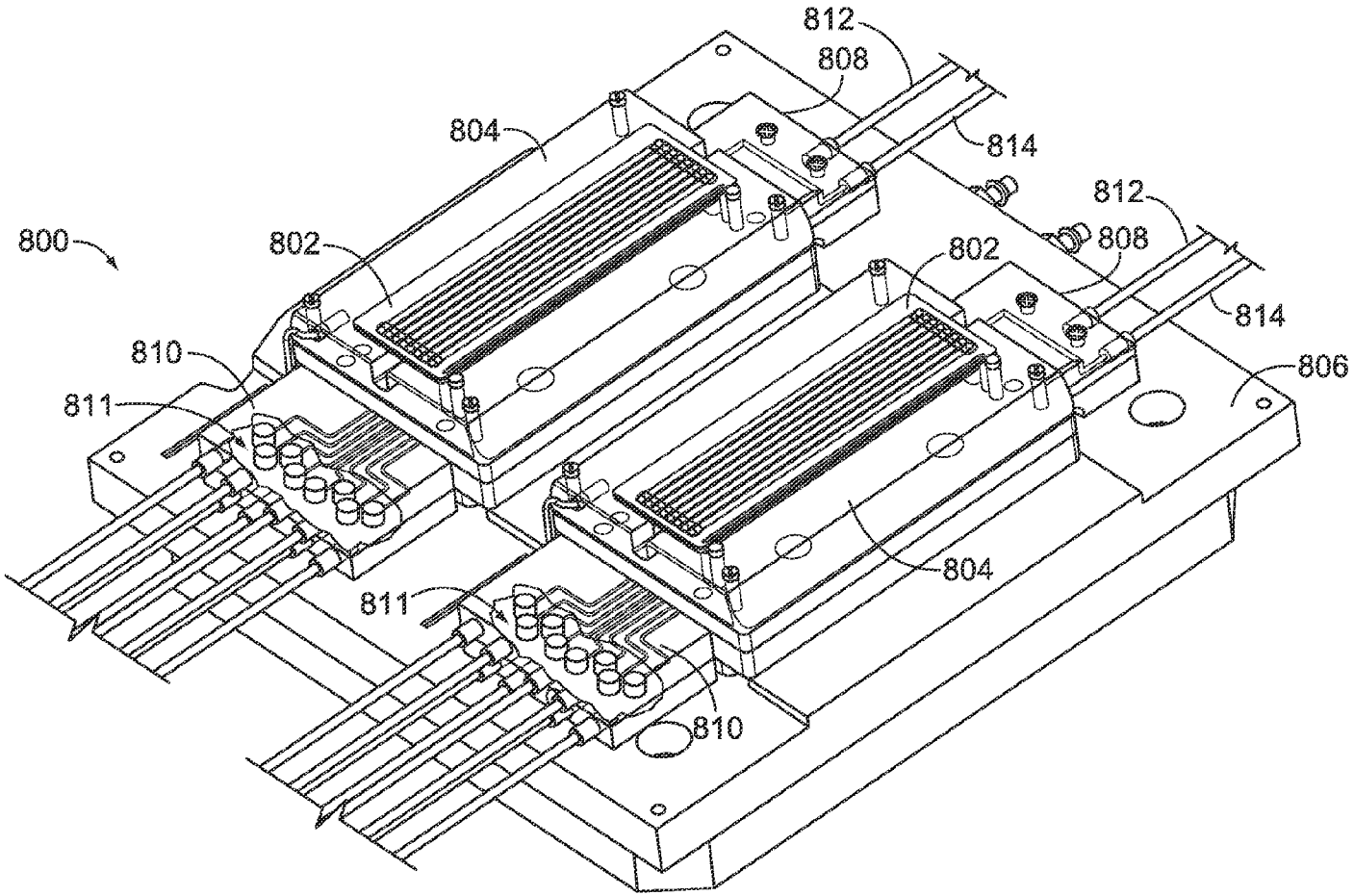
FIG. 15 illustrates a perspective view of a holder subassembly that may be formed in accordance with one embodiment.

FIG. 15 is a perspective view of a holder subassembly 800 that may be formed in accordance with one embodiment. The subassembly 800 is configured to hold flow cells 802 while the reader system (not shown) takes readings. The flow cells 802 may be similar to the flow cells 700 discussed above or may not include EO pumps. The subassembly 800 includes a holder 806 that is configured to support one or more inlet manifolds 808, prisms 804, flow cells 802, and outlet manifolds 810. As shown, each flow cell 802 is in flow communication with one inlet manifold 808 and one outlet manifold 810. A line 812 may provide the working fluid to the inlet manifold 808 in which an inner passageway (not shown) bifurcates and delivers the fluid to each of the channels on the flow cells 802. The holder 806 may have the prisms 804 fastened thereto by using, for example, screws. Each prism 804 is configured to hold one of the flow cells 802 and is configured to facilitate the reading process by refracting and/ or reflecting the light that is generated by, for example, a laser. The subassembly 800 may also include a suction device/vacuum chuck positioned under each flow cell 802 that creates a vacuum (or partial vacuum) for holding the corresponding flow cell 802 and/or corresponding prism 804 to the holder 806. In one embodiment, the vacuum chuck may include a heating device or thermally conductive rim/member that contacts the flow cell and regulates the temperature of the flow cell in addition to holding the flow cell or prism in position. A line 814 may, for example, be connected to a vacuum for providing the negative pressure to hold the flow cells 802 against the corresponding prisms 804.

Optionally, the manifolds 810 may be configured to receive EO pumps 811 therein. The EO pumps 811 may be provided in addition to, or in place of, the EO pumps in the flow cells 802. A group of EO pumps 811 are illustrated in FIG. 15 in cut-away portions of the manifolds 810. In the example of FIG. 15, eight channels are provided in each flow cell 802 and thus eight EO pumps 811 are provided within each manifold 810. Optionally, more or view EO pumps may be provided. Optionally, a common EO pump may be utilized to pull fluid through multiple channels.

Figure 16:
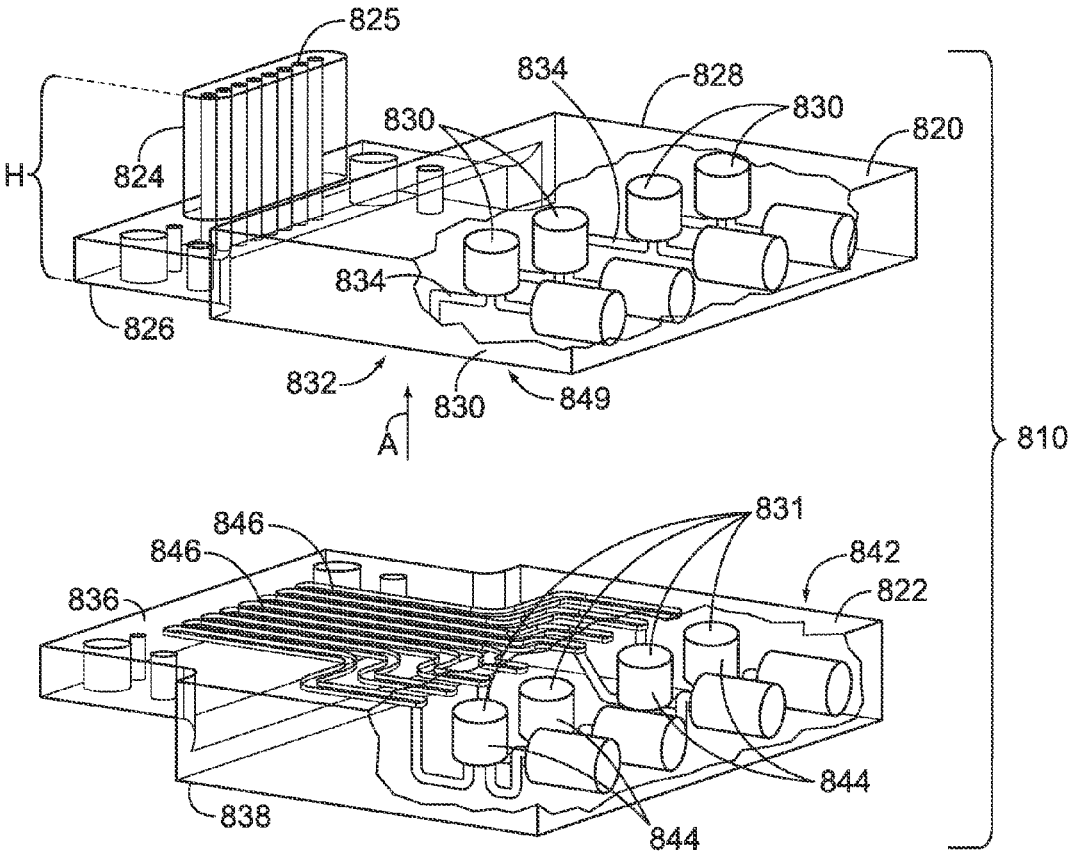
FIG. 16 illustrates an exploded perspective view of the components used to form the outlet manifold.

FIG. 16 is an exploded perspective view of the components used to form the outlet manifold 810 with a portion of the manifold shown in cut-away form. The manifold 810 includes a housing that may be formed from upper and lower layers 820 and 822. The layer 820 includes a channel connector 824 that extends from a base 826. The channel connector 824 includes one or more passages 825 that are configured to couple with the channels in the flow cell 802. The layer 820 also includes a lateral surface 832. The passages 825 extend a vertical distance H through the connector 824 and the base 826 to the lateral surface 832. The base 826 extends laterally outward from a body 828. The body 828 includes one or more EO pump cavities 830 that are in flow communication with passages 834. The pump cavities 830 have access openings in the surface 832 for allowing EO pumps to be inserted therein. The EO pumps may be inserted in the direction of arrow A up through the bottom of the layer 820.

Also shown in FIG. 16, the layer 822 includes a base 836 that extends laterally outward from a body 838. The base 836 and body 838 share a top lateral surface 842 that has one or more channel grooves 846 formed therein. The channel grooves 846 form a flared pattern. Mating channel grooves may be provided in the bottom surface 832 of layer 820. The layer 822 also includes a plurality of pump cavities 844, where each pump cavity 844 has an access opening 831 to allow one of the EO pumps to be inserted. To form the manifold 810, the layers 820 and 822 are secured together. For example, an epoxy may be applied to the lateral surfaces 832 and 842 which may then be thermally bonded together. Hence, a first subset of the EO pumps may be held in the upper layer 820 and a second subset of the EO pumps may be held in the lower layer 822. Optionally, all of the EO pumps may be located in one of layers 820 and 822, or the EO pumps may extend into both layers 820 and 822 and be sandwiched there between.

Figure 26:
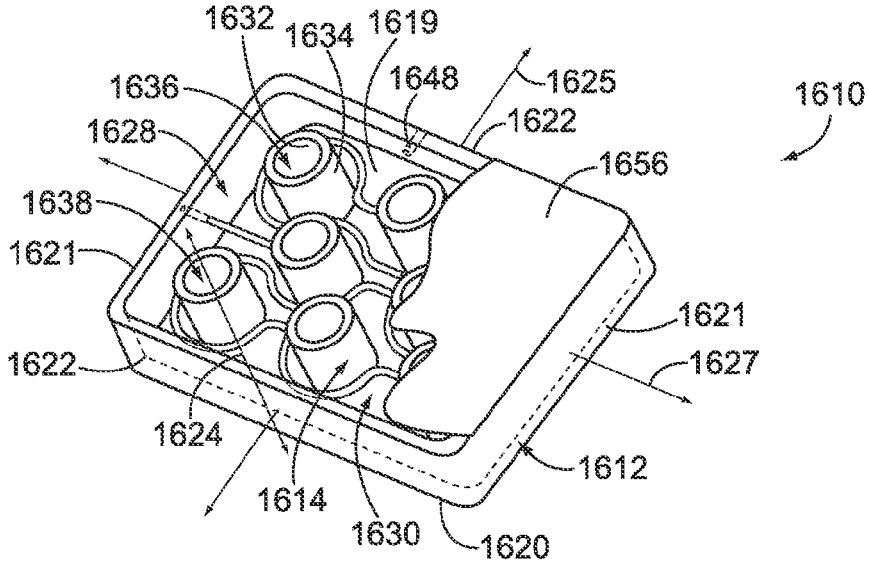
FIG. 26 illustrates a top perspective view of an EO pump formed in accordance with one embodiment.
Figure 27:
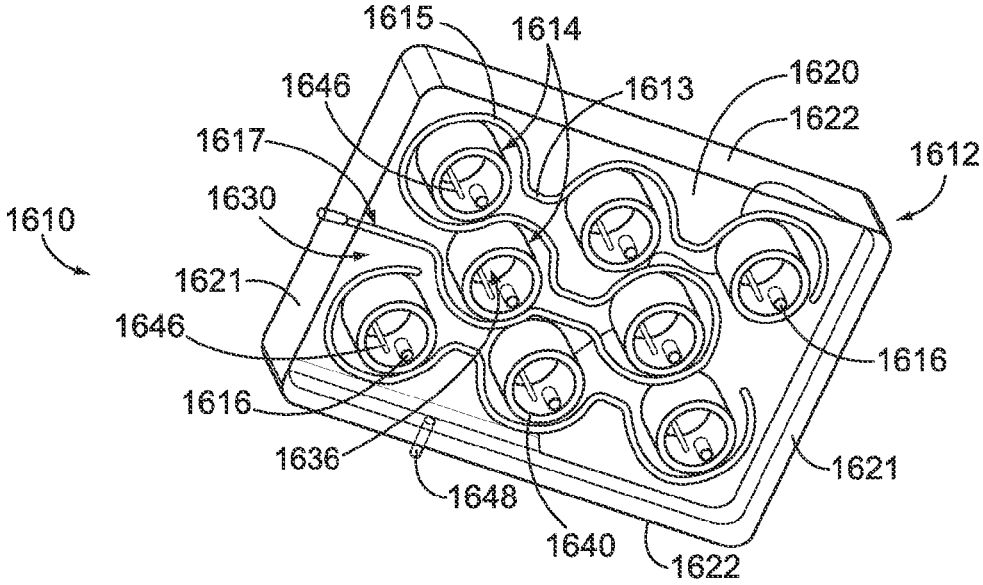
FIG. 27 illustrates a bottom perspective view of an EO pump formed in accordance with one embodiment.

FIGS. 26 and 27 illustrate top and bottom perspective views, respectively, of an electroosmotic (EO) pump 1610 formed in accordance with an embodiment of the present invention. As shown in FIG. 26, the pump 1610 comprises a housing 1612 including end walls 1621, side walls 1622 and a bottom 1620 that surround a pump cavity 1628. The housing 1612 is rectangular in shape with a length extending along longitudinal axis 1627 and a width extending along lateral axis 1625. The pump cavity 1628 receives a plurality of porous core mediums 1614 that are arranged in a pattern or array. The porous core mediums 1614 are spaced apart from one another to form a single common fluid reservoir 1630 therebetween and within the pump cavity 1628. The bottom 1620 of the pump cavity 1628 may be formed with a flat interior surface 1619 on which the porous core mediums 1614 are positioned. Optionally, the interior surface 1619 of the bottom 1620 may be formed with a recessed pattern, such as an array of circular indentations, to maintain the porous core medium 1614 in fixed, spaced apart positions.

The porous core mediums 1614 may be constructed as cylindrical fits that are placed in an upright orientation within the pump cavity 1628 along core axes 1624 (denoted by arrow 1624). The core axes 1624 are oriented upright relative to gravity and orthogonal to the lateral axis 1625 and longitudinal axis 1627 of the housing 1612. Each porous core medium 1614 has an interior surface 1632 and an exterior surface 1634 formed concentric with one another in an open cored, tubular shape. The interior surface 1632 of each porous core medium 1614 surrounds a corresponding central or interior reservoir 1636. The interior reservoir 1636 is open at opposite ends 1638 (FIG. 26) and 1640 (FIG. 27) that are spaced apart from one another along the core axis 1624. The porous core mediums 1614 are spaced inward from the side walls 1622 and end walls 1621 and are separated apart from one another to provide fluid flow gaps therebetween. The volume within the pump cavity 1628 surrounding the porous core mediums 1614 represents the common exterior reservoir 1630. The housing 1612 has an upper cover 1656 that is formed from a liquid impermeable, gas permeable membrane. The upper cover 1656 spans across the porous core mediums 1614 between the end and side walls 1621 and 1622 to entirely cover the pump cavity 1628. The upper cover 1656 permits gas bubbles that are generated within the pump cavity 1628 to be exhausted therefrom while retaining fluid in the pump cavity 1628. The upper cover 1656 also serves to separate the interior reservoir 1636 of each porous core medium 1614 from the common exterior reservoir 1630.

With reference to FIG. 27, a common electrode 1617 is positioned within the exterior reservoir 1630 of the pump cavity 1628. The electrode 1617 is shaped to extend along a curved path about the porous core mediums 1614 and throughout the pump cavity 1628. In the example of FIG. 27, the common electrode 1617 includes curved sections 1615 and straight sections 1613. The curved sections 1615 may wrap along an arc concentric about the exterior surfaces 1634. The curved sections 1615 may contact or closely follow the exterior surfaces 1634 of the porous core mediums 1614, while the straight sections 1613 span the gaps between the porous core mediums 1614. The common electrode 1617 extends from one end wall 1621 to the other end wall 1621 and back multiple times. Optionally, more than one common electrode 1617 may be provided within the pump cavity 1628. Individual core electrodes 16 are positioned in the interior reservoirs 1636 of each porous core medium 1614. The electrodes 1616 may be positioned against or proximate to, but spaced slightly apart from, the interior surfaces 1632 of the porous core mediums 1614. The electrodes are placed in such a way to maintain equal flow from each porous core medium. Alternatively, the electrode placement can be such that the flow rate can be tuned to desired values relative to each other. The electrodes 1616 and 1617 are supplied with opposite electrical charges by a power source. The polarity of the electrodes 1616 and 1617 is selected depending upon a desired direction of fluid flow. For example, the electrodes 1616 may constitute anodes, while the electrode 1617 constitutes a cathode to achieve radial outward flow from the interior reservoirs 1636 to the common exterior reservoir 1630. Alternatively, the electrode 1617 may constitute the anode, while the electrodes 1616 constitute cathodes to achieve radial inward flow. The electrodes 1616 and 1617 and the porous core mediums 1614 cooperate to induce flow of the fluid through the porous core mediums 1614 between the individual interior and common exterior reservoirs 1636 and 1630. The direction of flow is dependent upon the charges applied to the electrodes 1616 and 1617.

The housing 1612 has at least one fluid inlet 1646 that communicates with each interior reservoir 1632 and at least one fluid outlet 1648 for the common exterior reservoir 1630. For example, the bottom 1620 may include a separate fluid inlet 1646 within each of the open ends 1640, and a single fluid outlet 1648 in side wall 1622. In one flow direction, the fluid inlets 46 convey fluid into the interior reservoir 1636. The fluid outlet 1648 discharges the fluid from the exterior reservoir 1630 once the fluid is pumped through the porous core medium 1614. Optionally, the flow direction of the fluid inlets 1646 and fluid outlets 1648 maybe reversed such that fluid flows from the exterior reservoir 1630 radially inward to the interior reservoirs 1636. The upper cover 1656 allows gas to be discharged from the top of the housing 1612. The gas migrates toward the upper cover 1656 along a direction transverse (e.g. along core axis 1624) to the radial direction of fluid flow through the porous core mediums 1614.

Optionally, the housing 1612 and/or pump cavity 1628 may have a square, triangular, oval, hexagonal, polygonal shape and the like, when viewed from the top and/or side. The cylindrical porous core medium 1614 acts as a flow and current barrier between pumps. The entire upper cover 1656 of the housing 1612 is a soft top venting membrane. Optionally, the EO pump 1610 may use a single voltage source or independently controlled sources. When multiple voltage sources are used, the EO pump 1610 share a common electrode 1617, but the potential across each porous core medium 1614 can be independently controlled by a corresponding individual voltage source. When a single voltage source is used, the electric field, and thus the flow rate, can be tuned by varying the geometry of the common electrode 1617. The embodiment of FIGS. 26 and 27 provides various advantages including, among others, a larger reservoir for gas management, ease of construction, a compact form factor, and ease of pump replacement.

Figure 28:
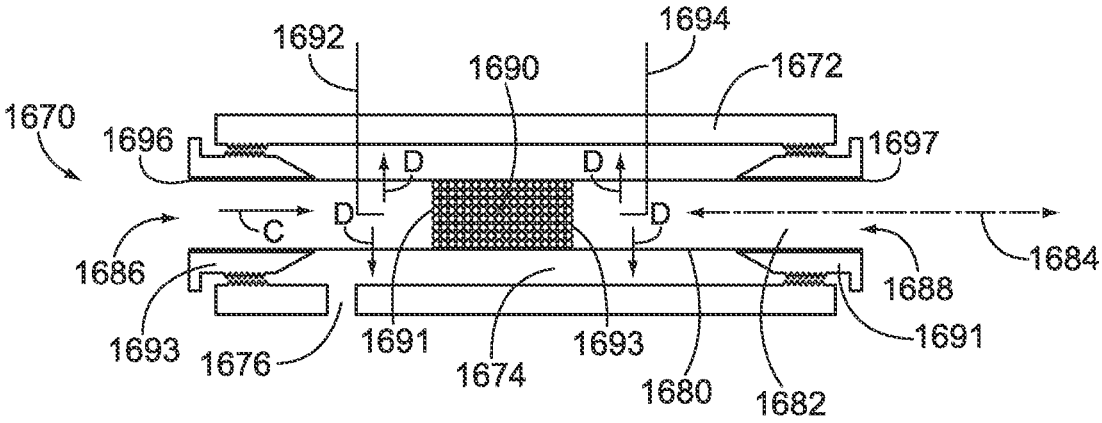
FIG. 28 illustrates a side sectional view of an EO pump formed in accordance with one embodiment.

FIG. 28 illustrates a side sectional view of an EO pump 1670 formed in accordance with an alternative embodiment of the present invention. The pump 1670 comprises a housing 1672 that has a vacuum cavity 1674 provided therein. A core retention member 1680 is provided within the vacuum cavity 1674. The core retention member 1680 has an inner pump chamber 1682 that forms a fluid channel that extends along a longitudinal axis 1684. Fluidic inlet and fluidic outlet 1686 and 1688 are located at the opposite ends 1696 and 1697 of the inner pump chamber 1682. The core retention member 1680 is made of a material that is gas permeable and fluid impermeable. The housing 1672 includes a vacuum inlet 1676 that is configured to be coupled to a vacuum source (not shown) to induce a vacuum within the vacuum cavity 1674. Optionally, the vacuum source may be removed entirely and EO pump 1670 operated without inducing a vacuum in the cavity 1674.

A porous core medium 1690 is provided within the core retention member 1680. The porous core medium 1690 is located between the fluidic inlet and fluidic outlet 1686 and 1688. The porous core medium 1690 is arranged to substantially fill the core retention member 1680 in the cross sectional direction, to require all fluid to pass through the porous core medium 1690 to be conveyed from the fluid inlet 1686 to the fluid outlet 1688. By way of example, the porous core medium 1690 may be comprised of a porous homogeneous or nonhomogeneous material, a collection of beads, PEEK, or other biocompatible polymers that retain a surface charge and permit fluid to flow there through. The core retention member 1680 has an elongated cylindrical shape that is open at opposite ends 1696 and 1697. The core retention member 1680 represents a tube having an outer wall formed from, for example, PTFE AF. The fluid flows along the tube within the outer wall, in the direction of arrow A while gas passes radially outward through the outer wall, in the direction of arrow B.

Electrodes 1692 and 1694 extend into the core retention member 1680 and are located proximate to opposite surfaces 1691 and 1693 of the porous core medium 1690, such that, when electrically charged, flow of a fluid is induced through the porous core medium 1690 from the fluid inlet 1686 to the fluid outlet 1688. The electrodes 1692 and 1694 are separated from one another along the longitudinal axis 1684. The electrodes 1692 and 1694 introduce an electrical potential difference across the porous core medium 1690 that causes the fluid to flow in the direction of arrow C along the longitudinal axis through the porous core medium 1690. As discussed above, a gas is generated at the electrode as the fluid flows through the porous core medium 1690. The core retention member 1680, being formed of a gas permeable material, permits the gas to dissipate radially outward from the core retention member 1680 away from the porous core medium 1690. The optional vacuum source (not shown) introduces a vacuum within the vacuuming cavity 1674 to induce migration of the gas in the radial direction (as denoted by arrows D) transverse to the longitudinal axis of 1684 away from the porous core medium 1690 and outward through the core retention member 1680. Venting of the electrolysis gases can be improved using a vacuum housing (depending on the gas generation rate and tubing permeability).

Optionally, threaded fittings 1681 and 1683 may be integrated at opposite ends of the housing 1672 as a part of the existing tubing network of a slide interface and manifold. The fittings 1681 and 1683 may be screwed-in to lock in place opposite ends 1697 and 1696 of the core retention member 1680. The fittings 1681 and 1683 may be unscrewed and slid off over opposite ends 1697 and 1696 of the core retention member 1680 to replace the core retention member 1680. Thus, no modifications of an existing slide interface or manifold are needed.

Figure 29:
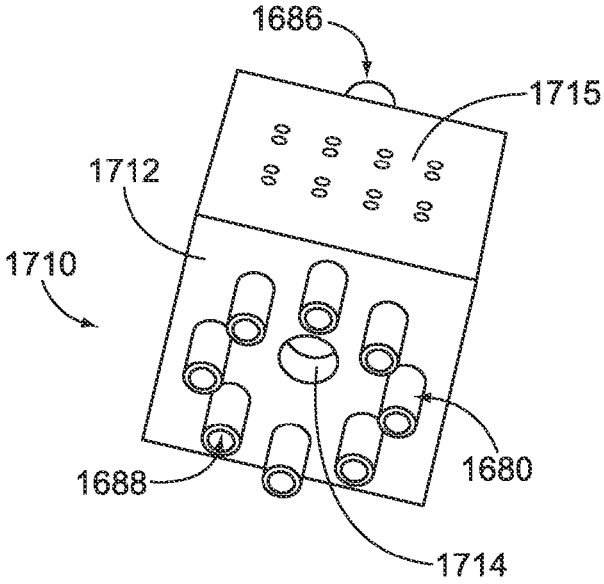
FIG. 29 illustrates an end perspective view of a manifold formed in accordance with one embodiment.

FIG. 29 illustrates an end perspective view of a manifold 1601 formed in accordance with an alternative embodiment. The manifold 1601 includes a vacuum housing 1603 that holds a plurality of core retention members, such as core retention member 1680 (FIG. 28) which form separate fluid channels through the manifold 1601. Optionally, a single inlet 1686 may be provided to supply fluid to multiple or all of the channels. The core retention members 1680 have inlets that communicate with the single inlet 1686 and fluid outlets 1688 at opposite ends. A vacuum inlet 1605 and electrode inlets 1607 are provided in the housing 1603 of the manifold 1601. In the example of FIG. 29, the electrode inlets 1607 are grouped in eight pairs, a separate pair for each of the eight core retention members 1680. The electrode inlets 1607 receive electrodes such as electrodes 1692 and 1694 (FIG. 28). The electrodes 1692 and 1694 may provide each channel with a unique applied electrical field. In the example of FIG. 29, eight pumps may be rapidly changed and all pumps may share a common vacuum line 1605. The embodiment of FIG. 29, provides various advantages such as a compact design, minor alterations to the existing slide interface, a large venting area, a pull and push flow capable, and compatibility with existing PEEK fitting technology.

Figure 30:
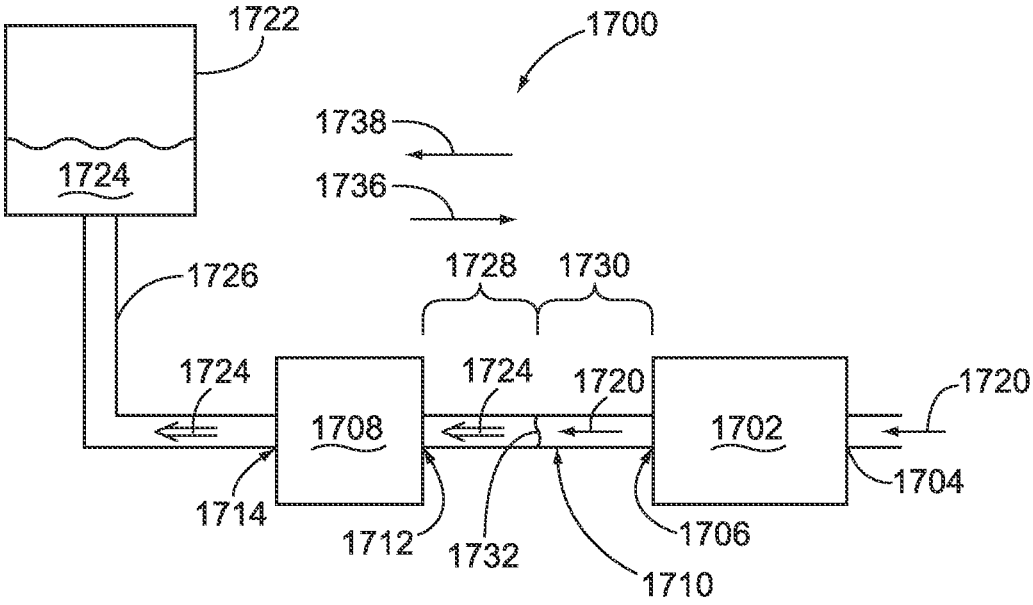
FIG. 30 illustrates a block diagram of a pump/flow subsystem formed in accordance with one embodiment.

FIG. 30 illustrates a block diagram of a pump/flow subsystem 1700 formed in accordance with one embodiment. The subsystem 1700 includes a flow cell 1702 that receives a fluid of interest 1720 at inlet 1704 and that discharges the fluid of interest 1720 at outlet 1706. The outlet 1706 is fluidly coupled to an EO pump 1708 over channel 1710. The EO pump 1708 includes a pump inlet 1712 and a pump outlet 1714. The pump outlet 1714 is coupled to a working fluid reservoir 1722 which stores a working fluid 1724. The working fluid 1724 is supplied over channel 1726 to the EO pump 1708. The working fluid 1724 fills the EO pump 1708 and passes into a first section 1728 the channel 1710 until meeting the fluid of interest 1720. The fluid of interest 1720 fills the second section 1730 of the channel 1710. The working fluid 1724 and fluid of interest 1720 come into contact with one another at a fluid to fluid interface 1732. The interface 1732 may simply represent a fluid interface, such as when the working fluid and the fluid of interest do not intermix due to their properties. Alternatively, the interface 1732 may represent a membrane that is permitted to move within and along the channel 1710 as the working fluid is pumped through the EO pump 1708.

In operation, the EO pump 1708 drives the working fluid along one or both of directions 1736 and 1738 to push and/or pull the working fluid 1724 toward and/or away from the flow cell 1702. As the working fluid 1724 is moved along channel 1710, the working fluid 1724 forces the fluid of interest to flow in the same direction and through the flow cell 1702. By utilizing a working fluid 1724 that is separate and distinct from the fluid of interest, the working fluid 1724 may be selected to have desired properties well suited for operation in EO pump 1708. The EO pump 1708 will operate independent of the properties of the fluid of interest 1702.

The EO pump 1708 may either push or pull the fluid of interest. The working fluid may represent de-ionized water, which subsequently generates a pressure gradient upon the fluid of interest 1720. The working fluid 1724 may be suitable when the fluid of interest 1710 is of a high ionic strength (e.g. Sodium Hydroxide) which would lead to higher currents, and therefore more gas generation if passed through the EO pump 1708.

Figure 17:
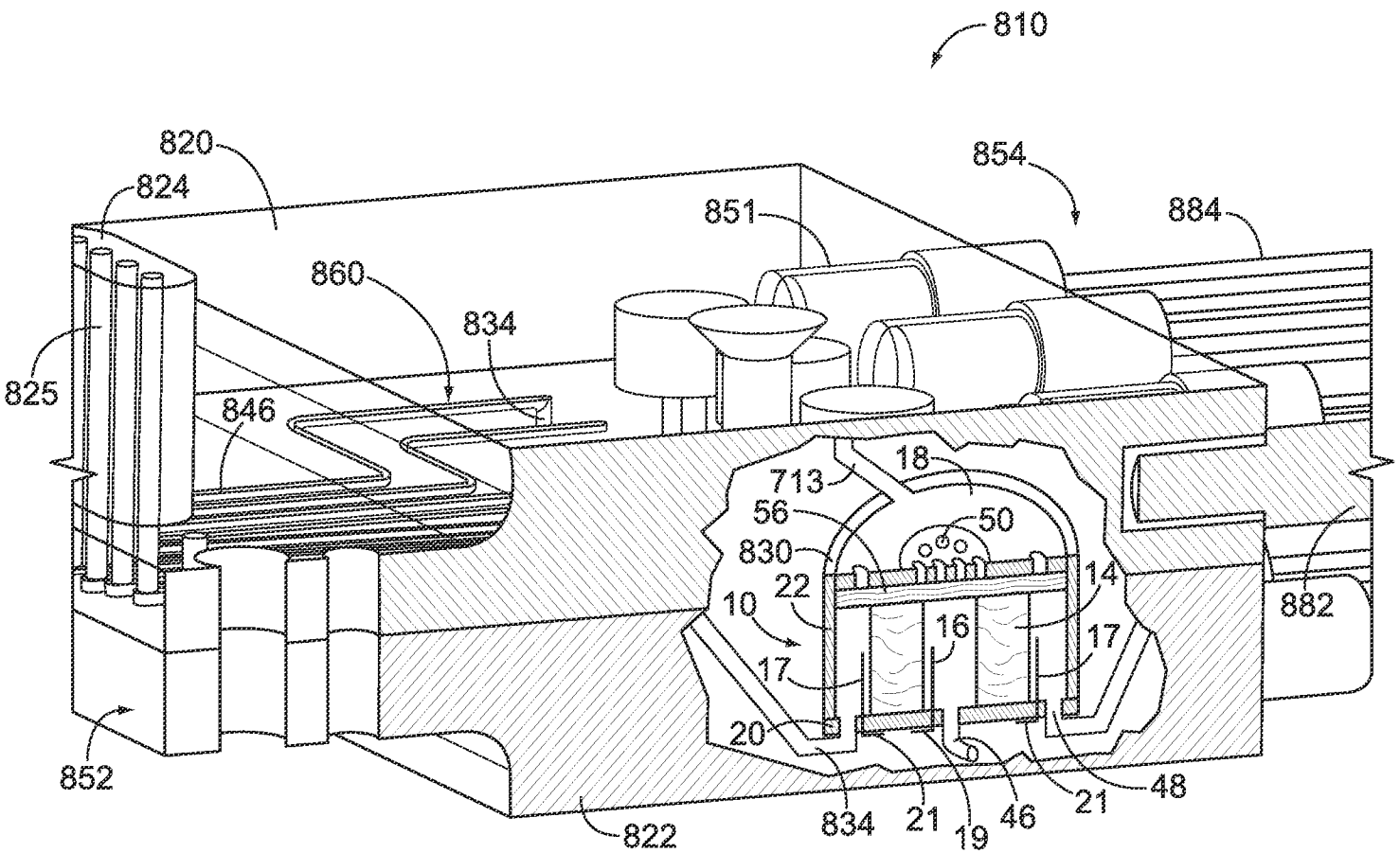
FIG. 17 illustrates a cross-sectional view of the manifold after the layers have been secured together.

FIG. 17 illustrates a cross-sectional view of the manifold 810 after the layers 820 and 822 have been secured together. For the purposes of illustration only, one EO pump 10 is shown in cross section. It is recognized that the EO pump 10 is not to scale. The EO pump 10 includes the structure and reference numerals of the EO pump 10 of FIG. 1 and thus is not discussed further here.

When constructed, the manifold 810 has a detector engaging end 852 and a line terminating end 854. The corresponding connector passages 825, channel grooves 846, and passages 834 form one channel 860 that extends from the detector engaging end 852 to the line terminating end 854. The line terminating end 854 includes a receptacle that is in flow communication between the pump cavity 830 (FIG. 16) and a discharge line 884. A sealing member 882 is secured to the receptacle and couples the discharge line 884 to an I/O port of the pump cavity 830. Furthermore, the manifold 810 may be fastened to the holder 806 (FIG. 15) using a screw hole 851. When the manifold 810 is in operation, the connector 824 is sealably connected to the flow cell 802 (FIG. 16) such that each channel 860 connects to a corresponding channel in the flow cell 802. By distributing the channels 860 in a flared pattern, the EO pumps 10 may be fitted with larger components (e.g., electrodes and porous core) thereby allowing a greater flow rate. Furthermore, by distributing the pump cavities 830 between the two layers 820 and 822 more EO pumps 10 may be used within the predetermined width of the manifold 810.

Figure 18:
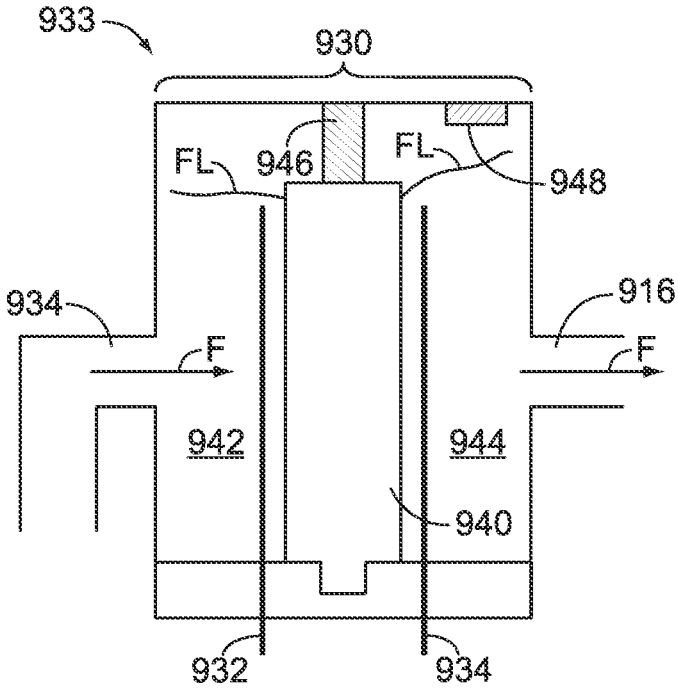
FIG. 18 illustrates a cross-section of the EO pump.

FIG. 18 is a cross-section of an EO pump 933 that may be used in the manifold 810, or in flow cells. As shown, the pump cavity 930 is in flow communication with the passage 934 and an I/O port 916 which leads to the discharge line. The EO pump 933 includes at least two electrodes 932 and 934 that are positioned a predetermined distance apart and have bodies that extend in a direction substantially parallel with respect to each other. The electrodes 932 and 934 may be, for example, wire coil electrodes so as to not substantially disrupt the flow of the fluid. The electrodes 932 and 934 may be electrically connected to contacts (not shown) which are, in turn, connected to a power source. In FIG. 18, the electrode 932 is positively charged and operates as an anode. And the electrode 934 is negatively charged and operates as a cathode.

The EO pump 933 also includes a core 940 that is interposed between the electrodes 932 and 934. The core 940 may be similar to the core 14 described above and includes a number of small pathways allowing the fluid to flow therethrough. The core 940 has a shape that extends across the pump cavity 930 such that the core 940 substantially separates the pump cavity 930 into two reservoirs 942 and 944. When an electric potential is applied between the electrodes 932 and 934, the fluid flows through the core 940 from the reservoir 942 to the reservoir 944. As described above, the applied electrical potentials may lead to the generation of gases (e.g., H2 generated near the electrode 934 and O2 generated near the electrode 932). The gas rises toward the top of the pump cavity 930 thereby avoiding the core 940 so that the gases do not interfere with the fluid flow through the core 940. As shown, the gases may form pockets at the top of the pump cavity 930 (illustrated by the fill lines FL).

As shown in FIG. 18, the EO pump 933 may include a vapor permeable membrane 946, which may be fabricated from, for example, polytetrafluoroethylene (PTFE). The membrane 946 may be positioned above the core 940 and, in one example, may form a collar that surrounds a portion of a perimeter of the core 940. The membrane 946 allows the O2 gas to pass from the reservoir 942 to the reservoir 944. Also shown, the EO pump 933 may include a catalyst member 948 within the reservoir 944. The catalyst member 948 operates as a catalyst for recombining the gases generated by the electrodes 932 and 934. The membrane 946 and catalyst member 948 may be located proximate to the core 940 in an area in which gases collect once generated during operation of the EO pump 933. When the gases mix in the reservoir 944, the catalyst member 948 facilitates recombining the H2 and O2 gases into water, which may then rejoin the fluid within the reservoir 944.

Figure 19:
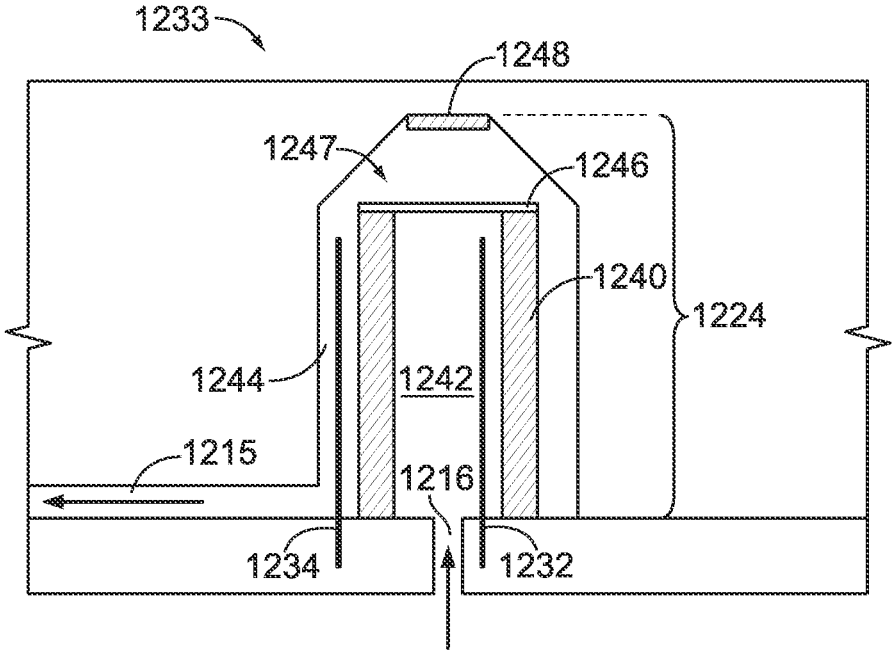
FIG. 19 illustrates a cross-sectional view of an EO pump formed in accordance with an alternative embodiment.

FIG. 19 is a cross-sectional view of an EO pump 1233 formed in accordance with an alternative embodiment. The EO pump 1233 may be used or integrated with the flow cells and/or the manifolds discussed herein. Furthermore, the EO pump 1233 may be positioned upstream or downstream from corresponding channels (not show) within a flow cell (not shown). The EO pump 1233 is positioned within a pump cavity 1224. The EO pump 1233 includes at least two electrodes 1232 and 1234 that are positioned a predetermined distance apart and have bodies that extend in a direction substantially parallel with respect to each other. The electrodes 1232 and 1234 may be electrically connected to contacts (not shown), which are connected to a power source (not shown). In FIG. 19, the electrode 1232 is positively charged and operates as an anode, and the electrode 1234 is negatively charged and operates as a cathode. The EO pump 1233 also includes a porous core medium 1240 that is interposed between the electrodes 1232 and 1234.

As shown in FIG. 19, the core 1240 has a shape that surrounds the electrode 1232. The core 1240 may have one portion that encircles the electrode 1232 or may include two portions that have the electrode 1232 interposed there between. When an electric potential is applied between the electrodes 1232 and 1234, the fluid flows through the core 1240 from an inner reservoir 1242 to an outer reservoir 1244. As described above, the applied electrical potentials may lead to the generation of gases (e.g., H2 generated near the electrode 1234 and O2 generated near the electrode 1232). The gas rises toward the top of the pump cavity 1224 thereby avoiding the core 1240 so that the gases do not interfere with the fluid flow through the core 1240. The EO pump 1233 may also include a vapor permeable membrane 1246, which may be fabricated from, for example, polytetrafluoroethylene (PTFE). The membrane 1246 may be positioned above the core 1240 and, in one example, may form a top that covers the core 1240. The membrane 1246 allows the O2 gas to pass from the reservoir 1242 to the reservoir 1244. Also shown, the EO pump 1233 may include a catalyst member 1248 within the pump cavity 1224. Similar to the catalyst member 748 and 948, the catalyst member 1248 operates as a catalyst for recombining the gases generated by the electrodes 1232 and 1234. The membrane 1246 and catalyst member 1248 may be located proximate to the core 1240 and define a gas collection area 1247 therebetween where gases collect. When the gases mix in the collection area 1247, the catalyst member 1248 facilitates recombining the H2 and O2 gases into water, which may then rejoin the fluid within the reservoir 1244.

In FIG. 19, the membrane 1246 is positioned below the catalyst member 1248 such that when the gases recombine to form water, the water may fall upon the membrane 1246. In an alternative embodiment, the catalyst member 1247 is not positioned directly above the membrane 1246 such that the water would fall upon the membrane 1246. More specifically, the pump cavity 1224 may be configured to direct the gases to a gas collection area that is not directly above the membrane 1246. For example, the gas collection area 1247 and the catalyst member 1248 may be positioned above the electrode 1234 shown in FIG. 19. When the gases recombine, the water may fall directly into fluid held by the reservoir 1244 near the electrode 1234 thereby not falling upon the membrane 1246.

Figure 20:
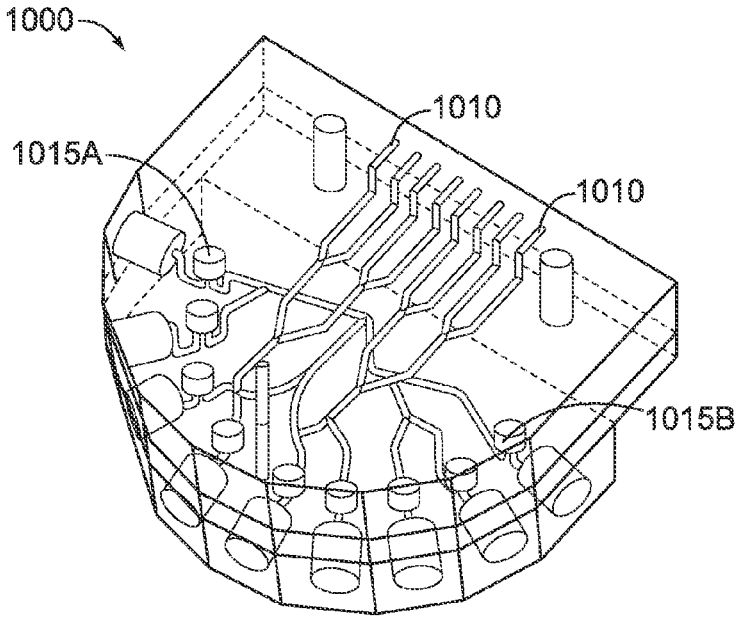
FIG. 20 illustrates a perspective view of the outlet manifold that may be formed in accordance with alternative embodiments.
Figure 21:
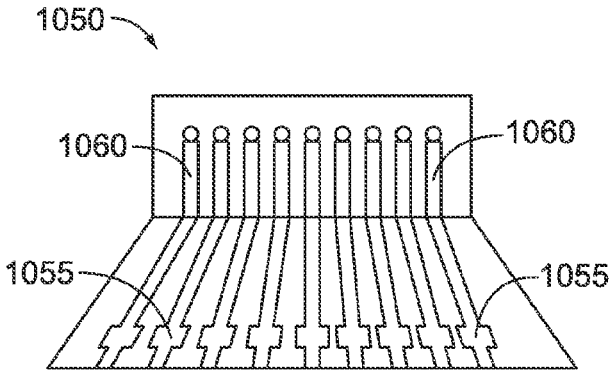
FIG. 21 illustrates a planar view of an inlet manifold and illustrates a "push" manifold that may be formed in accordance with alternative embodiments.

FIGS. 20 and 21 illustrate manifolds 1000 and 1050, respectively, that may be formed in accordance with alternative embodiments. FIG. 20 is a perspective view of the outlet manifold 1000. The outlet manifold 1000 has a number of branching channels 1010 that merge and diverge from each other. Each channel 1010 is in fluid communication with one or more EO pumps 1015, as each EO pump 1015 is in fluid communication with one or more channel 1010. The manifold 1000 sealably connects to a flow cell, such as those described above. The manifold 1000 allows an operator to use different EO pumps 1015 for different types of solution. For example, an operator may use the EO pump 1015A for a buffer solution and, separately, use the EO pump 1015B for a reagent solution. As such, the flow rate of the fluid in each flow cell channel (not shown) may be controlled by more than one EO pump 1015. Alternatively, the EO pumps 1015A and 1015B may be used simultaneously.

FIG. 21 is a planar representation of an inlet manifold 1050 and illustrates a "push" manifold that includes several EO pumps 1055 that are positioned upstream from a flow cell, such as those discussed above. The manifold 1050 forces the fluid through channels 1060, which sealably engage with channels from the flow cell where reactions may occur.

Furthermore, multiple EO pumps may be used either in series (i.e., cascade) or in a parallel with respect to one channel. Furthermore, the EO pumps 10, 70, 110, 410, 933, 1015, and 1055 described above are bi-directional in that the direction of flow may be reversed by changing the polarity of the corresponding electrodes and (if necessary) repositioning the catalyst member or medium. In one embodiment, the EO pump is integrated and held together by a housing thereby allowing a user to flip the EO pump causing the flow to change direction.

Figure 22:
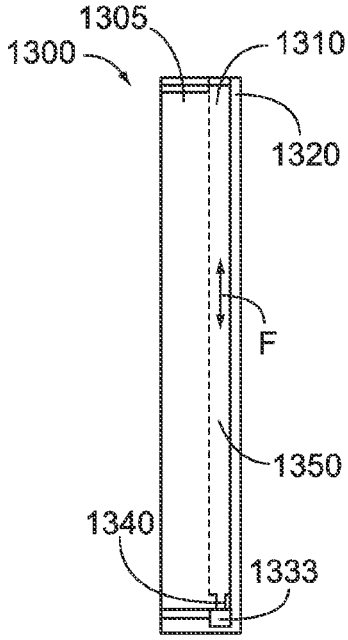
FIG. 22 illustrates a flow cell formed in accordance with an alternative embodiment.

FIG. 22 is a side view of flow cell 1300 formed in accordance with an alternative embodiment. The flow cell 1300 may be similarly fabricated as discussed above and may include a base layer 1305, a channel layer 1310, and a cover layer 1320. The flow cell 1300 is configured to be held vertically (i.e., the fluid flow within channels 1350 is substantially aligned with the force of gravity) by the system 50 while the flow cell 1300 is being read. The fluid flow could either be toward an EO pump 1333 or away from the EO pump 1333. The EO pumps 1333 that may be similarly configured to the EO pumps discussed above. However, the EO pumps 1333 may be, for example, rotated about 90 degrees with respect to the orientation shown above so that the gases generated by the electrodes (not shown) may rise to the designated gas collection area. The flow cell 1300 also includes passages 1340 in flow communication with the channels 1350 and EO pumps 1333. In one embodiment, the EO pump 1333 functions and operates similarly to the EO pumps discussed above. Alternatively, as will be discussed below, the EO pump 1333 may operate and function similar to a valve in controlling the direction and flow rate of the fluid through channels 1350.

Figure 23:
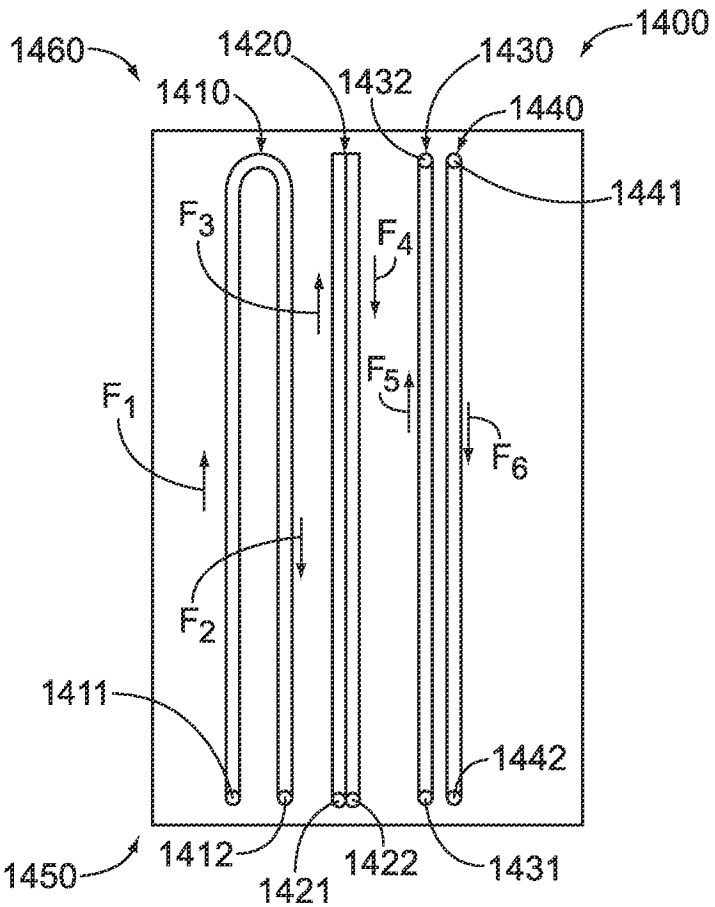
FIG. 23 illustrates a planar view of a flow cell formed in accordance with an alternative embodiment.

FIG. 23 is a planar view of a flow cell 1400 formed in accordance with an alternative embodiment. FIG. 23 illustrates channels having inlets and outlets on the same end of the flow cell 1400. More specifically, the flow cell 1400 includes a plurality of channels 1410, 1420, 1430, and 1440. Although the following is directed toward the flow cell 1400, the description of the channels 1410, 1420, 1430, and 1440 may similarly be applied to the other flow cells described herein. The channel 1410 has an inlet hole 1411 at an end 1450 and extends a length of the flow cell 1400 to another end 1460. The channel 1410 then turns and extends back toward the end 1450 until the channel 1410 reaches an outlet hole 1412. The channel 1420 includes an inlet hole 1421 and extends down toward the end 1460. When proximate to the end 1460, the channel 1420 then turns and extends back toward the end 1450 and outlet 1422. As shown in FIG. 23, the channel 1420 abruptly or sharply turns back toward the end 1450 such that the portion of channel 1420 extending from end 1450 to end 1460 is adjacent to or shares a wall with the portion of channel 1420 extending from end 1460 to end 1450. At the end 1460, the channel 1420 may turn within the channel layer or may turn into other layers (not shown) including extending out of the flow cell 1400 before returning to the channel layer.

Also shown in FIG. 23, the channels 1430 and 1440 extend parallel and adjacent to each other within the flow cell 1400. The channel 1430 includes an inlet hole 1431 and an outlet hole 1432. The channel 1440 includes an inlet hole 1441 and an outlet hole 1442. As shown, the flow of fluid F5 is opposite in direction to the flow of fluid F6. In some embodiments, the fluid within the channels 1430 and 1440 belong to separate lines of a fluid flow system. Alternatively, the fluid within the channels 1430 and 1440 belong to a common line of the fluid flow system such that the fluid flowing through the outlet 1432 either immediately or eventually returns to the channel 1440 through inlet 1441.

Figure 24:
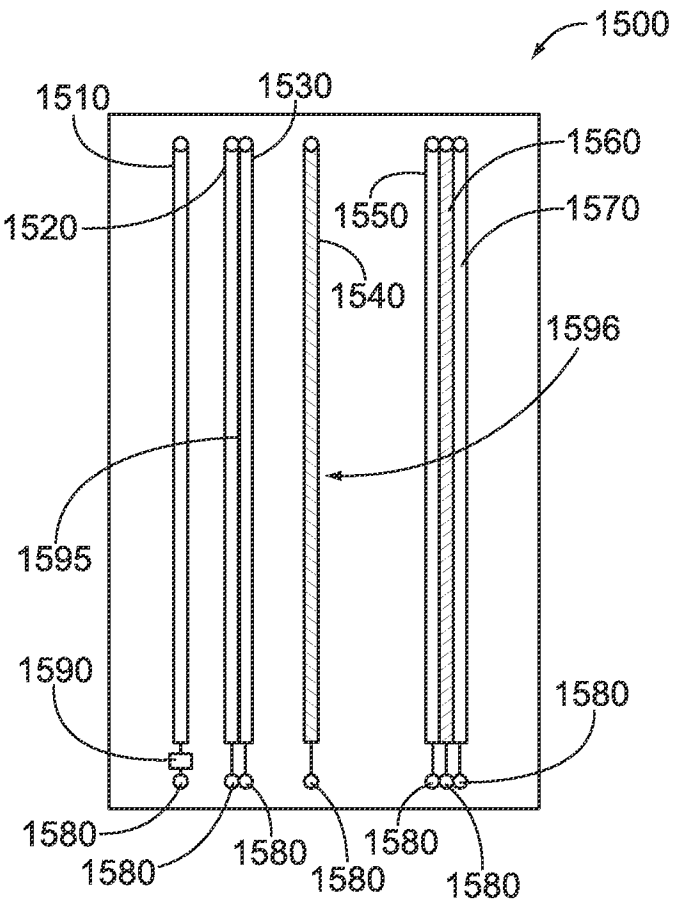
FIG. 24 illustrates a planar view of a flow cell that integrates one or more heating mechanisms.

FIG. 24 is a planar view of a flow cell 1500 that integrates one or more heating mechanisms. The flow cell 1500 illustrates a plurality of channels 1510, 1520, 1530, 1540, 1550, 1560, and 1570 all of which include inlet EO pumps 1580 that are upstream from the corresponding channel. Alternatively, the EO pumps may be outlets that are positioned downstream from the corresponding channel. The channel 1510 is in flow communication with the corresponding EO pump 1580 and includes a passage that runs adjacent or proximate to a contact pad 1590. The pad 1590 is configured to generate thermal energy (or, alternatively, absorb thermal energy) for regulating the temperature of the fluid within the channel 1510. The pad 1590 may be made from a metal alloy and/or another thermally conductive material. Also shown, the channels 1520 and 1530 extend adjacent to each other and include a thermal conductor 1595 that extends between the channels 1520 and 1530. Similar to the pad 1590, the thermal conductor 1595 is configured to regulate the temperature of the fluid within the channels 1520 and 1530 and may be made from a metal alloy and/or another thermally conductive material. Alternatively, each thermal conductor 1595 (if more than one) may only be used with one corresponding channel. Furthermore, the channel 1540 utilizes a thermal conductor 1596 that extends the bottom of the channel 1540 and functions similarly to the thermal conductor 1595.

Also shown in FIG. 24, the flow cell 1500 may utilize an additional channel 1560 to regulate the temperature of adjacent channels 1550 and 1570. More specifically, fluid flowing through the channel 1560 may have a predetermined temperature (determined by the computing system or operator) that generates thermal energy for or absorbs thermal energy from the adjacent channels 1550 and 1570. Although flow cell 1500 illustrates several types of integrated heating mechanisms, the flow cell 1500 (or other flow cells described herein) may use only one or more than one within the same flow cell if desired. Furthermore, more than one heating mechanism may be used for each channel. For example, one side of the channel may be kept warmer by a thermal conductor that generates heat. The other side of the channel may be cooler by a thermal conductor that absorbs thermal energy.

Figure 25:
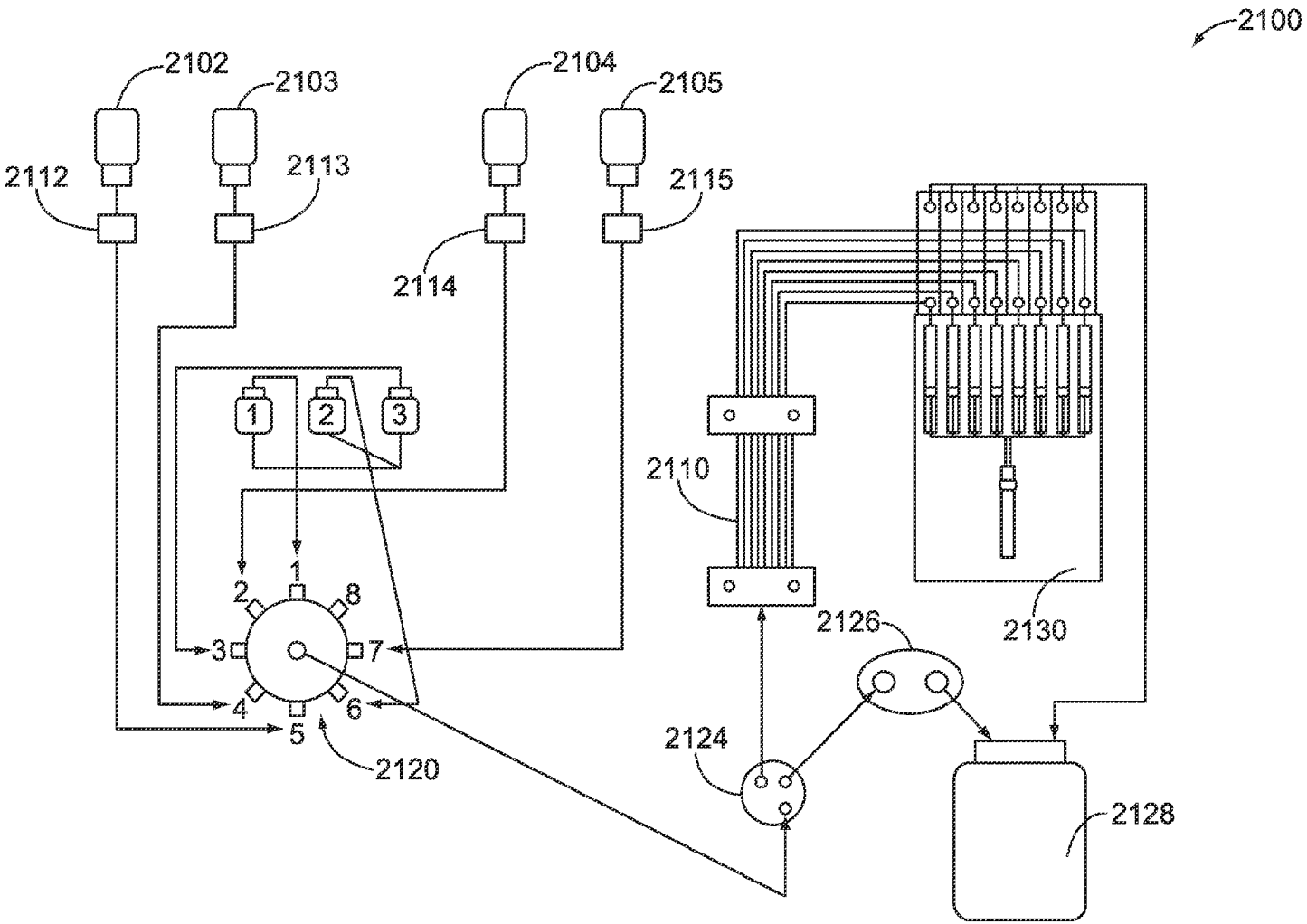
FIG. 25 illustrates a fluid flow system formed in accordance with one embodiment.

FIG. 25 illustrates a fluid flow system 2100 formed in accordance with one embodiment. The fluid flow system 2100 may be used with any system, such as system 50, that utilizes fluidics or microfluidics in delivering different types of solutions to different devices or systems. In addition, the fluid flow system 2100 may use any of the flow cells and manifolds discussed herein. As shown, the fluid flow system 2100 includes a plurality of solution containers 2102-2105 that hold corresponding reagents or solutions. Each container 2102-2105 is in fluid communication with a corresponding electroosmotic (EO) switch 2112-2115. The EO switches 2112-2115 include parts and components similar to those discussed above with reference to EO pumps 730 and 833. However, the EO switches 2112-2115 function and operate similar to valves. More specifically, the EO switches 2112-2115 resist fluidic motion in one direction. When the operator or computing system desires that a solution from one of the containers 1102-1105 be used, the voltage differential is reduced or turned off altogether.

As shown in FIG. 25, the fluid flow system 2100 may include a multi-valve 2120, which may or may not utilize EO switches, such as EO switches 2112-2115. The multi-valve 2120 may mix the solutions from the containers 2102-2105 with each other or with other solutions (e.g., with water for diluting). The solutions may then be directed toward a priming valve (or waste valve 2124), which may be connected to an optional priming pump 2126. The priming pump 2126 may be used to draw the solutions from the corresponding containers 2102-2105. The priming valve 2124 (which may or may not include an EO switch) may then direct the solutions into a detector system, such as system 50, or into a flow cell 2110. Alternatively, solutions are directed into a manifold (not shown) attached to the flow cell 2110. The flow cell 2110 may or may not contain an EO pump, such as those discussed above. The fluid flow system 2100 may also include a channel pump 2130, which may draw the solutions through the corresponding channels and optionally direct the solutions into a waste reservoir.

As discussed above, the many switches, valves, and pumps of the fluid flow system 2100 may be controlled by a controller or computing system which may be automated or controlled by an operator.

Furthermore, the positioning, size, path, and cross-sectional shape of the channels in the flow cells and the manifold housing may all be configured for a desired flow rate and/or design for using with the detector system 50. For example, the pump cavities 830 in FIG. 16 may have a co-planar relationship with respect to each other.

Figure 31:
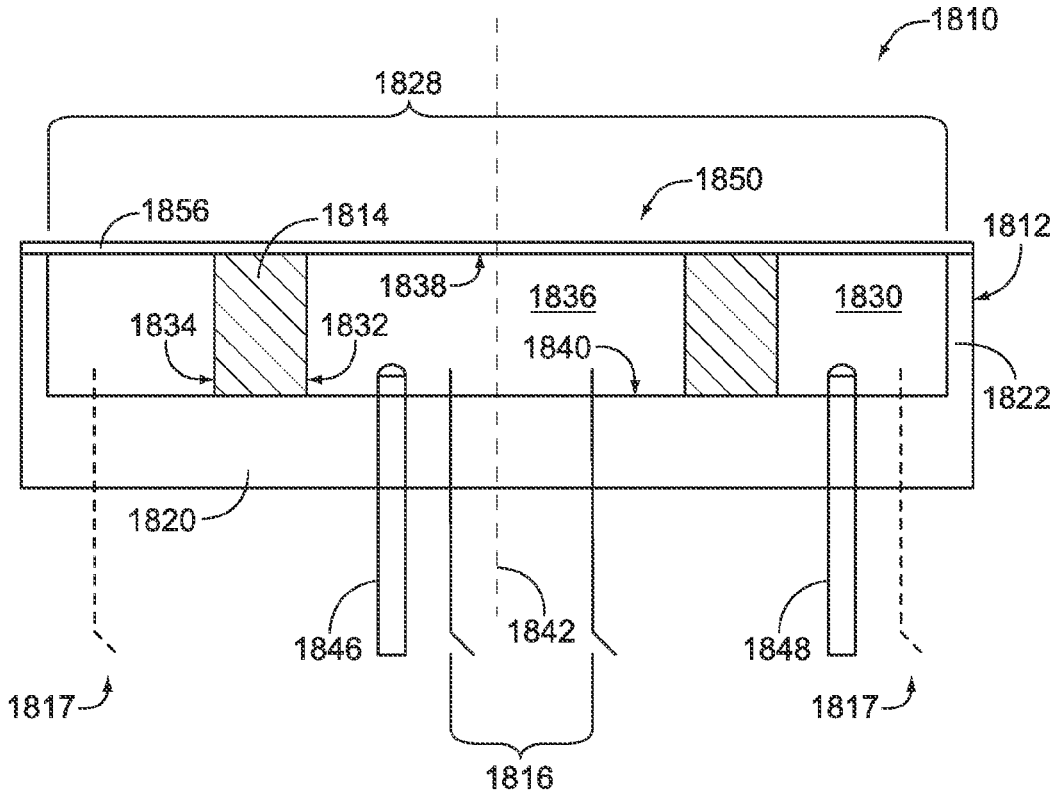
FIG. 31 illustrates a side sectional view of an EO pump formed in accordance with another embodiment.

FIG. 31 illustrates a side sectional view of an EO pump 1810 formed in accordance with another embodiment. The EO pump 1810 may have similar components and features as the EO pump 10, 110, and 410 or other EO pumps described herein. As shown in FIG. 31, the EO pump 1810 includes a housing 1812 that at least partially defines an interior pump cavity 1828. The EO pump 1810 also includes a porous core medium 1814 that separates the pump cavity 1828 into interior and exterior reservoirs 1836 and 1830. The EO pump 1810 can include a plurality of inner electrodes 1816 located in the interior reservoir 1836 and a plurality of outer electrodes 1817 located in the exterior reservoir 1830. Although the illustrated embodiment shows a plurality of inner electrodes 1816 and a plurality of outer electrodes 1817, in other embodiments the EO pump 1810 may have only one inner electrode 1816 and a plurality of outer electrodes 1817 or, alternatively, only one outer electrode 1817 and a plurality of inner electrodes 1816. The inner and outer electrodes 1816 and 1817 may be coupled to a power source 1807 (FIG. 32) that is configured to charge the inner and outer electrodes 1816 and 1817 in a predetermined or desired manner.

Also shown, the housing 1812 may be constructed with a lower plate 1820 and a side wall 1822 that rests on the lower plate 1820. The lower plate 1820 and the side wall 1822 at least partially define the interior pump cavity 1828. The porous core medium 1814 is positioned within the pump cavity 1828 and oriented in an upright configuration along a longitudinal axis 1842 relative to gravity. The porous core medium 1814 has an interior surface 1832 and an exterior surface 1834 that may be concentric with one another. The interior surface 1832 of the porous core medium 1814 surrounds the interior reservoir 1836 that may be open at opposite ends 1838 and 1840 which are spaced apart from one another along the longitudinal axis 1842.

The housing 1812 has at least one fluid inlet 1846 and at least one fluid outlet 1848. The housing 1812 includes an open top which forms a gas outlet 1850 that extends across an entire upper area spanning the interior reservoir 1836, the porous core medium 1814, and the exterior reservoir 1830. The open top gas outlet 1850 may receive a gas permeable, liquid impermeable membrane 1856 (e.g., modified PTFE or other materials). Although not shown, the membrane 1856 may be positioned between the interior reservoir and a cover or an upper plate of the EO pump 1910. The membrane 1856 may also be exposed to ambient air.

Although not shown, in some embodiments the EO pump 1810 may optionally comprise one or more motion sources. For example, the motion sources may be similar to the motion sources 58, 60, and 158 described above. Also optionally, the EO pump 1810 may include a filter membrane layer similar to the filter membrane layer 115 described above. The filter membrane layer may facilitate conduction of the electrical charge between the electrodes 1816 and 1817 and the porous core medium 1814. The filter membrane layers may include a hydrophilic material to encourage migration of the gas bubbles toward the gas outlet 1850.

Figure 32:
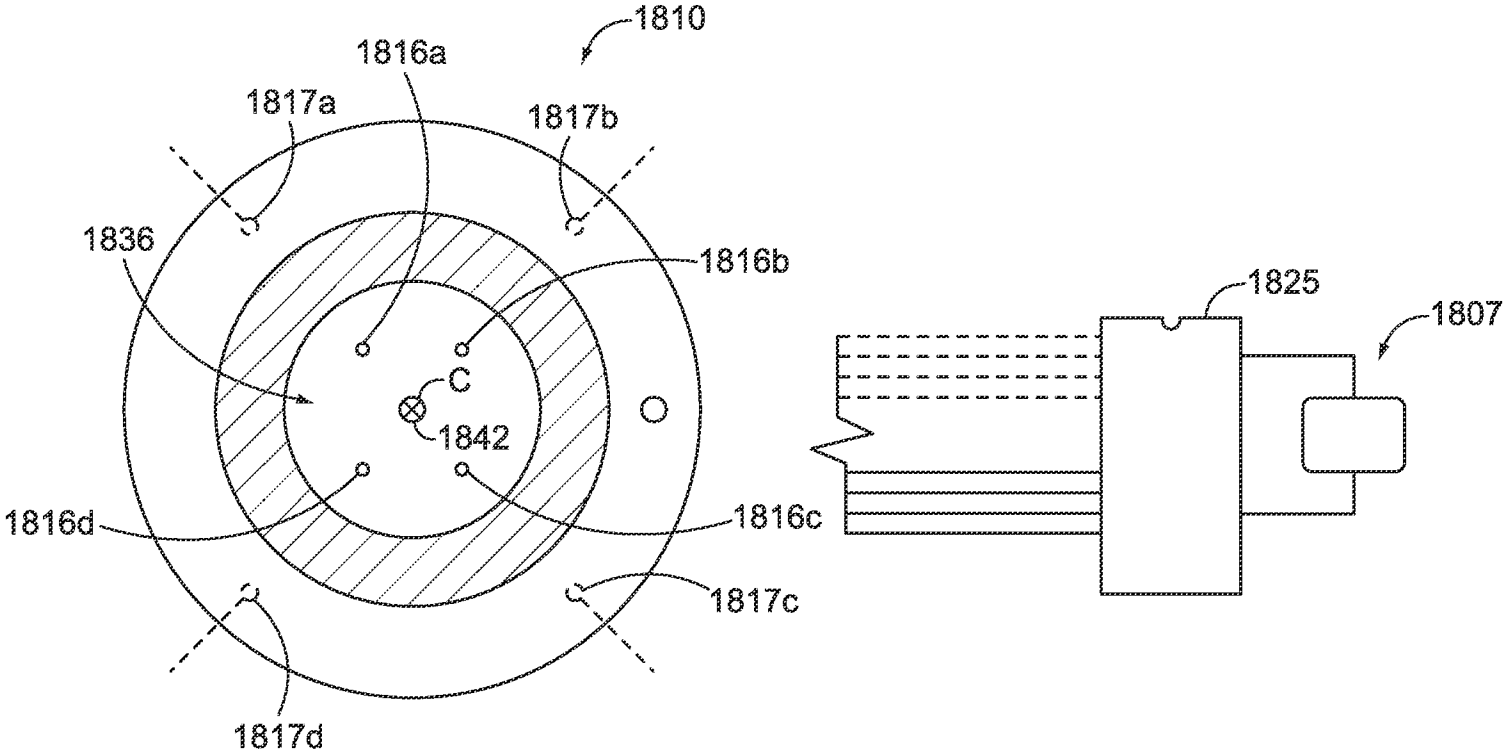
FIG. 32 is a top plan view of the EO pump of FIG. 31.

FIG. 32 is a top plan view of the EO pump 1810. As shown, the inner and outer electrodes 1816A-1816D and 1817A-1817D of the EO pump 1810 may be located at different positions within the interior and exterior reservoirs 1836 and 1830. In the illustrated embodiment, the inner electrodes 1816 may constitute anodes, while the outer electrodes 1817 may constitute cathodes. However, in other embodiments, the outer electrodes 1817 may constitute anodes and the inner electrode 16 may constitute cathodes. Similar to the description of other embodiments, the inner electrodes 1816 and the outer electrodes 1817 may induce a flow rate of the fluid based on a voltage potential maintained between anode(s) and cathode(s). The inner and outer electrodes 1816 and 1817 and the porous core medium 1814 may cooperate to induce flow of the fluid through the porous core medium 1814 between the interior and exterior reservoirs 1836 and 1830. During operation, the EO pump 1810 may generate gas bubbles within the pump cavity 1828.

Moreover, the inner and outer electrodes 1816 and 1817 may be positioned with respect to each other to distribute gas build-up within the pump cavity 1828 and/or to selectively control a flow of fluid within the pump cavity 1828. When the electrodes 1816 and 1817 are charged, gas may gather in certain regions of the pump cavity 1828 (e.g., electrode surface). As such, the electrodes 1816 and 1817 may be positioned so that gases migrate to and collect within predetermined or desired regions. Alternatively or in addition to, the inner and outer electrodes 1816 and 1817 may be positioned to control the flow of fluid. The controlled flow of fluid may facilitate the detachment of gas bubbles from surfaces within the EO pump 1810. For example, when fluid flows in a first direction within the pump cavity 1828, gas bubbles may generally collect in certain regions or on certain surfaces within the pump cavity 1828. More specifically, gas bubbles may attach to surfaces of the inner and outer electrodes 1816 and 1817 or to surfaces of the porous core medium 1814. Changing the flow of fluid from the first direction to a different second direction may facilitate detaching the gas bubbles from the corresponding surface. The gas bubbles may then migrate to a predetermined region of the pump cavity 1828 based upon the gravitational force direction.

FIG. 32 illustrates one example of an arrangement of inner and outer electrodes 1816 and 1817 for controlling gas build-up and/or the flow of fluid within the pump cavity 1828. As shown, the inner electrodes 1816 are spatially distributed about the longitudinal axis 1842 that extends through a geometric center C of the EO pump 1810. The inner electrodes 1816 may be positioned in a square-like arrangement where each inner electrode 1816 represents one corner of an inner square. More specifically, each inner electrode 1816 may be equi-distant from two other inner electrodes 1816 and positioned diagonally across from a third inner electrode 1816. Likewise, the outer electrodes 1817 may be positioned in a square-like arrangement where each outer electrode 1817 represents one corner of an outer square. More specifically, each outer electrode 1817 may be equi-distant from two other outer electrodes 1817 and positioned diagonally across from a third outer electrode 1817. The square-like arrangements of the inner and outer electrodes 1816 and 1817 may be concentric with each other about the center C. Furthermore, the square-like arrangements of the inner and outer electrodes 1816 and 1817 may be rotated about the center C such that each pair of diagonally spaced outer electrodes 1817 lies on a plane that intersects two diagonally spaced inner electrodes 1816.

Also shown in FIG. 32, the EO pump 1810 may be electrically coupled to the power source 1807 through a sequencing circuit 1825. The sequencing circuit 1825 may be configured to selectively charge the inner and outer electrodes 1816 and 1817 according to a predetermined sequence. For example, the inner electrodes 1816A-1816D and the outer electrodes 1817A-1817D may be selectively charged in coordination with each other. The inner and outer electrodes 1816 and 1817 may be selectively charged to control a build-up of gas within the EO pump 1810. When an electrode is charged, gas may form on a surface of the electrode. When the electrode is subsequently not charged, the gases on the surface may detach and migrate to certain regions in the pump cavity. As such, the inner and outer electrodes 1816 and 1817 may be selectively charged to distribute gases more evenly within the pump cavity 1828 to facilitate stabilizing a flow of the fluid and/or maintaining the EO pump 1810. Alternatively or in addition to, the inner and outer electrodes 1816 and 1817 may be selectively charged to direct the flow of fluid as desired.

Tables 1-3 illustrate different charge sequences that may be executed by the inner and outer electrodes 1816A-1816D and 1817A-1817D. The time periods T listed in Tables 1-3 may be approximately equal or different. For example, $T_{0-1}$ may be greater than, less than, or approximately equal to $T_{1-2}$ or other time periods T. The symbol (−) represents a negative charge, the symbol (+) represents a positive charge, and the symbol 0 represents no charge. After one cycle of a charge sequence has completed, the charge sequence may begin again as in a continuous loop. In some embodiments, each charged electrode may transfer an amount of charge to just about under a threshold of gas nucleation.

TABLE 1

| | $T_{0-1}$ | $T_{1-2}$ | $T_{2-3}$ | $T_{3-0}$ |
|---|---|---|---|---|
| Inner Electrode 1816A | (+) | 0 | 0 | 0 |
| Inner Electrode 1816B | 0 | (+) | 0 | 0 |
| Inner Electrode 1816C | 0 | 0 | (+) | 0 |
| Inner Electrode 1816D | 0 | 0 | 0 | (+) |
| Outer Electrode 1817A | (−) | 0 | 0 | 0 |
| Outer Electrode 1817B | 0 | (−) | 0 | 0 |
| Outer Electrode 1817C | 0 | 0 | (−) | 0 |
| Outer Electrode 1817D | 0 | 0 | 0 | (−) |

TABLE 2

| | $T_{0-1}$ | $T_{1-2}$ | $T_{2-3}$ | $T_{3-0}$ |
|---|---|---|---|---|
| Inner Electrode 1816A | (+) | 0 | (+) | 0 |
| Inner Electrode 1816B | 0 | (+) | 0 | (+) |
| Inner Electrode 1816C | (+) | 0 | (+) | 0 |
| Inner Electrode 1816D | 0 | (+) | 0 | (+) |
| Outer Electrode 1817A | (−) | 0 | (−) | 0 |
| Outer Electrode 1817B | 0 | (−) | 0 | (−) |
| Outer Electrode 1817C | (−) | 0 | (−) | 0 |
| Outer Electrode 1817D | 0 | (−) | 0 | (−) |

TABLE 3

| | $T_{0-1}$ | $T_{1-2}$ | $T_{2-3}$ | $T_{3-0}$ |
|---|---|---|---|---|
| Inner Electrode 1816A | (+) | (+) | (+) | (+) |
| Inner Electrode 1816B | (+) | (+) | (+) | (+) |
| Inner Electrode 1816C | (+) | (+) | (+) | (+) |
| Inner Electrode 1816D | (+) | (+) | (+) | (+) |
| Outer Electrode 1817A | (−) | 0 | (−) | 0 |
| Outer Electrode 1817B | 0 | (−) | 0 | (−) |
| Outer Electrode 1817C | (−) | 0 | (−) | 0 |
| Outer Electrode 1817D | 0 | (−) | 0 | (−) |

Tables 1-3 illustrate different sequences for the configuration of inner and outer electrodes 1816A-1816D and 1817A-1817D as shown in FIGS. 31 and 32. However, FIGS. 31 and 32 illustrate only one exemplary spatial arrangement of the inner and outer electrodes 1816 and 1817 and many other spatial arrangements may be used to produce a desired result. For example, the inner electrodes 1816 may form a triangle-like arrangement and the outer electrodes may form a hexagonal-like arrangement. The arrangements may be concentric with each other or offset in some manner. In addition, the inner and outer electrodes 1816 and 1817 are not required to be equally spaced or distributed, but may have several electrodes grouped together while other electrodes are remotely located. Furthermore, the inner and outer electrodes 1816 and 1817 are not required to be pin-type electrodes that extend along the longitudinal axis 1842. For example, the inner and outer electrodes 1816 and 1817 may curve in a spiral manner such as the electrodes 216 and 217 described above. The inner and outer electrodes 1816 and 1817 may also have planar or curved bodies.

In addition, there may be an unequal number of inner electrodes with respect to outer electrodes. For instance, there may be only one inner electrode and multiple outer electrodes. In such an embodiment, the outer electrodes may cycle through a predetermined charge sequence. As another example, one outer electrode (cathode) may be associated with a pair of inner electrodes (anodes). The pair of inner electrodes may be selectively charged in an alternating manner and the outer electrode may remain charged throughout. In addition to the spatial arrangements of the inner and outer electrodes, the interior and exterior reservoirs 1830 and 1836 and the porous core medium 1814 may have different sizes and shapes. Furthermore, various other charge sequences may be used with the exemplary embodiment or with alternative embodiments.

Figure 33:
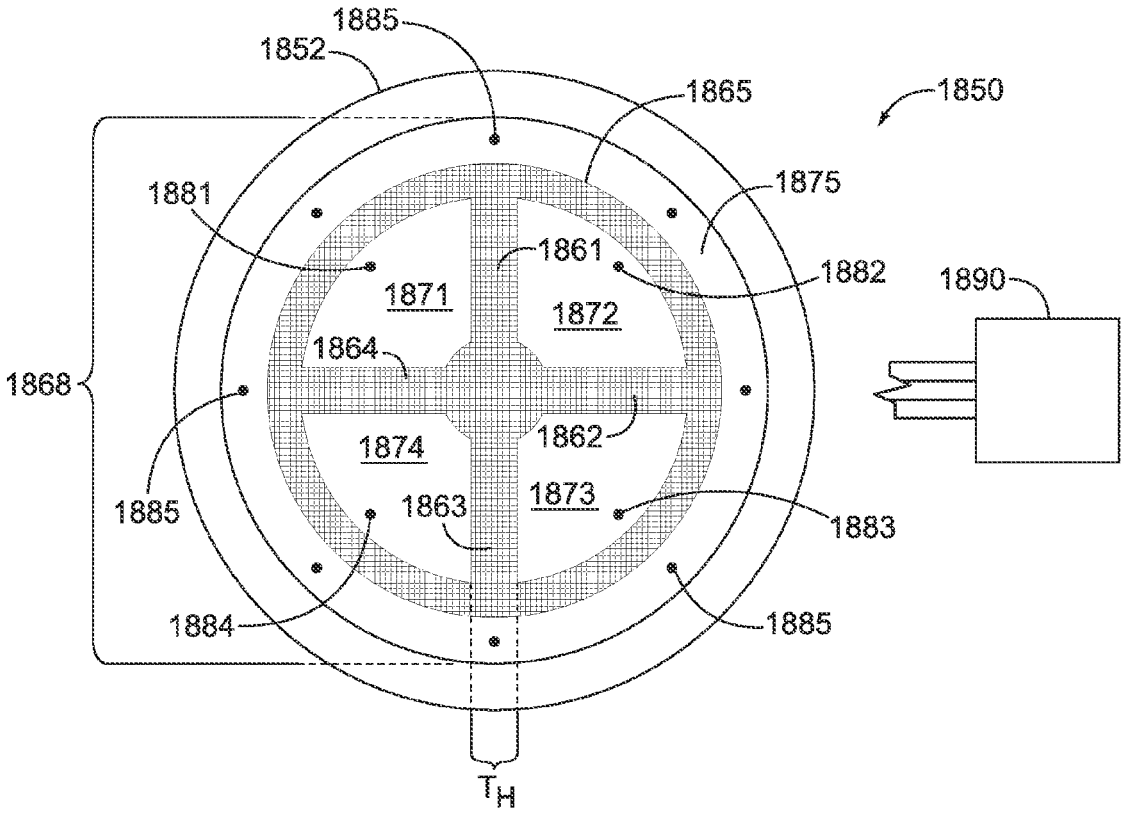
FIG. 33 illustrates a top plan view of a nucleic acid shearing apparatus formed in accordance with another embodiment.

FIG. 33 illustrates an apparatus 1850 that is formed in accordance with another embodiment for fragmenting or shearing species or polymers, such as nucleic acids or proteins. The apparatus 1850 may have similar features as the EO pumps described elsewhere. Likewise, the apparatus 1850 may also be an EO pump configured to induce a flow of fluid. Different methods and systems in biological or chemical analysis may desire fragments, such as DNA or ssDNA fragments. For example, various sequencing platforms use DNA libraries comprising DNA fragments that are separated into single-stranded nucleic acid templates that are subsequently sequenced. To this end, the apparatus 1850 may operate in a similar manner as the various EO pumps described herein and may include similar features. The apparatus may receive a sample fluid that includes nucleic acids or other species. Nucleic acids and other biomolecules may be positively or negatively charged. In some cases, a biomolecule may be negatively charged in one location and positively charged in another location. Although exemplified with respect to shearing or fragmenting polymers, such as nucleic acids, it will be understood that similar apparatus and methods can be used to fragment or shear other species, such as chemical compounds, cells, organelles, particles, and molecular complexes.

As shown, the apparatus 1850 includes a housing 1852 that at least partially defines a sample reservoir 1868. The apparatus 1850 may include a plurality of shear walls 1861-1865 that are positioned within the sample reservoir 1868 and define a plurality of chambers 1871-1875 within the sample reservoir 1868. More specifically, the shear walls 1861-1865 include an outer shear wall 1865 that surrounds a plurality of inner shear walls 1861-1864. Optionally, the outer shear wall 1865 may be spaced apart from the housing 1852 and define an outer chamber 1875 therebetween. The shear walls 1861-1864 may at least partially define the chambers 1871-1874. As shown, first and second chambers 1871 and 1872 may be separated by the shear wall 1861; second and third chambers 1872 and 1873 may be separated by the shear wall 1862; third and fourth chambers 1873 and 1874 may be separated by the shear wall 1863; and the fourth and first chambers 1874 and 1871 may be separated by the shear wall 1864. As used herein, any two chambers that are separated by a shear wall may be referred to as adjacent chambers.

Although not shown, the apparatus 1850 may include top and bottom plates or covers, and may also include a gas permeable, liquid impermeable membrane such as those described above. The shear walls 1861-1865 may also be joined together in a unitary structure or body filter 1866. The body filter 1866 may be formed from a porous material, such as the porous core medium described above. The porous material may also comprise a fiber mesh, filter, or screen. The porous material may have pores that are sized to permit the species to flow therethrough. For example, the porous material may have pores that are sized to permit nucleic acids to flow therethrough. In particular embodiments, the pores can be sized to permit passage of nucleic acids that are smaller than a preselected size cutoff or to shear nucleic acids to a desired size. The body filter 1866 could be a frit and, more specifically, a cylindrical frit having interior cross-shaped walls that form the chambers. Alternatively, the shear walls 1861-1865 may comprise different materials. In other embodiments, the porous core media of the shear walls 1861-1865 comprise a common material having different properties (e.g., different porosity). Furthermore, in some embodiments, the shear walls 1861-1865 may have a wall thickness $T_H$ that is measured between the adjacent chambers.

Furthermore, the apparatus 1850 may include a plurality of electrodes 1881-1884 that are located within the chambers 1871-1874, respectively. Embodiments described herein may utilize electrodes to generate an electric field that exerts a force on a charged species. For example, DNA strands are typically negatively charged. Alternatively or in addition to, the embodiments described herein may induce a flow of the fluid to move species in a desired direction. Accordingly, the electrodes 1881-1884 may be configured to generate an electric field to move the species, such as nucleic acids or other biomolecules or polymers, through one or more of the shear walls 1861-1864 whether the resulting movement is caused by the force exerted on the charged species and/or by flow of the sample fluid. As the species pass through the pores of a shear wall, the species may be fragmented (or sheared) into smaller pieces.

Also shown, the apparatus 1850 may include a power source 1890 that selectively charges one or more of the electrodes 1881-1884 to generate different electric fields to move the species in different directions. For example, nucleic acids may be configured to move through the shear walls 1861-

1864 according to a predetermined sequence to fragment the nucleic acid to an approximate desired size. Alternatively or additionally, the pore size of the porous material can be selected to produce fragments of a particular maximum size or a particular size range. For example, the nucleic acids may be fragmented to a size of at most about 100 nucleotides, 500 nucleotides, 1000 nucleotides, 2000 nucleotide, 5000 nucleotides, or 10,000 nucleotides. Exemplary size ranges for nucleic acid fragments are from about 100 to about 1000 nucleotides, from about 100 to about 10000 nucleotides, from about 1000 to about 10,000 nucleotides, from about 500 to about 1000 nucleotides, from about 500 to about 10,000 nucleotides or any of a variety of other ranges resulting from the shearing conditions used.

The pore size and density within the porous material for the shear walls may be configured for its intended purpose. For example, an average pore size may be about 0.1 μm, 0.5 μm, 1 μm, 2 μm, 10 μm, 100 μm, or 1000 μm. The pore sizes may be less than about 0.1 μm or less than about 0.5 μm. The pore sizes may also be from about 0.5 μm to about 20 μm or from about 0.5 μm to about 10 μm. Larger pore sizes may also be used. For example, the pore sizes may be from about 10 μm to about 100 μm or, in other embodiments, from about 100 μm to about 1000 μm or larger. Furthermore, the pores may have a surface coating with properties configured to facilitate at least one of a flow of the fluid through the pores and the shearing of the species. For example, the surface coating of the pores may be hydrophobic or hydrophilic.

The wall thickness $T_H$ of the shear wall may be measured along the flow direction of the fluid. The wall thickness $T_H$ may also be configured for its intended purpose. For example, the wall thickness $T_H$ may be less than about 2 μm or less than about 10 μm. The wall thickness $T_H$ may also be less than about 25 μm or less than about 50 μm. Larger wall thicknesses $T_H$ may be used. For example, the wall thickness $T_H$ may be less than about 125 μm, less than about 250 μm, or less than about 500 μm. The wall thickness $T_H$ may also be less than about 1000 μm or less than about 10 mm.

Table 4 illustrates one predetermined sequence for operating the electrodes. However, various predetermined sequences may be configured to direct the species along a flow path through the sample reservoir 1868. The shear walls 1861-1865 may be positioned within the flow path so that the species move therethrough. The flow path is the path that the species moves along through the fragmentation process. Movement along the flow path may be caused by a flow of the sample fluid and/or a force exerted on the species if the species is charged. In some embodiment, the flow of the sample fluid and the force exerted on the species are in a common direction. However, in other embodiments, the flow of sample fluid and the force exerted on the species may be in opposite directions (i.e., counter-act each other).

With reference to Table 4 and FIG. 33, in a first stage the electrodes 1881 and 1882 may be positively and negatively charged, respectively, such that a bias potential or electric field exerts a force on a charged species. Alternative, or in addition to, movement of the species may be caused by flow of the sample fluid due to electroosmotic effect. The other electrodes 1883 and 1884 may have no charge. The electric field may be held for a predetermined time period $T_1$ so that the species move from the first chamber 1871 to the second chamber 1872. As the species pass through the shear wall 1861, the species may be fragmented or sheared to smaller sizes (e.g., lengths).

TABLE 4

| | $T_1$ | $T_2$ | $T_3$ | $T_4$ | $T_5$ | $T_6$ |
|---|---|---|---|---|---|---|
| Electrode 1881 | (+) | 0 | 0 | 0 | 0 | (−) |
| Electrode 1882 | (−) | (+) | 0 | 0 | (−) | (+) |
| Electrode 1883 | 0 | (−) | (+) | (−) | (+) | 0 |
| Electrode 1884 | 0 | 0 | (−) | (+) | 0 | 0 |

During a second stage, the electrodes 1882 and 1883 may be positively and negatively charged, respectively, and the other electrodes 1881 and 1884 may have no charge. The generated electric field moves the species from the second chamber 1872 to the third chamber 1873. As the fragments pass through the shear wall 1862, the fragments may be further fragmented or sheared to smaller sizes. In the illustrated embodiment, the shear walls 1861 and 1862 have a common porosity. However, in alternative embodiments, the shear wall 1861 may have pores that have a greater size than pores of the shear wall 1862.

During a third stage, the electrodes 1883 and 1884 may be positively and negatively charged, respectively, and the other electrodes 1881 and 1882 may have no charge. The generated electric field moves the species from the third chamber 1873 to the fourth chamber 1874. As the fragments of the species pass through the shear wall 1863, the fragments are further fragmented or sheared to smaller sizes. In the illustrated embodiment, the shear walls 1862 and 1863 have a common porosity. However, in alternative embodiments, the shear wall 1862 may have pores that have a greater size than pores of the shear wall 1863.

At some point in the fragmentation process, a pair of electrodes may switch charges thereby reversing the electric field such that the flow of the species is reversed. As shown in the illustrated embodiment, the fragments are moved in a clockwise direction from the first to third stages. During stages four through six, the fragments may be directed in an opposite direction (i.e., counter-clockwise) such that the fragments move from the fourth chamber to the third chamber to the second chamber and to the first chamber. Changing a direction of the flow during the fragmentation process may facilitate reducing adsorption of the fragments to the electrodes 1881-1884. However, in alternative embodiments, the fragments may continue to move in a clockwise manner from chamber to chamber.

In other embodiments, the chamber 1875 may also have one or more electrodes 1885 therein. In such embodiments, the sample fluid may be introduced generally into the sample reservoir 1868 or specifically into the chamber 1875. Before the charge sequences discussed above are executed, the species may be moved to within the chambers 1871-1874 by charging the electrodes 1881-1885 accordingly. More specifically, the electrodes 1881-1884 may be negatively charged and the electrodes 1885 may be positively charged. After the species are generally located within the chambers 1871-1874, the charged sequences may be executed to move the species as described above.

A desired fragment size may be obtained by configuring various factors, including, but not limited to, wall thicknesses $T_H$, porosities of the shear walls, sizes of the pores, a flow rate of the species through the shear walls (which may be determined by the bias potential between associated electrodes), concentration of the material to be fragmented, fluid viscosity, and combinations of two or more of these factors.

Although not shown, the apparatus 1850 may be part of a fluidic network and/or located within a flow cell, such as the various embodiments described above. The apparatus 1850 may also be used in a device, such as a microplate.

Figure 34:
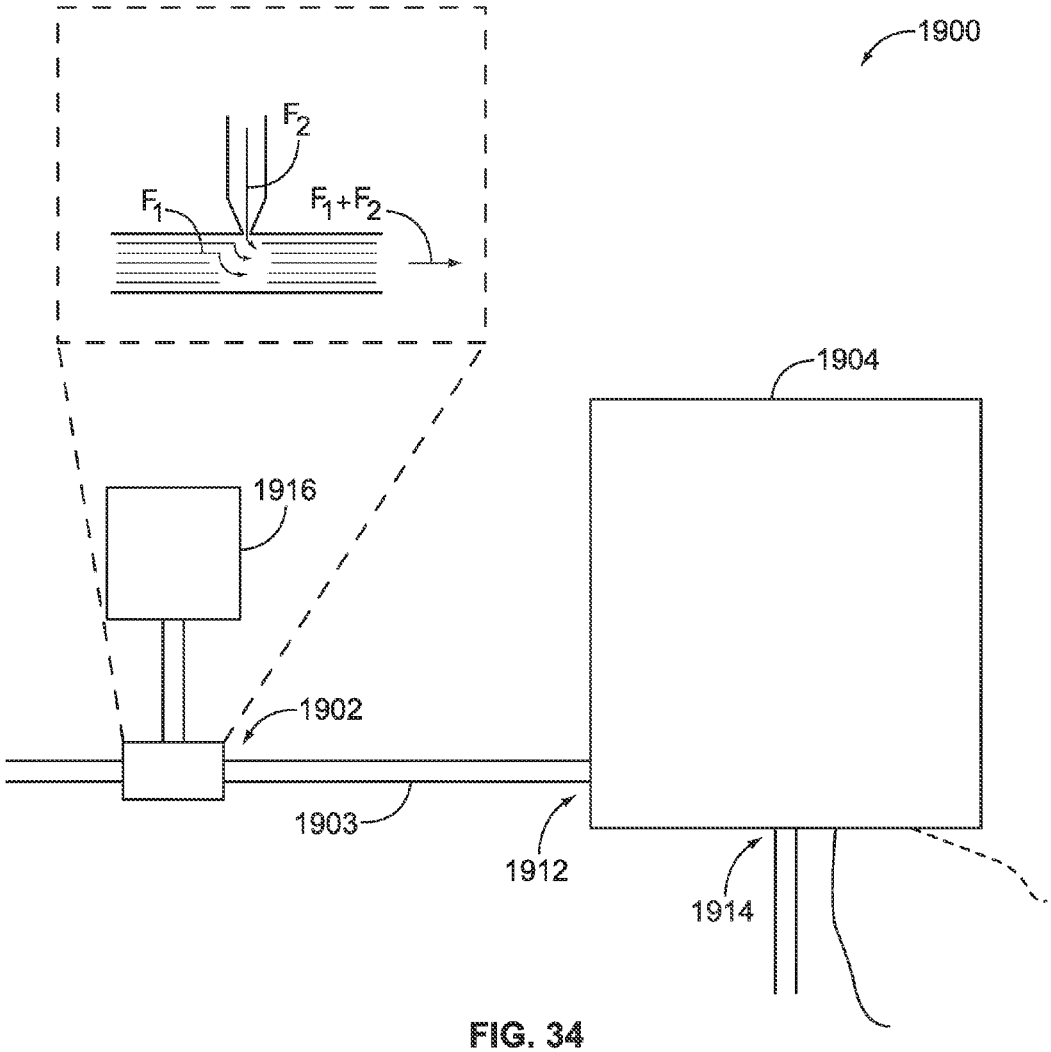
FIG. 34 is a side view of a pump system that may be used in accordance with various embodiments.

FIG. 34 illustrates a flow system (or subsystem) 1900 that may be used with various embodiments described herein. As shown, the flow system 1900 includes a fluid-delivery port or inlet 1902 and an electroosmotic (EO) device 1904 that is in fluid communication with the fluid-delivery port 1902 through a fluidic channel 1905. The EO device 1904 may be various kinds of EO pumps, such as those described above, or may be a species fragmenting apparatus, such as the apparatus 1850.

In the illustrated embodiment, the EO device 1904 may include inlet and outlet ports 1912 and 1914. Although not shown, the EO device 1904 may include separate reservoirs that are separated by a porous core medium. The inlet port 1912 may deliver fluid to an interior reservoir and the outlet port 1914 to an exterior reservoir, or, alternatively, the inlet port 1912 may deliver fluid to the exterior reservoir and the outlet port 1914 to the interior reservoir.

The fluid-delivery port 1902 is in fluid communication with a fluid reservoir 1916 and is configured to introduce a fluid $F_2$ from the fluid reservoir 1916 into a fluid $F_1$ that is flowing through the fluidic channel 1905. In the illustrated embodiment, the fluid-delivery port 1902 and the EO device 1904 are in direct fluid communication with each other such that fluid $F_2$ entering the fluidic channel 1905 flows directly into the EO device 1904.

The fluid-delivery port 1902 may facilitate maintaining a desired fluidic environment of the fluid in the EO device 1904. During operation of EO devices, the internal fluidic environment may change or be affected by gases or materials within the fluid. Accordingly, the fluid-delivery port 1902 may introduce the fluid $F_2$ to facilitate maintaining electrochemistry of the fluid therein and/or maintaining a flow rate within the EO device 1904. The fluid $F_2$ may have predetermined properties or other characteristics to maintain the electrochemistry. Accordingly, the flow system 1900 may also be referred to as a fluidic environment regulator 1900.

In other embodiments, the fluid $F_2$ may function exclusively as a flushing or cleaning solution that is delivered through the fluidic channel 1905 to remove any unwanted chemicals or matter within the EO device. For example, in embodiments that include a nucleic acid fragmenting apparatus, unwanted DNA fragments may remain attached to the porous core medium of the apparatus. The fluid $F_2$ may be introduced to remove the unwanted DNA fragments. For example, the fluid $F_2$ may be flushed through the EO devices using a predetermined charge sequence (i.e., a cleaning or flushing sequence). Accordingly, the flow system 1900 may also be referred to as a flushing or cleaning system 1900.

Although only one fluid reservoir 1916 and fluidic channel 1905 are shown in FIG. 34, separate fluidic channels may be in fluid communication with the EO device 1904 in alternative embodiments. Respective fluids may be introduced to either of the interior reservoirs of the EO device 1904 as desired.

It is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." The term "comprising" is intended herein to be open-ended, including not only the recited elements, but further encompassing any additional elements. Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A system or device for biochemical analysis comprising:

a plurality of fluid lines configured to have liquids flow therethrough for biochemical analysis; and at least one electroosmotic (EO) pump configured to pump the liquids through the plurality of fluid lines, the at least one EO pump comprising:

a housing having a pump cavity;

a porous core medium positioned within the pump cavity to form an exterior reservoir that extends at least partially about an exterior surface of the porous core medium, the porous core medium having an inner chamber provided therein, the inner chamber representing an interior reservoir; and electrodes positioned in the inner chamber and positioned proximate the exterior surface, the electrodes configured to induce a flow of the corresponding liquid through the porous core medium between the interior and exterior reservoirs, wherein a gas is generated when the electrodes induce the flow of the corresponding liquid;

the housing having a fluid inlet to convey the corresponding liquid to one of the interior reservoir and the exterior reservoir, the housing having a fluid outlet to discharge the corresponding liquid from another of the interior reservoir and the exterior reservoir, the housing having a gas outlet to discharge the gas from the pump cavity.

2. The system or device of claim 1, further comprising a body, wherein the at least one EO pump includes a plurality of EO pumps that are held in fixed positions with respect to one another by the body, the EO pumps being oriented with respect to the body such that the gases are directed toward the respective gas outlets during operation of the system or device.

3. The system or device of claim 2, wherein the body is a flow cell body that includes the fluid lines, the system or device constituting a flow cell.

4. The system or device of claim 2, wherein the body is a manifold body that includes the fluid lines, the system or device constituting a manifold.

5. The system or device of claim 2, further comprising reagent containers configured to hold the liquids, the fluid lines being in fluid communication with the reagent containers.

6. The system or device of claim 1, further comprising a detector system that is configured to detect light from at least some of the fluid lines.

7. The system or device of claim 1, wherein the at least one EO pump is located downstream from the fluid lines and configured to draw the liquids through the fluid lines.

8. The system or device of claim 1, wherein the porous core medium includes a cylindrical body that is placed in an upright configuration within the pump cavity to separate the pump cavity into the interior and exterior reservoirs.

9. The system or device of claim 8, wherein the cylindrical body has a height and a diameter that are measured perpendicular to each other, the height being less than the diameter.

10. The system or device of claim 1, wherein the housing has a height and a width that are measured perpendicular to each other, the height being less than the width.

11. The system or device of claim 1, wherein the fluid inlet is a first fluid inlet, the housing including a second fluid inlet that conveys the corresponding liquid into the pump cavity.

12. The system or device of claim 1, wherein the at least one EO pump includes a plurality of EO pumps and at least one of the EO pumps is in flow communication with more than one of the fluid lines.

13. The system or device of claim 1, wherein the gas outlet includes a liquid impermeable, gas permeable membrane to block flow of the corresponding liquid therethrough while permitting flow of the gas therethrough.

14. The system or device of claim 1, wherein the porous core medium wraps about a longitudinal axis that projects along the interior reservoir, the interior reservoir having at least one open end.

15. The system or device of claim 1, wherein the pump cavity includes a bottom wall on which the porous core medium is positioned, the bottom wall including the fluid inlet therethrough to deliver the liquid to the inner chamber of the porous core medium.

16. The system or device of claim 1, wherein the inner chamber of the medium core is open at bottom and top ends, the gas being directed from the inner chamber to the top end of the medium core to be discharged.

17. The system or device of claim 1, wherein the pump cavity includes a top wall holding a vent membrane proximate the gas outlet to permit gas to vent from the pump cavity.

18. The system or device of claim 1, wherein surfaces on at least one of the pump cavity, porous core medium, and electrodes are coated with a hydrophilic material to reduce attachment of gas bubbles and induce migration of gas bubbles.

19. The system or device of claim 1, wherein the at least one EO pump includes a motion source to induce motion into at least one of the housing, electrodes, and gas bubbles to actively cause the gas bubbles to detach.

20. The system or device of claim 1, wherein the at least one EO pump includes a plurality of EO pumps, the system or device further comprising a computing system that selectively controls the EO pumps such that one or more of the EO pumps induce the flow of the corresponding liquid(s) while one or more of the other EO pumps do not induce the flow of the corresponding liquid(s).

* * * * *